US009944416B2

(12) United States Patent
Hauke et al.

(10) Patent No.: US 9,944,416 B2
(45) Date of Patent: Apr. 17, 2018

(54) FILLING DEVICE AND USE THEREOF FOR DISPENSING A FLUID

(71) Applicant: MERCK PATENT GMBH, Darmstadt (DE)

(72) Inventors: Guenter Hauke, Muehltal (DE); Holger Jost, Trebur-Geinsheim (DE); Leticia Garcia Diez, Darmstadt (DE); Michael Ukelis, Riedstadt (DE); Guenter Brenner, Griesheim (DE)

(73) Assignee: Merck Patent GmbH, Darmstadt (DE)

( * ) Notice: Subject to any disclaimer, the term of this patent is extended or adjusted under 35 U.S.C. 154(b) by 0 days.

(21) Appl. No.: 14/761,165

(22) PCT Filed: Dec. 5, 2014

(86) PCT No.: PCT/EP2014/003258

§ 371 (c)(1),
(2) Date: Jul. 15, 2015

(87) PCT Pub. No.: WO2015/090524

PCT Pub. Date: Jun. 25, 2015

(65) Prior Publication Data

US 2016/0272346 A1 Sep. 22, 2016

(30) Foreign Application Priority Data

Dec. 16, 2013 (DE) ..... 10 2013 020 638

(51) Int. Cl.

| | |
|---|---|
| ***B65B 3/28*** | (2006.01) |
| ***B65B 39/12*** | (2006.01) |
| ***B65B 43/59*** | (2006.01) |
| ***B65B 57/04*** | (2006.01) |
| ***B65B 57/14*** | (2006.01) |
| ***B65B 31/00*** | (2006.01) |
| ***B65B 65/06*** | (2006.01) |

(52) U.S. Cl.

CPC ..... *B65B 3/28* (2013.01); *B65B 31/00* (2013.01); *B65B 39/12* (2013.01); *B65B 43/59* (2013.01);

(Continued)

(58) Field of Classification Search

CPC ..... B65B 3/28; B65B 39/12; B65B 43/59

(Continued)

(56) References Cited

U.S. PATENT DOCUMENTS 4,211,263 A 7/1980 Kennedy et al.
4,832,092 A * 5/1989 Hirose ..... B65B 3/28 141/1

(Continued)

FOREIGN PATENT DOCUMENTS

CN 86105747 A 1/1987
CN 1498181 A 5/2004

(Continued)

OTHER PUBLICATIONS

International Search Report dated Mar. 24, 2015 issued in corresponding PCT/EP2014/003258 application (pp. 1-4).
Office Action for related Chinese patent Application No. 201480068155.7 dated Feb. 24, 2018.
Office Action for related Taiwanese Patent Application No. 1036143725 dated Jan. 18, 2018.
English Translation of Office Action for related Taiwanese Patent Application No. 1036143725 dated Jan. 18, 2018.

(Continued)

*Primary Examiner* — Timothy L Maust
*Assistant Examiner* — Timothy P Kelly
(74) *Attorney, Agent, or Firm* — Millen White Zelano and Branigan, PC; Csaba Henter

(57) ABSTRACT

The invention relates to a filling device (1) for dispensing a fluid into at least one container, where the filling device (1) has a weighing system (2) and a filling-needle system (3). The weighing system (2) has a positioning device (4) which can be adapted to a container diameter and which may have an annular design. The weighing system (2) is arranged on an accommodation platform (7) which can be moved vertically by means of a linear unit. The filling-needle system (3) is arranged on a displacement unit in a position at a distance in the axial direction above the positioning device (4).

15 Claims, 2 Drawing Sheets

(52) U.S. Cl.
CPC ..... *B65B 57/04* (2013.01); *B65B 57/145* (2013.01); *B65B 65/06* (2013.01)

(58) Field of Classification Search
USPC ..... 141/83, 177, 269–270, 374, 378, 387
See application file for complete search history.

(56) References Cited

U.S. PATENT DOCUMENTS

| | | | | |
|---|---|---|---|---|
| 7,278,451 | B2 * | 10/2007 | Cavallari | B67C 3/202 141/152 |
| 7,438,019 | B2 | 10/2008 | Lofink, Jr. et al. | |
| 7,503,355 | B2 | 3/2009 | Bruna et al. | |
| 2004/0079438 | A1 | 4/2004 | Bruna et al. | |
| 2006/0144252 | A1 | 7/2006 | Lofink, Jr. et al. | |
| 2009/0283175 | A1 | 11/2009 | Husard | |

FOREIGN PATENT DOCUMENTS

| | | | | |
|---|---|---|---|---|
| CN | 102126693 | A | 7/2011 | |
| CN | 203079662 | U | 7/2013 | |
| DE | 102004053474 | A1 | 6/2005 | |
| DE | 102008017942 | A1 | 10/2009 | |
| FR | 2900127 | A1 * | 10/2007 | B65B 3/28 |
| TW | 200631860 | A | 9/2006 | |

OTHER PUBLICATIONS

English Abstract of CN 102126693, dated Jul. 20, 2011.
English Abstract of CN86105747, dated Jan. 1, 1987.
English Abstract of CN203079662, dated Jul. 24, 2013.

* cited by examiner

FILLING DEVICE AND USE THEREOF FOR DISPENSING A FLUID

The invention describes a filling device for dispensing a fluid, in particular a liquid-crystal mixture, into at least one container, and the use thereof for dispensing a liquid-crystal mixture.

Various filling devices or filling machines are known by means of which a meterable amount of fluid can be introduced into a container. The fluid can be, for example, liquid or flowable chemical raw materials or end products which are used in the chemical or pharmaceutical industry. The fluid may also be a liquid food or a liquid component for the preparation of foods.

The fluid can be introduced into the container by means of a filling-needle system. Reliable metering during the filling operation can be ensured via a weighing system.

Suitable containers which are employed in the context of industrial use are usually drums, canisters or bottles which are made from plastic, metal or glass. Containers of this type serve for the transport or storage of the liquid introduced into the container. So-called rotary machines, for example, are known here, in which small containers to be filled are automatically fed into a rotating conveyor device and filled with the desired liquid or the pre-specified fluid in the filling machine.

The fluids are usually pumped into the container to be filled from a fluid reservoir, for example from a further container, by means of a pump. The containers to be filled may differ here with respect to their size and shape, meaning that adaptation of the filling machine to the container to be filled in the individual case is regularly necessary. It is regarded as disadvantageous here that each change in the container size requires re-fitting of the filling device.

It is known from practice that a filling nozzle of the filling device which is used for filling the containers can be displaced axially and is moved out or in depending on the container size. The length of the section projecting into the container can be changed and adapted to respective other container sizes. In spite of the possibility of adjustment for the length of the filling nozzle, the use of a filling machine of this type is restricted, since calibration of the filling speed has to be carried out and in addition the containers have to be positioned manually. For containers which have a different diameter of the opening intended for the introduction of the liquid, either the container position must be pre-specified separately, giving rise to an additional handling operation, or alternatively a separate filling machine adapted to the containers in question must be used.

Particularly in the case of the dispensing of liquid-crystal mixtures, high demands are made of the filling machine or of the filling operation, such as, for example, clean-room ambient conditions. Before the filling of the containers with liquid-crystal mixtures, the containers to be filled generally have to be inertised, which is usually carried out before arrangement of the containers in a filling position and is subsequently followed by displacement of the containers from an inertisation position to the filling position.

It is therefore regarded as an object of the present invention to design a filling machine for dispensing liquids into a container in such a way that the filling machine can be adapted to different containers with as little effort as possible and optionally offers possibilities for inertisation.

This object is achieved in accordance with the invention in that a filling device for dispensing a fluid into at least one container is provided, where the filling device has at least one weighing system and a filling-needle system, where the weighing system has at least one container positioning device which can be adapted to a container diameter, where the weighing system is arranged on an accommodation platform which can be moved vertically by means of a linear unit and where the filling-needle system is arranged on a displacement unit in a position at a distance in the axial direction above the positioning device.

For the purposes of the present invention, the term fluid is taken to mean all flowable inorganic, organic or biological systems or mixtures, for example true or colloidal solutions, suspensions, emulsions, melts, dispersions, liquid/gas dispersions or mixtures thereof. In particular, liquid-crystalline mixtures and isotropic liquid mixtures are taken to be fluids in the sense of the invention.

The filling device can advantageously be used for dispensing a liquid-crystal mixture into at least one container, where the filling is preferably carried out in a clean room. Owing to its advantageous design, the device is suitable for use in clean rooms. This has proven extremely positive, since the filling-device design according to the invention means that it is not necessary to re-fit the filling device in the case of a change of the containers, enabling costs and work to be saved. In particular, the possibility that inertisation and filling of a container can be carried out using the filling device without major manual interventions or displacement of the container or a complex re-fitting operation being necessary has proven advantageous for use of the filling device, in particular in a clean room. In addition, the high quality and purity of the dispensed fluid can be retained, in particular in the case of a liquid-crystal mixture.

A filling device is provided by means of which high filling accuracy is achieved. The filling operation can be monitored by a high-precision balance. The weighing system containing the balance has at least one positioning device, preferably with an annular design, for at least one container. This enables not only weighing of the empty container, but also monitoring of the filling operation itself and the amount of fluid metered in during the filling operation. During the filling operation, the volume flow of the liquid to be introduced is preferably monitored at specifiable intervals by a process computer integrated into the weighing system, and this actual value determined is compared with a nominal value. The volume flow can be increased or reduced manually or automatically if necessary. The change in the volume flow can take place via a membrane valve installed upstream of the filling-needle system. Other adjustable or controllable valves are also conceivable.

In a preferred embodiment of the device, an operator unit, for example a touch-screen monitor with a reader, is connected to the filling device. Via the reader, which is designed, for example, as a barcode scanner, information or a barcode on a container to be filled or on a storage container of the fluid to be dispensed can be input. This information is compared with a database, after which adjustments specific to the filling operation, i.e. specific to the container or specific to the product, can be carried out automatically on the filling device, so that an individual filling operation can be guaranteed for different fluids or for different containers.

In order to facilitate adaptation to the different container sizes or drum sizes, the weighing system with the positioning device is arranged on an accommodation platform which can be moved vertically by means of a linear unit, so that the position of the weighing system and thus of the container relative to the filling-needle system can be adjusted depending on the container to be filled, i.e. depending on its volume or size. The accommodation platform is moved automatically to the height required for the filling of the container by a machine control system of the linear unit. Additional detection of the empty container via the tare weight can prevent malfunctions of the filling device.

It may also be advantageous for the filling device to comprise two or more weighing systems, where the weighing systems are each arranged on a separate accommodation platform which can be moved vertically by means of in each case one linear unit. The accommodation tables can be controlled separately, enabling two containers, in particular two containers of different size, to be filled simultaneously by means of the filling device.

It is likewise possible and advantageous for certain applications to arrange two or more weighing systems on a common accommodation platform, if the filling device is used predominantly for the filling of a single container size.

In a particularly advantageous embodiment, the filling device has two weighing systems, where the two weighing systems are each mounted on an accommodation platform which can be moved vertically by means of in each case one linear unit.

The weighing system preferably has at least one container positioning device with an annular design. In the case of two weighing systems or more, it is advantageously provided that each weighing system with in each case one positioning device is arranged on the at least one movable accommodation platform. The weighing system may in addition have a universal positioning device, by means of which the containers can be reliably centred and positioned. This has proven advantageous, since this enables the filling needle to be positioned reproducibly in the opening of the containers. This universal adaptation ability of the positioning device is provided through the positioning device consisting of a plurality of annular bulges and each bulge being intended or standardised for a defined container size. Clamping means may also be utilised for positioning of the containers.

The containers which are particularly suitable for use with the filling device are glass bottles in the sizes 0.1-0.5 l and 1 l, and steel containers in the size 10 l. This adaptation ability of the positioning device guarantees universal usability of the device and is to be regarded as an essential advantage over the filling devices known in the prior art. The filling device can of course be extended at any time with further positioning devices which are standardised to further container sizes. The positioning devices can advantageously be fixed on or to the weighing system by means of a non-positive or positive connection, enabling fast replacement.

It has proven advantageous if the filling device, in particular the weighing system and the volume flow, can be matched to the liquid to be dispensed and the containers. This enables product-specific filling through adaptation of the filling parameters via software of the device control system. Differing properties of the fluids, in particular different liquid-crystal mixtures, also require different filling parameters. The optimum filling parameters can be determined in advance in a suitable manner in experiments and saved in a database. During initialisation of the device, the product-specific data can be read in via an input device or reader, for example a barcode reader, and identified from a barcode on the documents accompanying the batch. Fine adjustment of the parameters may in addition also be possible by hand.

Furthermore, it is advantageous to use a pump, whose control can be taken on by the filling device. The corresponding parameters are preferably called up via the database, and, for example, the volume flow is regulated correspondingly. The filling device may also advantageously ensure pressure regulation of a storage container and thus media transport.

The filling-needle system is preferably arranged on a horizontally movable displacement unit at a distance in the axial direction above the positioning device. The filling is preferably carried out under software control in the steps coarse, medium and fine flow. This enables the duration of the filling operation to be minimised.

According to an advantageous embodiment of the inventive idea, it is provided that the filling-needle system comprises a combined filling and inertisation needle. In addition, the diameters of the combined filling and inertisation needles may have been optimised in experiments with respect to the filling flow to be expected. Before the filling, the container is preferably inertised by means of a noble gas.

For this purpose, the filling-needle system may, in addition to the filling needle, have a second tube welded on at the side or, in another embodiment, a tube mounted coaxially over the filling needle. This tube is likewise called a needle in the sense of the invention. This means that the filling-needle system preferably comprises a first needle for the inertisation and a second needle for the filling. The combination of an inertisation needle and a filling needle enables the inertisation and filling operation to be carried out in one position, namely in the filling device according to the invention, without displacement of the container being necessary. The inertisation tube or the inertisation needle may advantageously be somewhat tapered in a front region in order to facilitate introduction of the needle into glass bottles having narrow mouths.

In a preferred embodiment of the device, the filling-needle system is arranged in a clamping block which can be removed from the displacement unit. The entire filling-needle system is preferably mounted in a clamping block and can thus be prepared and assembled outside the device. The clamping block can be mounted on and fixed to the displacement unit using attachment means known to the person skilled in the art, in particular screws. The filling-needle system is preferably installed in the clamping block using clamp connections, in particular in accordance with DIN standards 32676, 11851, 11864 and 11853. This guarantees rapid assembly and disassembly.

Components of the filling-needle system which may come into contact with the respective fluid used during the filling operation preferably consist of stainless steel and/or polytetrafluoroethylene (PTFE). However, it may likewise be advantageous, depending on the proposed application, to use other metals or plastics. Plastics denote, in particular, materials whose essential constituents consist of macromolecular organic compounds which are formed synthetically or by modification of natural products. The plastics also include, in particular, the rubbers and the synthetic fibres. For the advantageous embodiment, use can be made of plastics from the group modified natural products, synthetic plastics (polycondensates, polymers, polyaddition products), thermosets and/or unsaturated polyester resins, including cellulose nitrate, cellulose acetate, cellulose mixed esters, cellulose ethers, polyamide, polycarbonate, polyester, polyphenylene oxide, polysulfone, polyvinylacetal, polyethylene, polypropylene, poly-1-butene, poly-4-methyl-1-pentene, ionomers, polyvinyl chloride, polyvinylidene chloride, polymethyl methacrylate, polyacrylonitrile, polystyrene, polyacetal, fluorinated plastics, polyvinyl alcohol, polyvinyl acetate, poly-p-xylylene, linear polyurethanes, chlorinated polyethers, casein plastics, crosslinked polyurethanes, silicone, polyimide and/or polybenzimidazole.

It may furthermore be advantageous for the components of the filling-needle system to be made from metal, in particular from stainless steel. Stainless steel is resistant to water, water vapour, atmospheric moisture, edible acids and to weak organic and inorganic acids and offers the filling needle good protection against many different fluids. It may of course also be advantageous to make the filling-needle system from a combination of metal and plastic.

The clamping block of the filling-needle system is attached to the displacement unit, where the displacement unit and in particular the clamping block can be moved at least horizontally for fine adjustment by means of suitable means. This enables slight inaccuracies of the needle geometry of different needles to be compensated. The adjustment can advantageously be carried out by hand using adjustment screws, so that fine adjustment in the direction of the X and Z axes of the filling-needle system is possible.

In a preferred embodiment, the filling device has a drop-catching system, where the drop-catching system, which is attached to a swivel arm and includes a vessel, can be swivelled beneath the filling-needle system if no container is located in the positioning device or the filling operation is complete. Dripping of liquid, in particular liquid-crystal mixture, out of the filling needle onto the weighing system can thus be prevented.

The filling needle is optimised with respect to its dimensions so that it preferably projects into the opening of the container. In order to prevent dripping of liquid out of the filling-needle system in a filling-needle design of this type too, a drop-catching system adapted thereto may be integrated. It consists, in particular, of a vessel, in particular a collection vessel, which is mounted on a swivel arm, which can be moved beneath the filling-needle system automatically or manually after the filling operation, i.e. as soon as the filling operation is complete or no container is located in the positioning device of the weighing system, the vessel can be swivelled beneath the filling-needle system. This enables dripping of liquid onto the weighing system to be reliably prevented.

A filter unit for filtration of the fluid to be dispensed is advantageously installed upstream of the membrane valve used to control the volume flow. Before the filling, all the liquid to be dispensed is preferably filtered through a filter unit. A filter unit of this type can, for example, be mounted on the side of the device in a corresponding filter holder and may include an ultrafine filter. The filter is preferably attached to a quick-change filter holder in a readily accessible manner. It can advantageously be prepared before attachment and subsequently mounted on the filter holder, preferably via a clamp connection.

In order to prevent undesired effects due to electrostatic charging of the liquid, in particular the liquid-crystal mixture, during the filling operation, ionisers are in a preferred embodiment of the device installed laterally, above and/or below the filling-needle system and emit a directed stream of ionised air against the filling-needle system and/or the filling region. This enables, in particular, effects such as a liquid-crystal mixture flowing past the opening or mouth of the container to be filled due to electrostatic charging to be substantially prevented.

It may furthermore be advantageous for protective walls having an antistatic coating to be arranged laterally to the filling-needle system. The protective walls are preferably earthed. The protective walls enable any interfering electrostatic effects otherwise possibly occurring owing to the laminar flow of the fluid to be dispensed to be reduced or even entirely prevented.

In the following list, various features and advantages of the filling device according to the invention are summarised:

- high filling accuracy (in particular −0%/+0.3 −0.03%);
- high filling speed including inertisation of the container, in particular 0.5 l in 30 seconds;
- use of glass bottles of different dimensions and in particular 10 l containers on one device possible;
- filling-needle system which is easy to disassemble and clean;
- inertisation of the containers before filling;
- filtration of the filling medium, in particular the liquid, before filling;
- fine adjustment of the filling-needle system via the displacement unit possible;
- integrated ionisers for ionisation of the filling point in order to reduce electrostatic effects;
- drop-catching system for preventing contamination and incorrect measurements of the device by dripping liquid, in particular liquid-crystal mixture;
- product-specific filling by adaptation of the filling parameters via the software of the device control system.

Further advantageous embodiments are explained in greater detail with reference to an illustrative embodiment depicted in the drawing, in which:

BRIEF DESCRIPTION OF DRAWINGS

FIG. 1 shows a diagrammatic representation of a preferred filling device 1. The filling device 1 comprises two separate weighing systems 2, two filling-needle systems 3, two positioning devices 4 which can be adapted to a container diameter, and two drop-catching systems 5.

Figure 1:
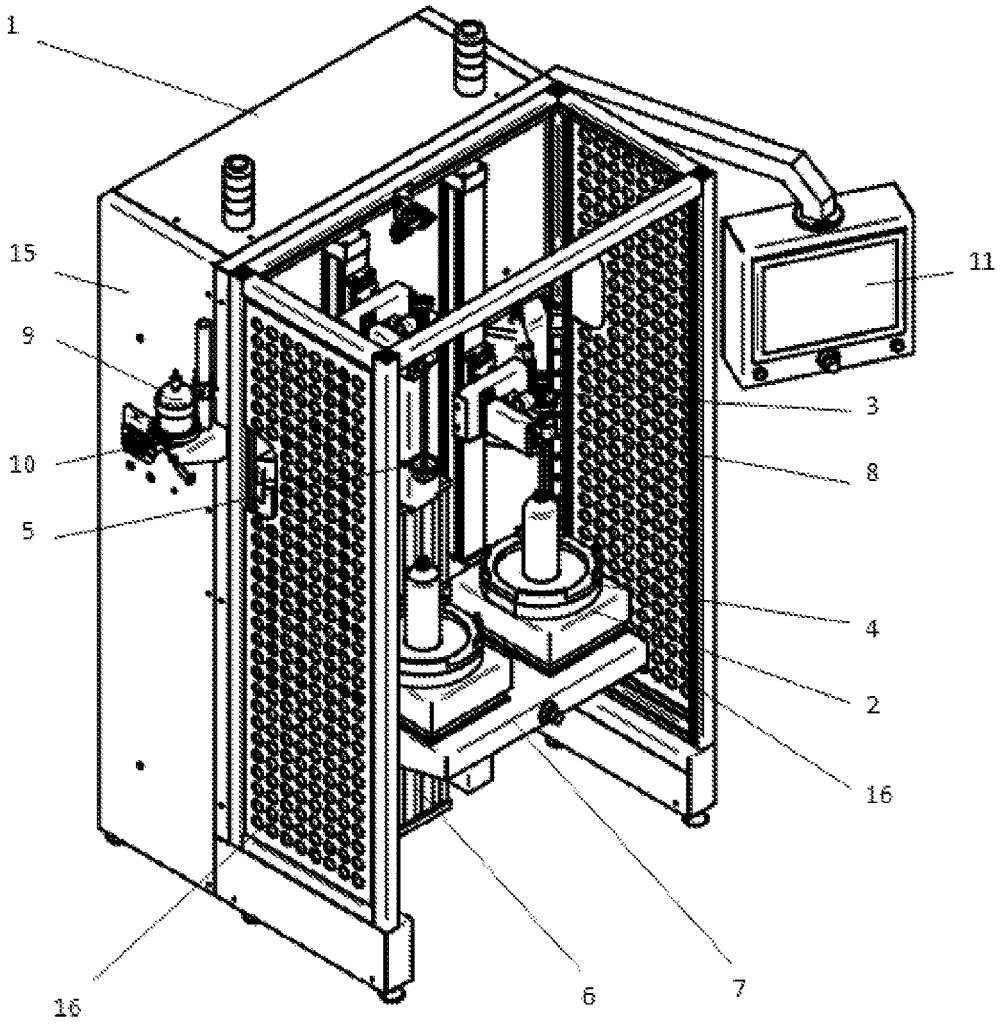
FIG. 1 shows an illustrative depiction of a filling device according to the invention.

The container positioning device 4 has an annular design and has bulges of different size, so that containers having different sizes or diameters can be introduced and fixed reliably in the respective positioning device.

In order to enable the two weighing systems 2 to be moved vertically, the two weighing systems 2 are arranged on an accommodation platform 7 which can be moved vertically by means of a linear unit 6. The two weighing systems 2 can be adapted uniformly to different container sizes by means of the common accommodation platform 7, where automatic or manual displacement of the accommodation platform 7 can take place.

In the case where a plurality of containers of different size are to be filled independently of one another and if possible simultaneously with one or more fluids, each weighing system 2 could, contrary to the illustrative variant depicted by way of example, be arranged on an assigned accommodation platform 7 each, where the accommodation tables 7 can be moved vertically independently of one another by means of in each case one linear unit 6. This enables the accommodation tables 7 to be moved into different positions, enabling the filling of different container sizes.

The filling-needle systems 3 are each arranged in a position at a distance in the axial direction above the positioning devices 4 on a displacement unit 8 which can be moved horizontally. This enables each filling-needle system 3 and the assigned weighing system 2 to be adapted to different container sizes. The adjustment of the filling-needle system 3 takes place via a fine adjustment which enables horizontal displacement of the system 3 in the X and Z directions. Simultaneous horizontal and vertical movability of the filling-needle system 3 may optionally also be provided. It has been found that this enables it to be ensured that the filling-needle system 3 penetrates to an optimum extent into the opening of a container and efficient and lossfree filling is possible.

In order to prevent fluid residues dripping out of the filling-needle system 3 onto the weighing system 2 after filling of a container, the drop-catching system 5, which is attached to a swivel arm and includes a vessel, can advantageously be swivelled beneath the associated filling-needle system 3 after filling. It can thus be ensured that the weighing system 2 is not contaminated by fluid residues and the weighing of a current or future filling operation is thereby falsified. The drop-catching system 5 may of course also be designed in such a way that it swivels automatically beneath the filling-needle system 3 as soon as or if no container is located in the positioning device 4.

Before filling of a container located in the positioning device 4, the fluid to be dispensed is advantageously purified using a filter unit 9. The filter unit 9, preferably an ultrafine filter, can be mounted on the side of the filling device 1 in a filter holder 10. The filter unit 9 can be prepared before beginning the filling and inserted rapidly into the filter holder 10, in particular via clamp connections.

Different properties of the fluids and in particular liquid-crystal mixtures to be dispensed require adaptation of the filling to the differing properties of the fluids in question. The specific filling parameters, such as, for example, adjustment of the weighing system, the container size, a filling speed and optionally ionisation, can be determined in advance and stored in a database. During initialisation of the filling device, these parameters can be input into the filling device 1, for example via a touch-screen monitor 11. The filling device 1 subsequently automatically adjusts all relevant parameters correspondingly. However, it may also be advantageous for the product-specific data to be input via a reader, for example a barcode reader (not depicted), from a barcode on documents accompanying the batch, on containers to be filled or on a storage container of the fluid to be dispensed. The barcode reader can thus be an advantageous supplement of the filling device 1 and may be connected, for example, to the touch-screen monitor 11. The filling device 1 is arranged in a switching cabinet 15, which also accommodates circuitry of supply and discharge lines of the filling device 1.

Side walls 16 which have an antistatic coating may be arranged laterally alongside the weighing systems 2 or alongside the filling-needle systems 3, so that electrostatic charges formed by a laminar flow of the liquid to be dispensed are prevented.

Figure 2:
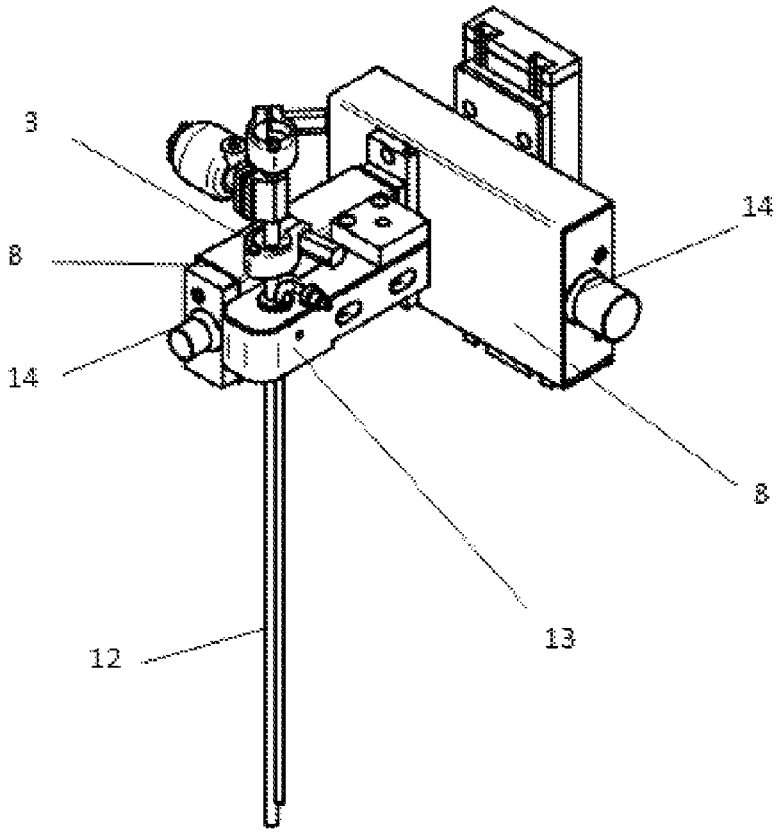
FIG. 2 shows an illustrative depiction of a filling-needle system for the filling device shown in FIG. 1.

FIG. 2 shows an enlarged representation of the filling-needle system 3. The filling-needle system 3 comprises a combined filling and inertisation needle 12. Filling and inertisation of a container are thus possible using the filling-needle system 3 of the filling device without the container having to be transported to a further station for this purpose.

The filling-needle system 3 is fixed in a clamping block 13 and may be assembled outside the filling device 1. The clamping block 13 can be mounted on the displacement unit (not depicted in FIG. 2) using attachment means, for example screws. The installation of the filling-needle system 3 in the clamping block 13 is carried out in an advantageous manner by means of clamp connections, enabling rapid assembly and disassembly. The filling-needle system 3 may furthermore have screws 14 for the fine adjustment of the filling-needle system 3 on the displacement unit, so that the position of the combined filling and inertisation needle 12 in the opening of a container is achieved. The fine adjustment preferably enables the filling-needle system 3 and/or the clamping block 13 to be moved horizontally and/or vertically on the displacement unit.

The filling device described above is particularly suitable for liquid-crystal mixtures. In particular, liquid-crystal mixtures comprising at least two organic substances, preferably mesogenic, in particular liquid-crystalline substances, are used here, where the organic substances are preferably selected from the compounds of the general formula I,

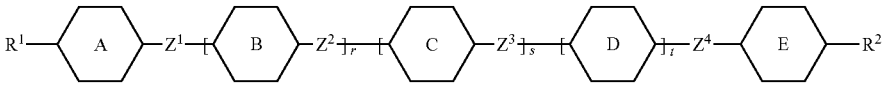

I in which $R^1$ and $R^2$ each, independently of one another, denote H, an alkyl radical having up to 15 C atoms which is unsubstituted, monosubstituted by CN or $CF_3$ or at least monosubstituted by halogen, where, in addition, one or more $CH_2$ groups in these radicals may be replaced by —O—, —S—,

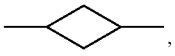

—C≡C—, —CH═CH—, —$CF_2$O—, —O$CF_2$—, —OC—O— or —O—CO— in such a way that 0 atoms are not linked directly to one another, and one of the radicals $R^1$ and $R^2$ also denotes F, Cl, CN, $SF_5$, NCS, SCN, OCN, rings A, B, C, D and E each, independently of one another, denote

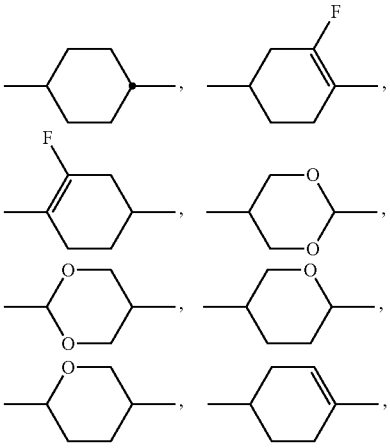

-continued
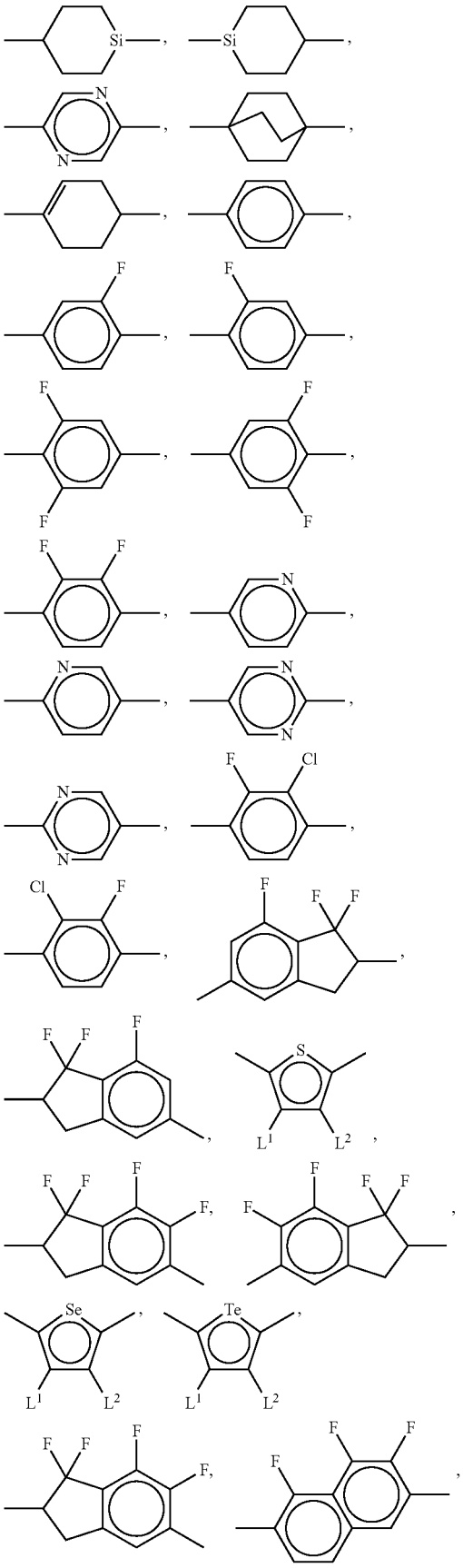
-continued
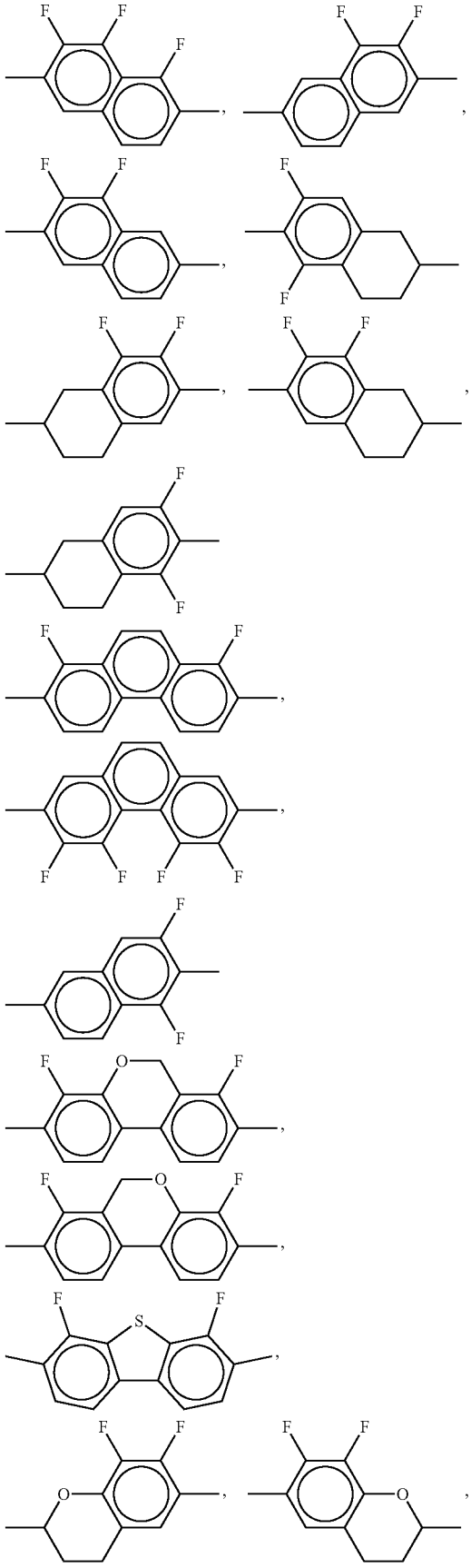

-continued

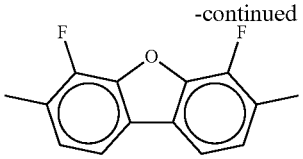

r, s and t each, independently of one another, denote 0, 1, 2 or 3, where r+s+t≤3, $Z^{1-4}$ each, independently of one another, denote —CO—O—, —O—CO—, —$CF_2O$—, —$OCF_2$—, —$CH_2O$—, —$OCH_2$—, —$CH_2CH_2$—, —$(CH_2)_4$—, —CH═CH—$CH_2O$—, —$C_2F_4$—, —$CH_2CF_2$—, —$CF_2CH_2$—, —CF═CF—, —CH═CF—, —CF═CH—, —CH═CH—, —C≡C— or a single bond, and $L^1$ and $L^2$ each, independently of one another, denote H or F.

In the case where r+s+t=0, $Z^1$ and $Z^4$ are preferably selected in such a way that, if they do not denote a single bond, they are not linked to one another via two O atoms.

The liquid-crystal mixtures employed comprising the individual mesogenic substances may additionally also comprise one or more polymerisable compounds, so-called reactive mesogens (RMs), for example as disclosed in U.S. Pat. No. 6,861,107, in concentrations of, preferably, 0.12-5% by weight, particularly preferably 0.2-2% by weight, based on the mixture. Mixtures of this type can be used for so-called polymer stabilised VA (PS-VA) modes, negative IPS (PS-IPS) or negative FFS (PS-FFS) modes, in which polymerisation of the reactive mesogens is intended to take place in the liquid-crystalline mixture. The prerequisite for this is that the liquid-crystal mixture does not itself comprise any individual polymerisable substances.

The polymerisable mesogenic or liquid-crystalline compounds, also known as "reactive mesogens" (RMs), are preferably selected from the compounds of the formula II $$R^a\text{-}A^1\text{-}(Z^1\text{-}A^2)_m\text{-}R^b \qquad \text{II}$$

in which the individual radicals have the following meanings:

$A^1$ and $A^2$ each, independently of one another, denote an aromatic, heteroaromatic, alicyclic or heterocyclic group, preferably having 4 to 25 C atoms, which may also contain fused rings and which is optionally mono- or polysubstituted by L, $Z^1$ on each occurrence, identically or differently, denotes —O—, —S—, —CO—, —CO—O—, —OCO—, —O—CO—O—, —$OCH_2$—, —$CH_2O$—, —$SCH_2$—, —$CH_2S$—, —$CF_2O$—, —$OCF_2$—, —$CF_2S$—, —$SCF_2$—, —$(CH_2)_n$—, —$CF_2CH_2$—, —$CH_2CF_2$—, —$(CF_2)_n$—, —CH═CH—, —CF═CF—, —C≡C—, —CH═CH—COO—, —OCO—CH═CH—, $CR^0R^{00}$ or a single bond, L, $R^a$ and $R^b$ each, independently of one another, denote H, halogen, $SF_5$, $NO_2$, a carbon group or hydrocarbon group, where the compounds contain at least one radical L, $R^a$ and $R^b$ which denotes or contains a P-Sp-group, $R^0$ and $R^{00}$ each, independently of one another, denote H or alkyl having 1 to 12 C atoms, P denotes a polymerisable group, Sp denotes a spacer group or a single bond, m denotes 0, 1, 2, 3 or 4, n denotes 1, 2, 3 or 4.

The polymerisable compounds may contain one polymerisable group (monoreactive) or two or more (di- or multireactive), preferably two, polymerisable groups.

Above and below, the following meanings apply:

The term "mesogenic group" is known to the person skilled in the art and is described in the literature, and denotes a group which, due to the anisotropy of its attracting and repelling interactions, essentially contributes to causing a liquid-crystal (LC) phase in low-molecular-weight or polymeric substances. Compounds containing mesogenic groups (mesogenic compounds) do not necessarily have to have an LC phase themselves. It is also possible for mesogenic compounds to exhibit LC phase behaviour only after mixing with other compounds and/or after polymerisation. Typical mesogenic groups are, for example, rigid rod- or disc-shaped units. An overview of the terms and definitions used in connection with mesogenic or LC compounds is given in Pure Appl. Chem. 73(5), 888 (2001) and C. Tschierske, G. Pelzl, S. Diele, Angew. Chem. 2004, 116, 6340-6368.

The term "spacer group", also referred to as "Sp" above and below, is known to the person skilled in the art and is described in the literature, see, for example, Pure Appl. Chem. 73(5), 888 (2001) and C. Tschierske, G. Pelzl, S. Diele, Angew. Chem. 2004, 116, 6340-6368. Unless indicated otherwise, the term "spacer group" or "spacer" above and below denotes a flexible group which connects the mesogenic group and the polymerisable group(s) in a polymerisable mesogenic compound ("RM") to one another. Sp preferably denotes a single bond or a 1-16 C alkylene, in which one or more $CH_2$ groups may be replaced by —O—, —CO—, —COO— or —OCO— in such a way that two O atoms are not connected directly to one another.

The term "organic group" denotes a carbon or hydrocarbon group.

The term "carbon group" denotes a mono- or polyvalent organic group containing at least one carbon atom which either contains no further atoms (such as, for example, —C≡C—) or optionally contains one or more further atoms, such as, for example, N, O, S, P, Si, Se, As, Te or Ge (for example carbonyl, etc.). The term "hydrocarbon group" denotes a carbon group which additionally contains one or more H atoms and optionally one or more heteroatoms, such as, for example, N, O, S, P, Si, Se, As, Te or Ge.

"Halogen" denotes F, Cl, Br or I.

The terms "alkyl", "aryl", "heteroaryl", etc., also encompass polyvalent groups, for example alkylene, arylene, heteroarylene, etc.

The term "alkyl" in this application encompasses straight-chain and branched alkyl groups having 1 to 9 carbon atoms, preferably the straight-chain groups methyl, ethyl, propyl, butyl, pentyl, hexyl, heptyl, octyl and nonyl. Groups having 1 to 5 carbon atoms are particularly preferred.

The term "alkenyl" in this application encompasses straight-chain and branched alkenyl groups having 2 to 9 carbon atoms, preferably the straight-chain groups having 2 to 7 carbon atoms. Particularly preferred alkenyl groups are $C_2$-$C_7$-1E-alkenyl, $C_4$-$C_7$-3E-alkenyl, $C_5$-$C_7$-4-alkenyl, $C_6$-$C_7$-5-alkenyl and $C_7$-6-alkenyl, in particular $C_2$-$C_7$-1E-alkenyl, $C_4$-$C_7$-3E-alkenyl and $C_5$-$C_7$-4-alkenyl. Examples of preferred alkenyl groups are vinyl, E-propenyl, 1E-butenyl, 1E-pentenyl, 1E-hex-enyl, 1E-hept-enyl, 3-butenyl, 3E-pentenyl, 3E-hexenyl, 3E-heptenyl, 4-pentenyl, 4Z-hexenyl, 4E-hexenyl, 4Z-hep-tenyl, 5-hexenyl, 6-heptenyl and the like. Groups having up to 5 carbon atoms are particularly preferred.

The term "fluoroalkyl" in this application encompasses straight-chain groups having a terminal fluorine, i.e. fluoromethyl, 2-fluoroethyl, 3-fluoropropyl, 4-fluoro-butyl, 5-fluoro-pentyl, 6-fluorohexyl and 7-fluoroheptyl. However, other positions of the fluorine are not excluded.

The term "oxaalkyl" or "alkoxy" in this application encompasses straight-chain radicals of the formula $C_nH_{2n+1}$—O—$(CH_2)_m$, in which n and m each, independently of one another, denote 1 to 6. Preferably, n=1 and m=1 to 6.

The term "aryl" denotes an aromatic carbon group or a group derived therefrom. The term "heteroaryl" denotes "aryl" in accordance with the above definition containing one or more heteroatoms.

The polymerisable group P is a group which is suitable for a polymerisation reaction, such as, for example, free-radical or ionic chain polymerisation, polyaddition or polycondensation, or for a polymer-analogous reaction, for example addition or condensation onto a main polymer chain. Particular preference is given to groups for chain polymerisation, in particular those containing a C≡C double bond or a —C≡C— triple bond, and groups which are suitable for polymerisation with ring opening, such as, for example, oxetane or epoxide groups.

The polymerisable compounds are prepared analogously to processes which are known to the person skilled in the art and are described in standard works of organic chemistry, such as, for example, in Houben-Weyl, Methoden der organischen Chemie [Methods of Organic Chemistry], Thieme-Verlag, Stuttgart.

Typical and preferred reactive mesogens (RMs) are described, for example, in WO 93/22397, EP 0 261 712, DE 195 04 224, WO 95/22586, WO 97/00600, U.S. Pat. No. 5,518,652, U.S. Pat. No. 5,750,051, U.S. Pat. No. 5,770,107 and U.S. Pat. No. 6,514,578. Very particularly referred reactive mesogens are shown on Table E.

The process is used for the preparation of a mixture consisting of organic compounds, one or more of which are preferably mesogenic, preferably liquid-crystalline, per se. The mesogenic compounds preferably include one or more liquid-crystalline compounds. The process product is preferably a homogeneous, liquid-crystalline mixture. In the broader sense, the process also encompasses the preparation of mixtures which consist of organic substances in the homogeneous liquid phase and comprise additives which are insoluble therein (for example small particles). The process can thus also be used for the preparation of suspension-like or emulsion-like mixtures based on a continuous homogeneous organic phase. However, process variants of this type are generally less preferred.

By means of suitable additives, the liquid-crystal phases according to the invention can be modified in such a way that they can be employed in any type of LCD display that has been disclosed to date, for example, ECB, VAN, IPS, FFS, TN, TN-TFT, STN, OCB, GH, PS-IPS, PS-FFS, PS-VA or ASM-VA displays.

The liquid-crystal mixtures may also comprise further additives known to the person skilled in the art and described in the literature, such as, for example, UV stabilisers, such as, for example, Tinuvin® from Ciba, antioxidants, free-radical scavengers, nanoparticles, microparticles, one or more dopants, etc. For example, 0-15% of pleochroic dyes may be added, furthermore conductive salts, preferably ethyldimethyldodecylammonium 4-hexoxybenzoate, tetrabutylammonium tetraphenylboranate or complex salts of crown ethers (cf., for example, Haller et al., Mol. Cryst. Liq. Cryst. Volume 24, pages 249-258 (1973)) in order to improve the conductivity, or substances can be added in order to modify the dielectric anisotropy, the viscosity and/or the alignment of the nematic phases. Substances of this type are described, for example, in DE-A 22 09 127, 22 40 864, 23 21 632, 23 38 281, 24 50 088, 26 37 430 and 28 53 728.

Suitable stabilisers and dopants which can be combined with the compounds of the formula I in the mixing container in the preparation of the liquid-crystal mixtures are indicated below in Tables C and D.

The following examples are intended to explain the invention without limiting it. Above and below, percentages are percent by weight and all temperatures are indicated in degrees Celsius.

Throughout the patent application, 1,4-cyclohexylene rings and 1,4-phenylene rings are depicted as follows:

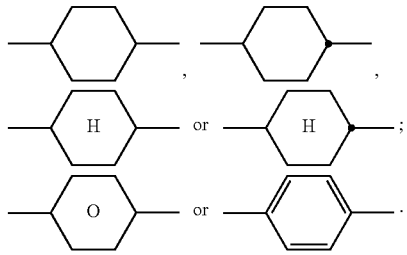

The cyclohexylene rings are trans-1,4-cyclohexylene rings.

In the present application and in the following examples, the structures of the liquid-crystal compounds are indicated by means of acronyms, with the transformation into chemical formulae taking place in accordance with Tables A and B below. All radicals $C_nH_{2n+1}$ and $C_mH_{2m+1}$ are straight-chain alkyl radicals having n and m C atoms respectively; n, m, k and z are integers and preferably denote 0, 1, 2, 3, 4, 5, 6, 7, 8, 9, 10, 11 or 12. The term "$(O)C_mH_{2m+1}$" means $OC_mH_{2m+1}$ or $C_mH_{2m+1}$. The coding in Table B is selfevident.

In Table A, only the acronym for the parent structure is indicated. In individual cases, this is followed, separated from the acronym for the parent structure by a dash, by a code for the substituents $R^{1*}$, $R^{2*}$, $L^{1*}$ and $L^{2*}$:

| Code for $R^{1*}$, $R^{2*}$, $L^{1*}$, $L^{2*}$, $L^{3*}$ | $R^{1*}$ | $R^{2*}$ | $L^{1*}$ | $L^{2*}$ |
|---|---|---|---|---|
| nm | $C_nH_{2n+1}$ | $C_mH_{2m+1}$ | H | H |
| nOm | $C_nH_{2n+1}$ | $OC_mH_{2m+1}$ | H | H |
| nO · m | $OC_nH_{2n+1}$ | $C_mH_{2m+1}$ | H | H |
| n | $C_nH_{2n+1}$ | CN | H | H |
| nN · F | $C_nH_{2n+1}$ | CN | F | H |
| nN · F · F | $C_nH_{2n+1}$ | CN | F | F |
| nF | $C_nH_{2n+1}$ | F | H | H |
| nCl | $C_nH_{2n+1}$ | Cl | H | H |
| nOF | $OC_nH_{2n+1}$ | F | H | H |
| nF · F | $C_nH_{2n+1}$ | F | F | H |
| nF · F · F | $C_nH_{2n+1}$ | F | F | F |
| $nOCF_3$ | $C_nH_{2n+1}$ | $OCF_3$ | H | H |
| $nOCF_3$ · F | $C_nH_{2n+1}$ | $OCF_3$ | F | H |
| n-Vm | $C_nH_{2n+1}$ | —CH═CH—$C_mH_{2m+1}$ | H | H |
| nV-Vm | $C_nH_{2n+1}$—CH═CH— | —CH═CH—$C_mH_{2m+1}$ | H | H |

Preferred mesogenic or liquid-crystalline substances which are suitable for the preparation of liquid-crystal mixtures and can be used in the purification process according to the invention are listed, in particular, in Tables A and B:

TABLE A
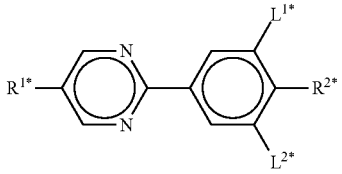
PYP
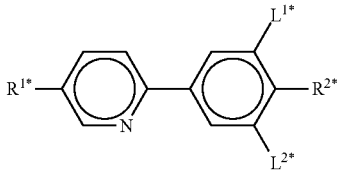
PYRP
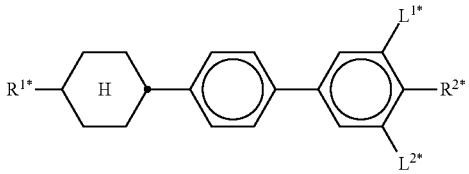
BCH
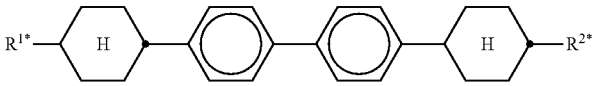
CBC
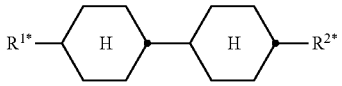
CCH
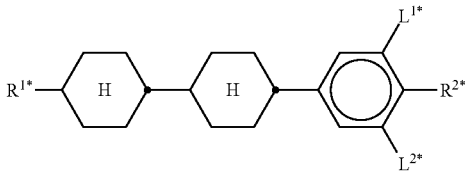
CCP
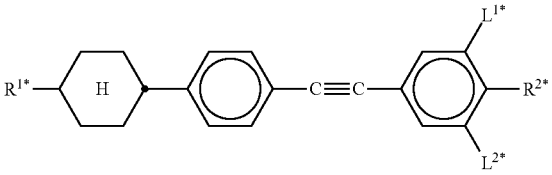
CPTP
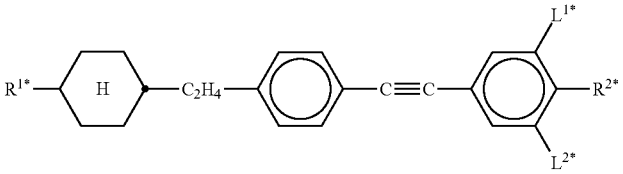
CEPTP TABLE A-continued
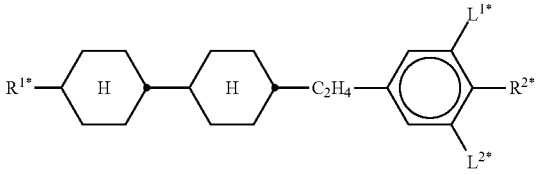
ECCP
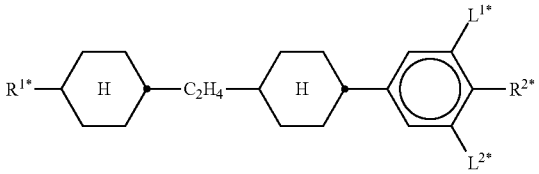
CECP
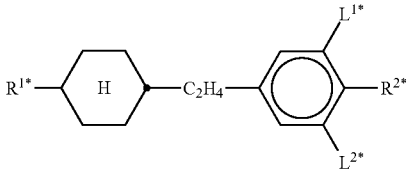
EPCH
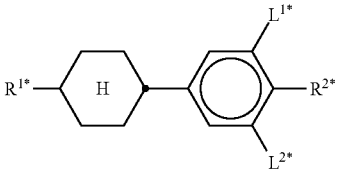
PCH
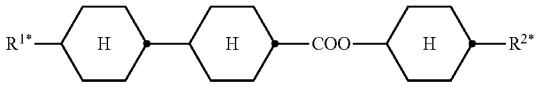
CH
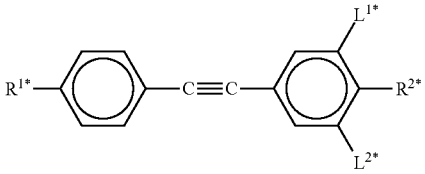
PTP
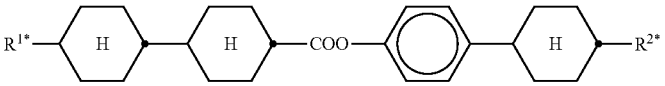
CCPC
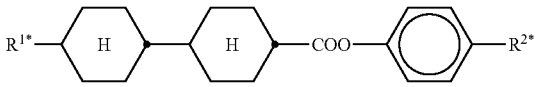
CP TABLE A-continued
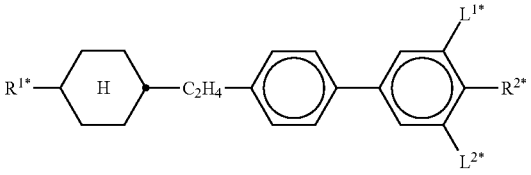
BECH
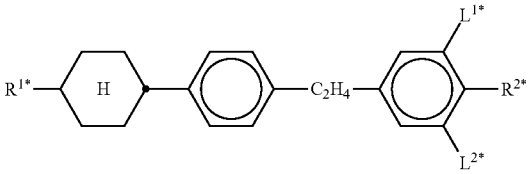
EBCH
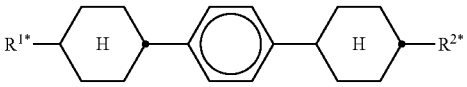
CPC
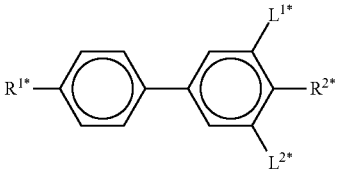
B
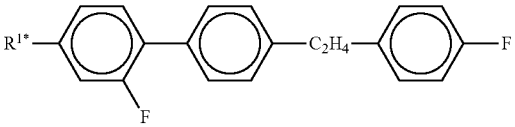
FET-nF
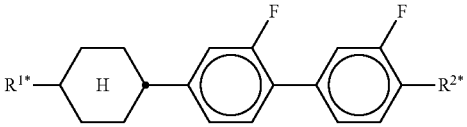
CGG
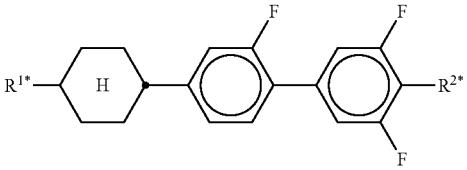
CGU
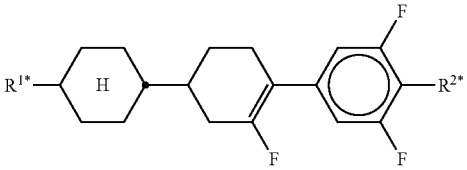
CFU TABLE B
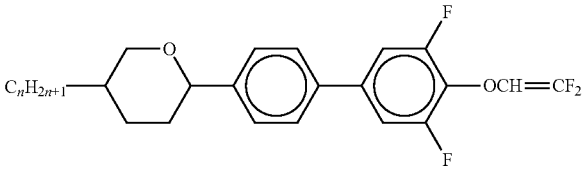
APU-n-OXF
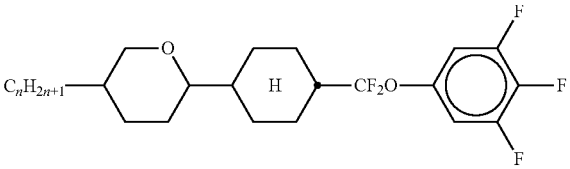
ACQU-n-F
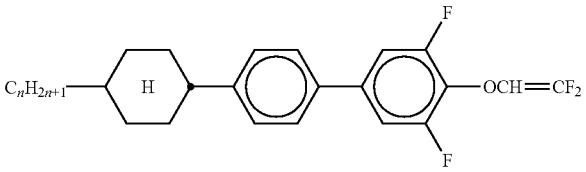
CPU-n-OXF
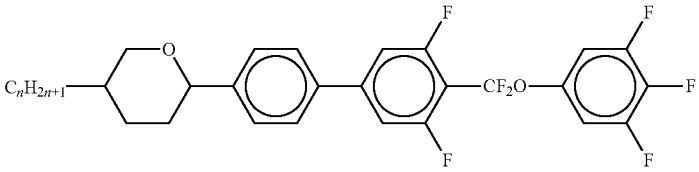
APUQU-n-F
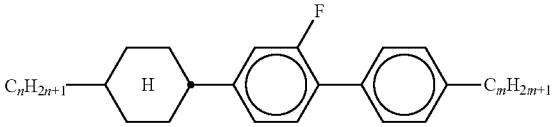
BCH-n•Fm
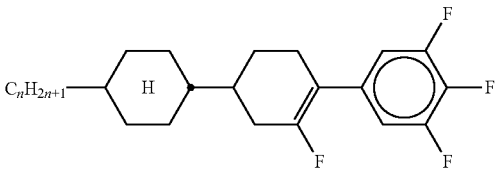
CFU-n-F
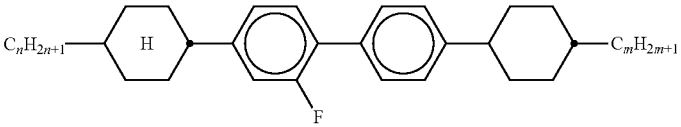
CBC-nmF
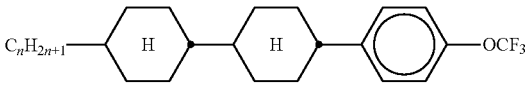
CCP-n$OCF_3$ TABLE B-continued
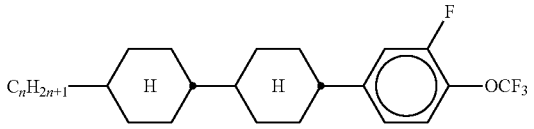
CCP-n$OCF_3$•F
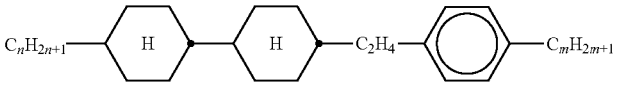
ECCP-nm
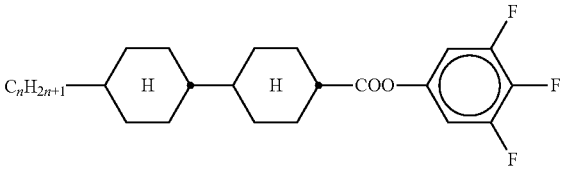
CCZU-n-F
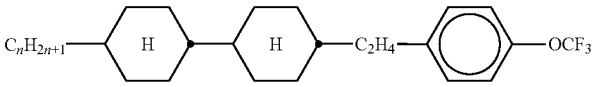
ECCP-n$OCF_3$
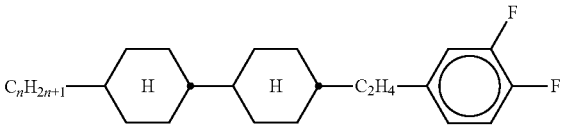
ECCP-nF•F
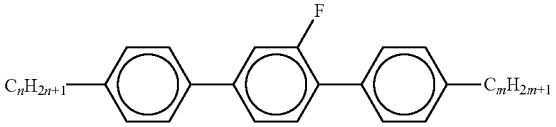
PGP-n-m
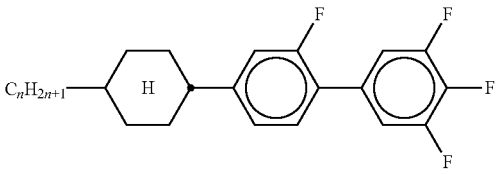
CGU-n-F
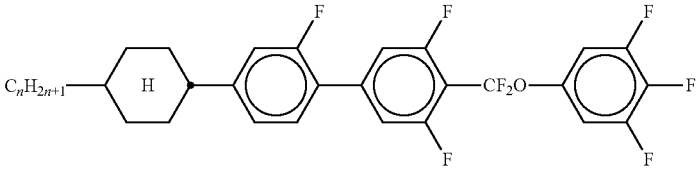
CGUQU-n-F TABLE B-continued
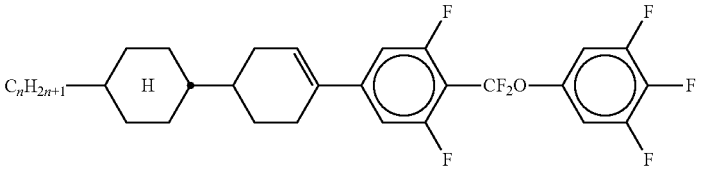
CLUQU-n-F
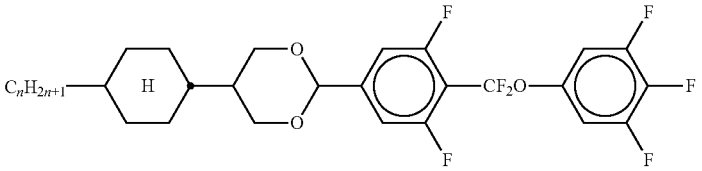
CDUQU-n-F
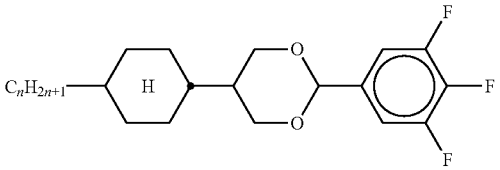
CDU-n-F
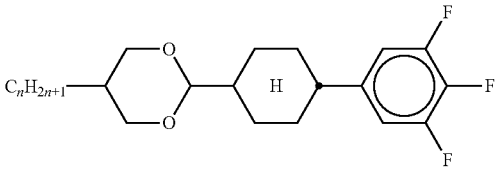
DCU-n-F
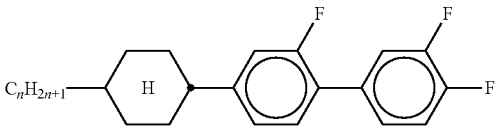
CGG-n-F
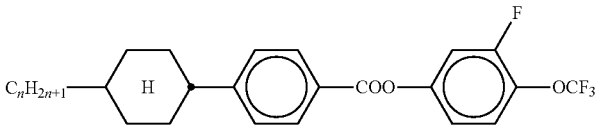
CPZG-n-OT
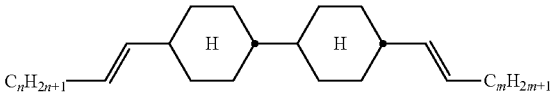
CC-nV-Vm
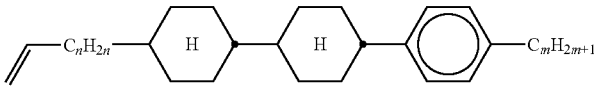
CCP-Vn-m TABLE B-continued
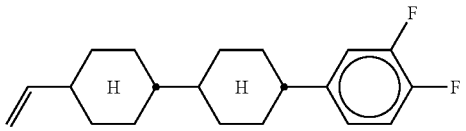
CCG-V-F
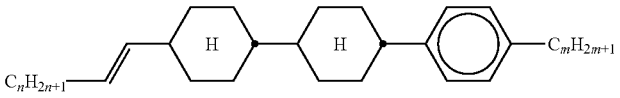
CCP-nV-m
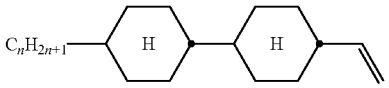
CC-n-V
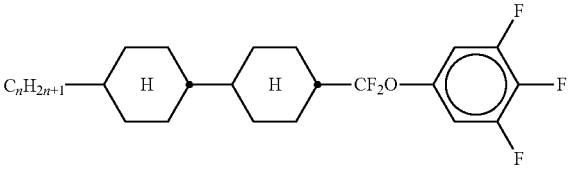
CCQU-n-F
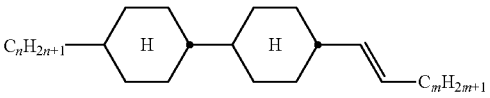
CC-n-Vm
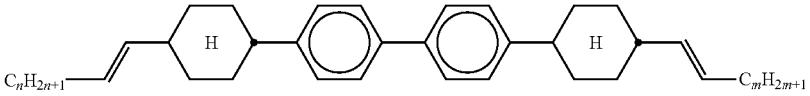
CPPC-nV-Vm
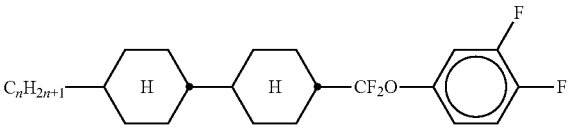
CCQG-n-F
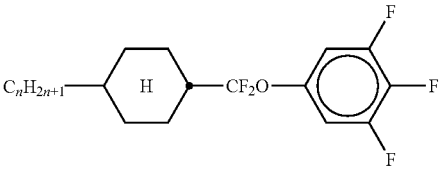
CQU-n-F
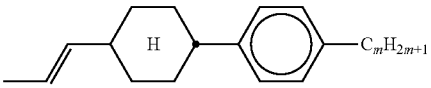
CP-1V-m TABLE B-continued
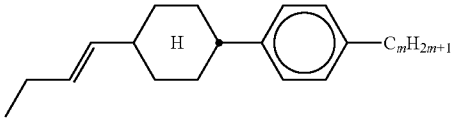
CP-2V-m
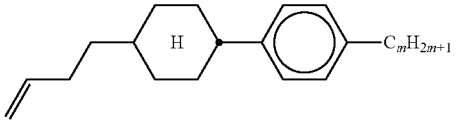
CP-V2-m
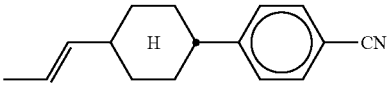
CP-1V-N
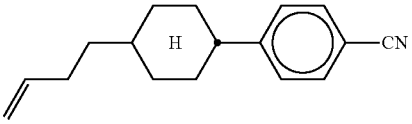
CP-V2-N
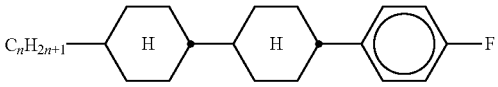
CCP-nF
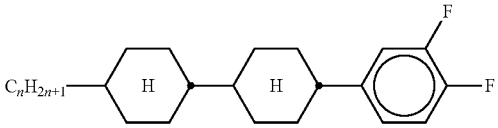
CCP-nF•F
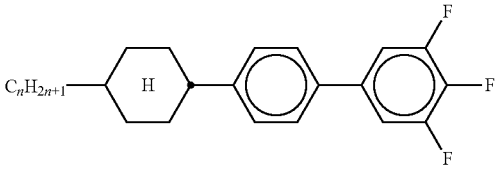
BCH-nF•F•F
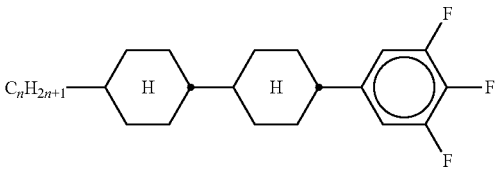
CCP-nF•F•F
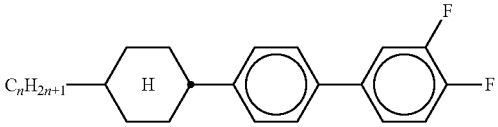
BCH-nF•F TABLE B-continued
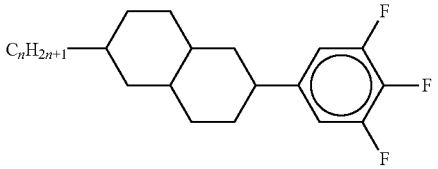
Dec-U-n-F
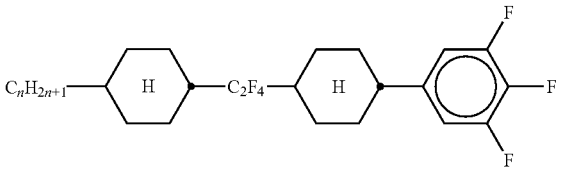
CWCU-n-F
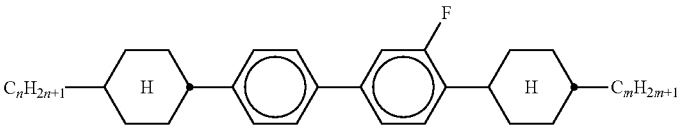
CPGP-n-m
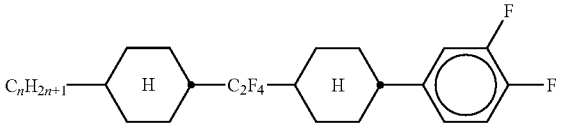
CWCG-n-F
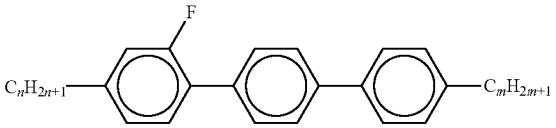
GPP-n-m
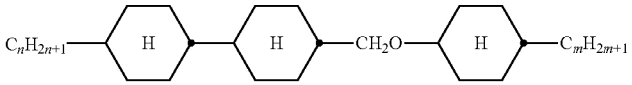
CCOC-n-m
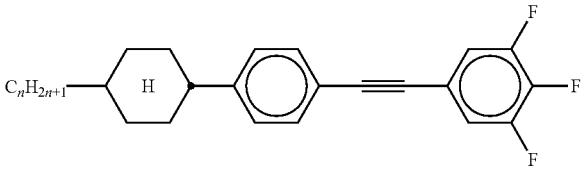
CPTU-n-F
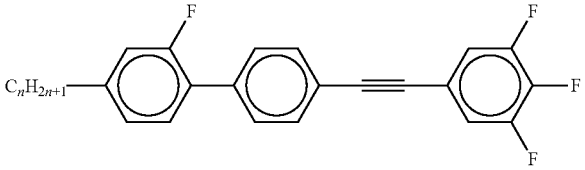
GPTU-n-F TABLE B-continued
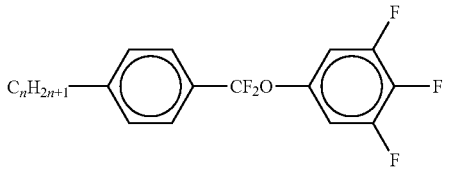
PQU-n-F
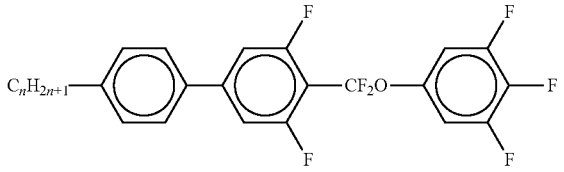
PUQU-n-F
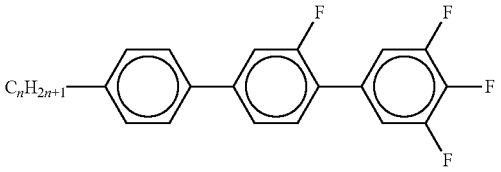
PGU-n-F
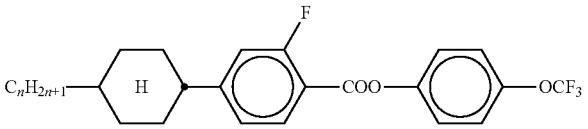
CGZP-n-OT
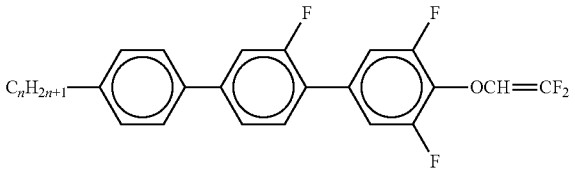
PGU-n-OXF
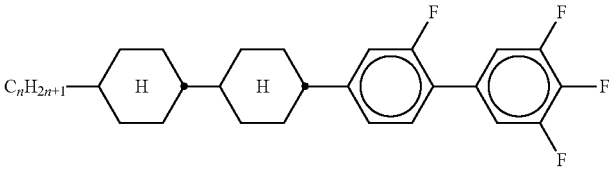
CCGU-n-F
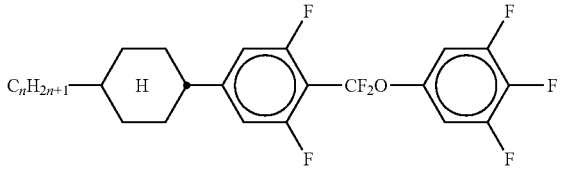
CUQU-n-F TABLE B-continued
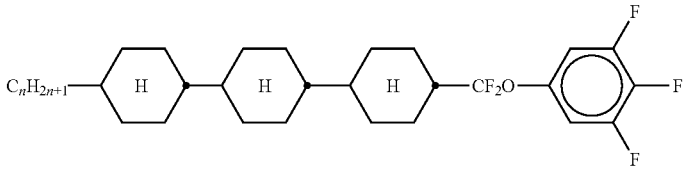
CCCQU-n-F
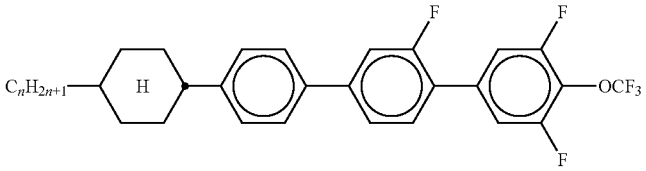
CPGU-n-OT
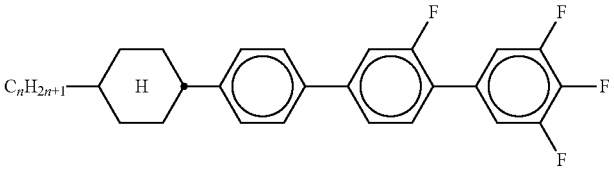
CPGU-n-F
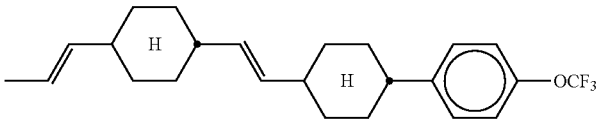
CVCP-1V-OT
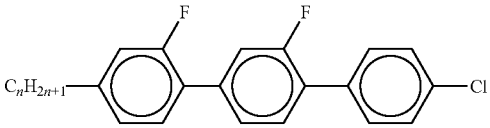
GGP-n-Cl
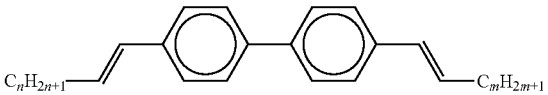
PP-nV-Vm
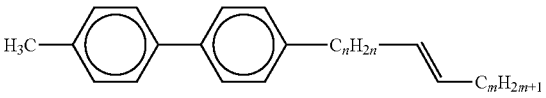
PP-1-nVm
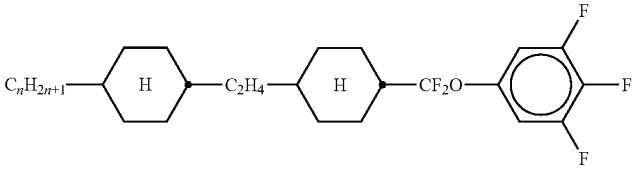
CWCQU-n-F TABLE B-continued
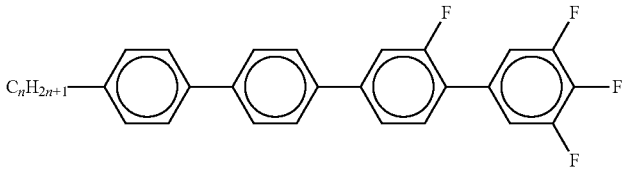
PPGU-n-F
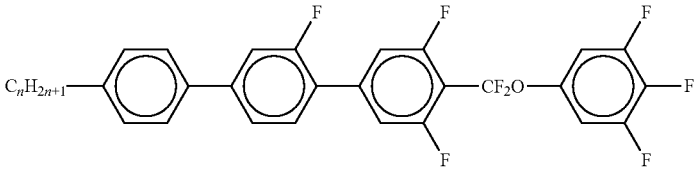
PGUQU-n-F
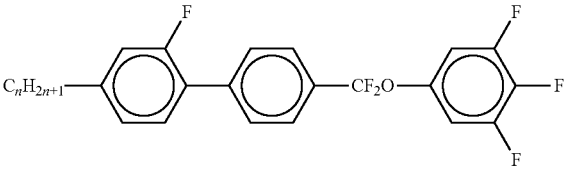
GPQU-n-F
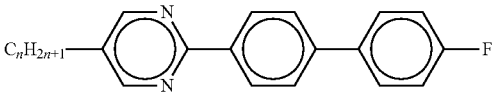
MPP-n-F
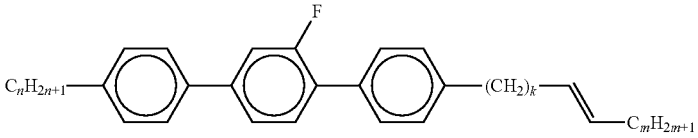
PGP-n-kVm
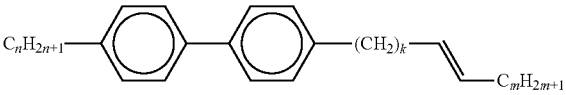
PP-n-kVm
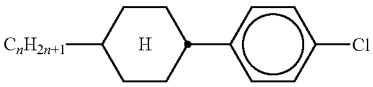
PCH-nCl
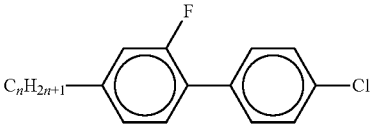
GP-n-Cl
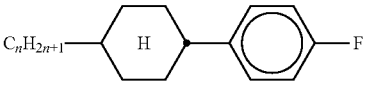
PCH-nF TABLE B-continued
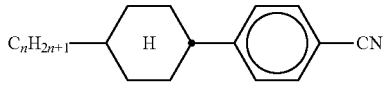
PCH-n
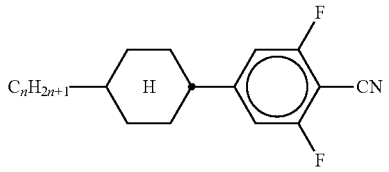
PCH-nN•F•F
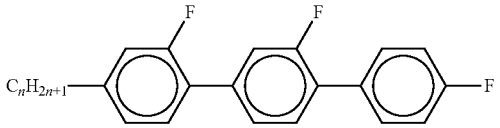
GGP-n-F
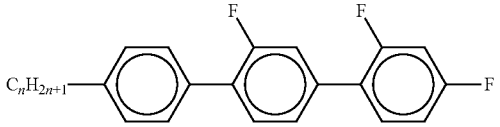
PGIGI-n-F
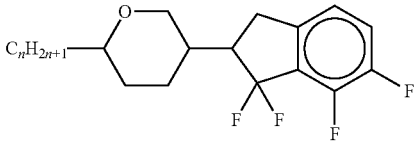
AlK-n-F
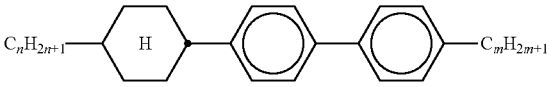
BCH-nm
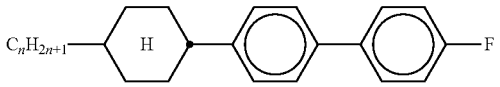
BCH-nF/CPP-n-F
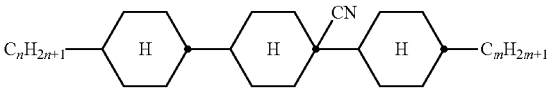
BCN-nm
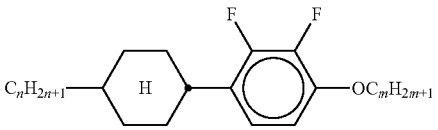
CY-n-Om/PCH-nOmFF TABLE B-continued
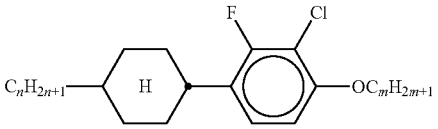
CP(F,Cl)n-Om
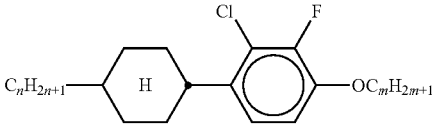
CP(Cl,F)-n-Om
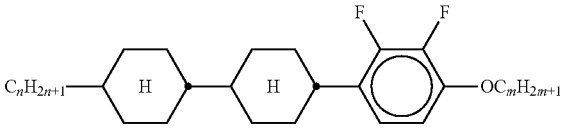
CCY-n-Om
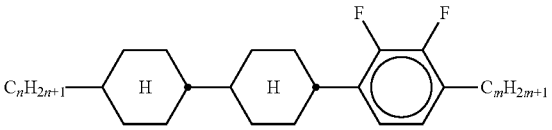
CCY-n-m
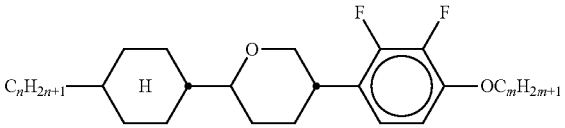
CAIY-n-Om
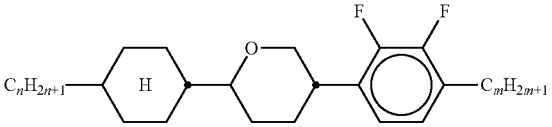
CAIY-n-m
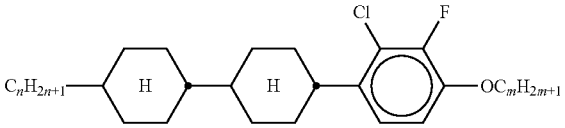
CCP(Cl,F)-n-Om
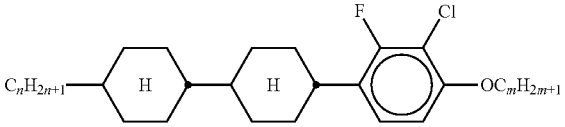
CCP(F,Cl)n-Om
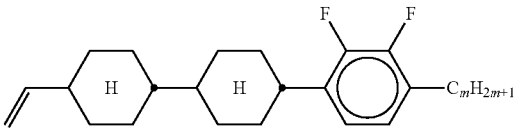
CCY-V-m TABLE B-continued
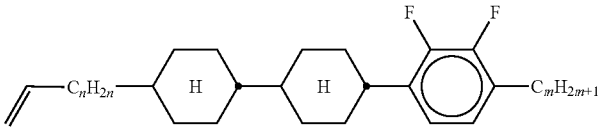
CCY-Vn-m
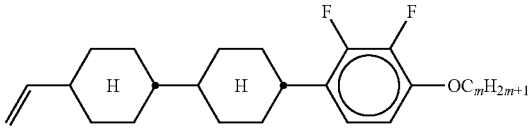
CCY-V-Om
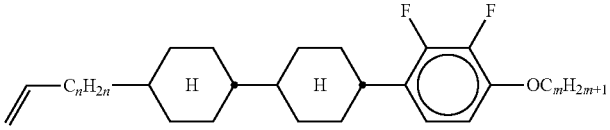
CCY-Vn-Om
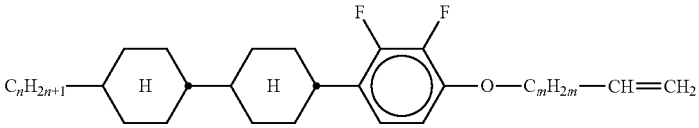
CCY-n-OmV
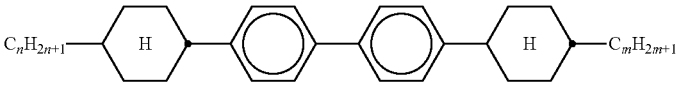
CBC-nm
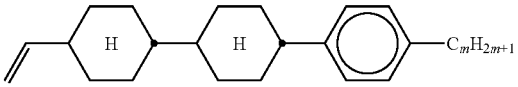
CCP-V-m
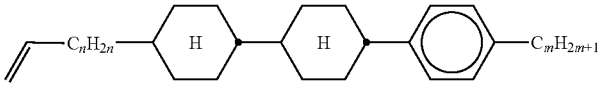
CCP-Vn-m
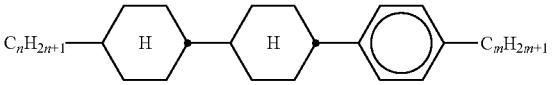
CCP-n-m/CCP-nm
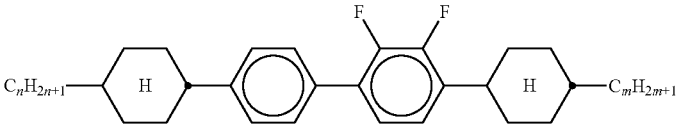
CPYC-n-m TABLE B-continued
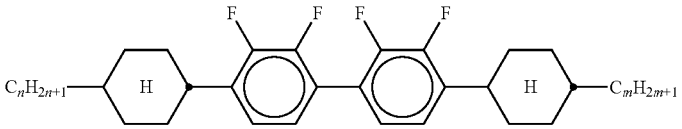
CYYC-n-m
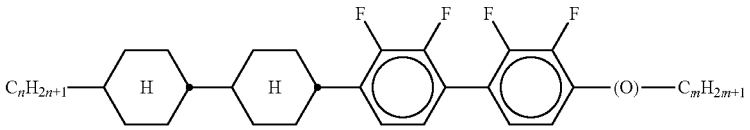
CCYY-n-(O)m
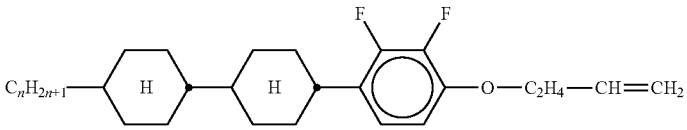
CCY-n-O2V
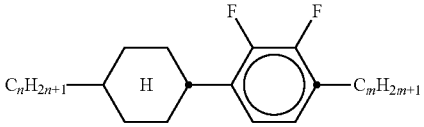
CY-n-m
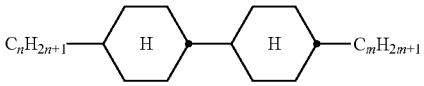
CCH-nm/CC-n-m
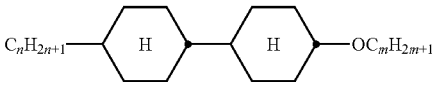
CCH-nOm/CC-n-Om
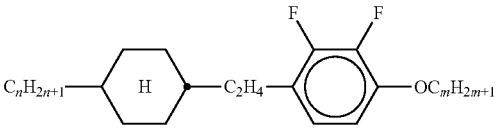
CEY-n-Om
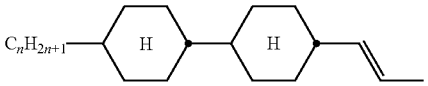
CC-n-V1
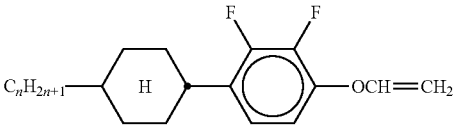
CY-n-OV TABLE B-continued
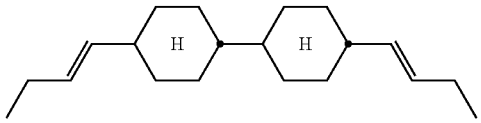
CC-2V-V2
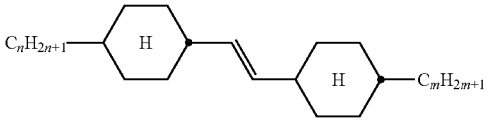
CVC-n-m
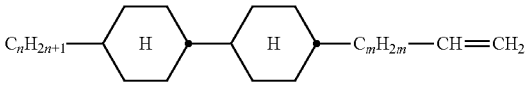
CC-n-mV
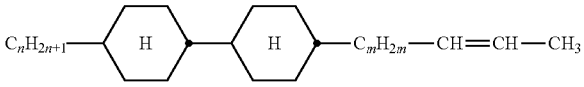
CC-n-mV1
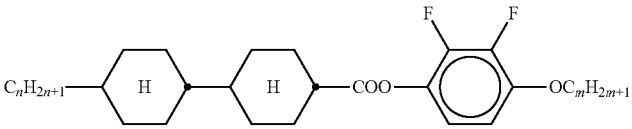
CP-nOmFF
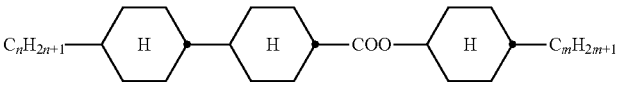
CH-nm
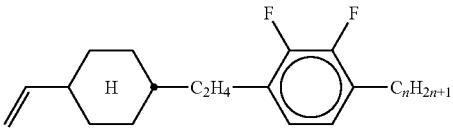
CEY-V-n
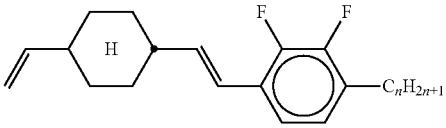
CVY-V-n
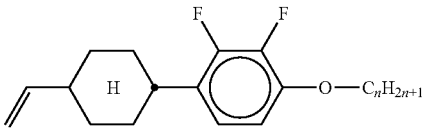
CY-V-On TABLE B-continued
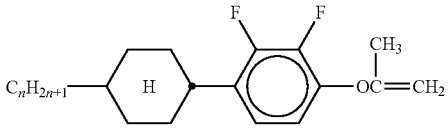
CY-n-OC(CH3)═CH2
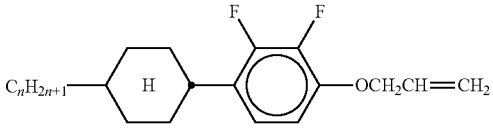
CY-n-O1V
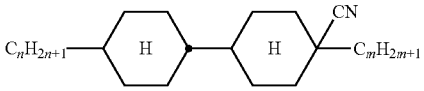
CCN-nm
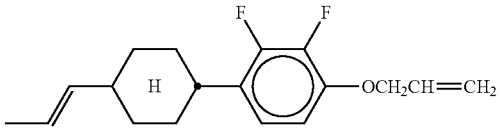
CY-1V-O1V
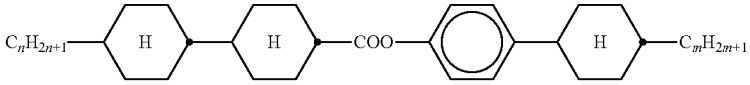
CCPC-nm
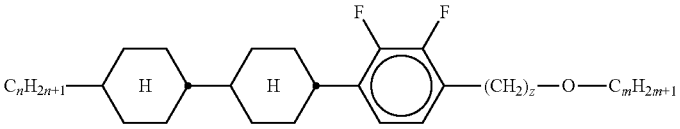
CCY-n-zOm
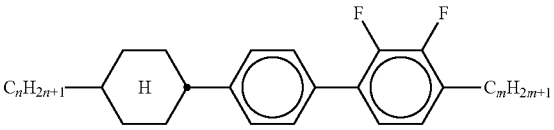
CPY-n-m
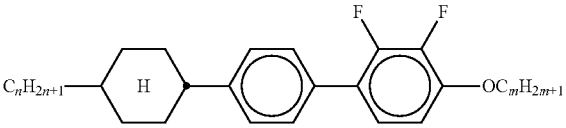
CPY-n-Om
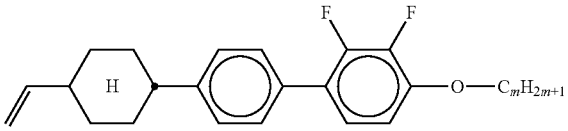
CPY-V-Om TABLE B-continued
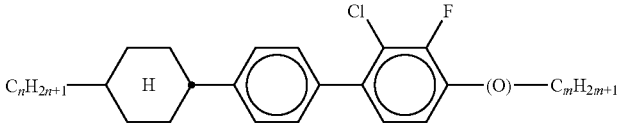
CPP(Cl,F)-n-(O)m
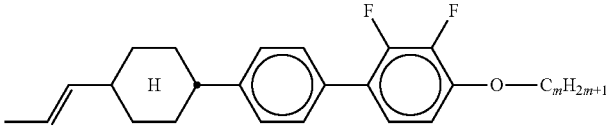
CPY-1V-Om
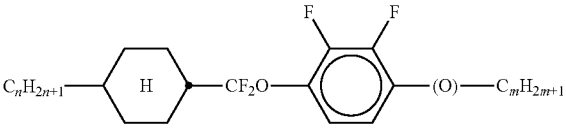
CQY-n-(O)m
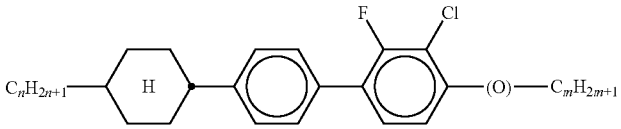
CPP(F,Cl)n-(O)m
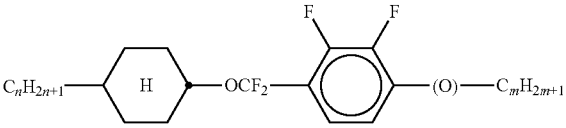
CQIY-n-(O)m
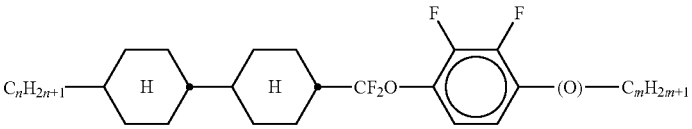
CCQY-n-(O)m
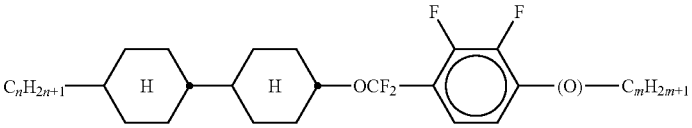
CCQIY-n-(O)m
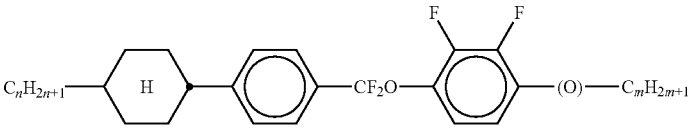
CPQY-n-(O)m
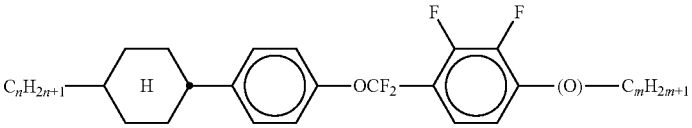
CPQIY-n-(O)m TABLE B-continued
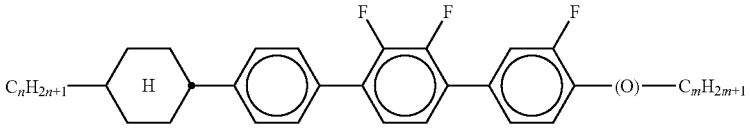
CPYG-n-(O)m
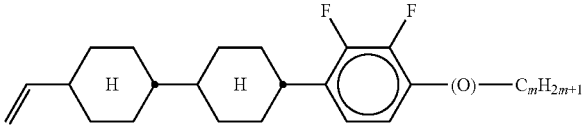
CCY-V-Om
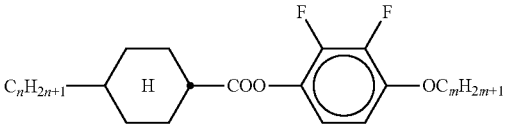
D-nOmFF
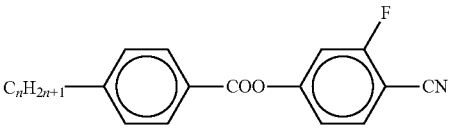
MEnN•F
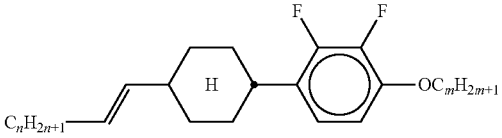
CY-nV-Om
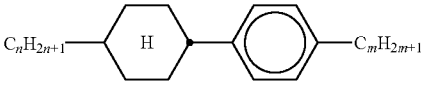
PCH-nm/CP-n-m
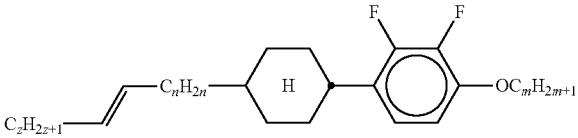
CY-zVn-Om
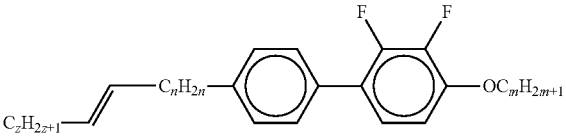
PY-zVn-Om
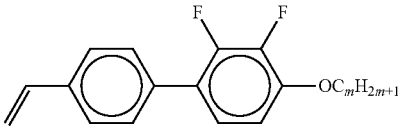
PY-V-Om TABLE B-continued
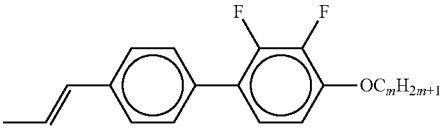
PY-1V-Om
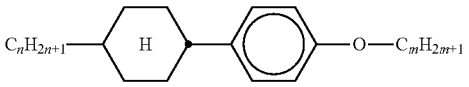
PCH-nOm/CP-n-Om
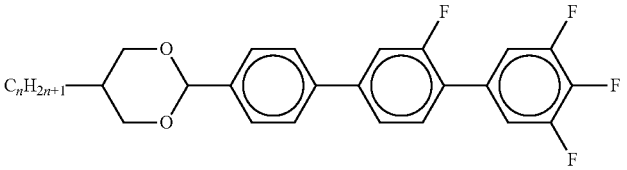
DPGU-n-F
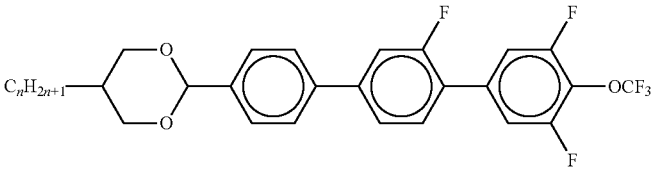
DPGU-n-OT
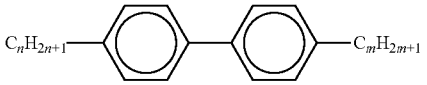
PP-n-m
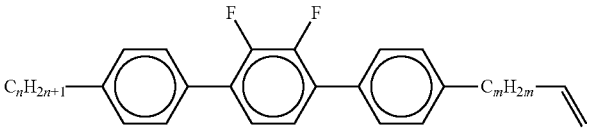
PYP-n-mV
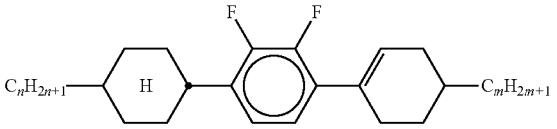
CYLI-n-m
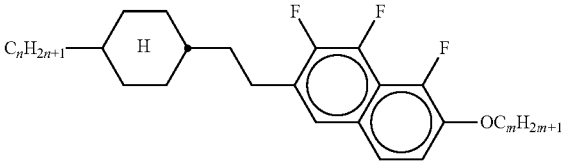
CENap-n-Om TABLE B-continued
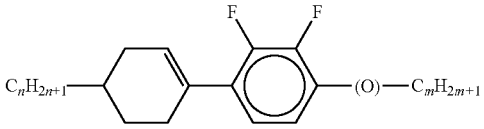
LY-n-(O)m
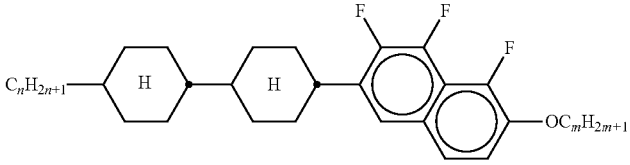
CCNap-n-Om
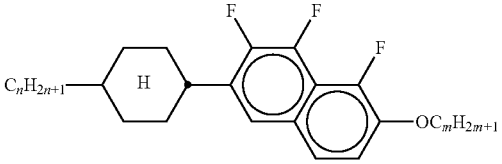
CNap-n-Om
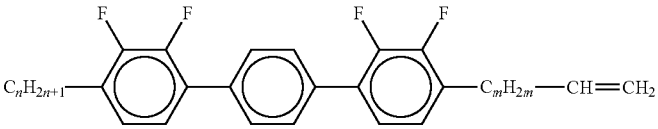
YPY-n-mV
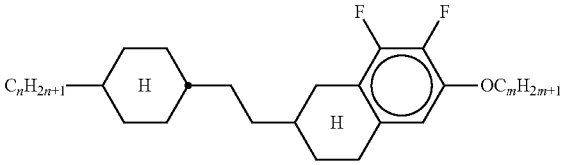
CETNap-n-Om
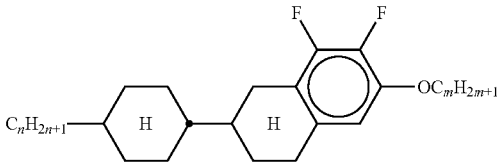
CTNap-n-Om
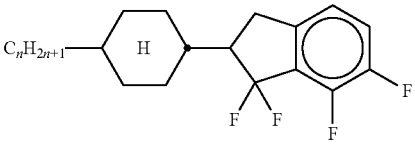
CK-n-F
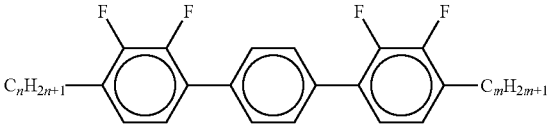
YPY-n-m TABLE B-continued
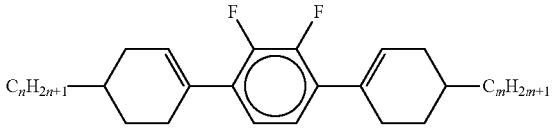
LYLI-n-m
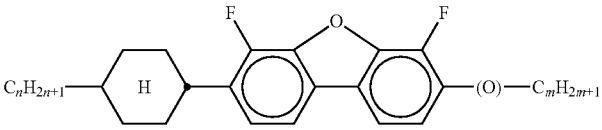
C-DFDBF-n-(O)m
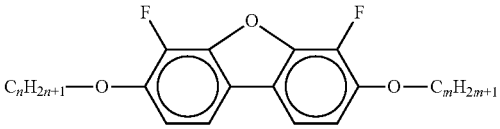
B-nO-Om
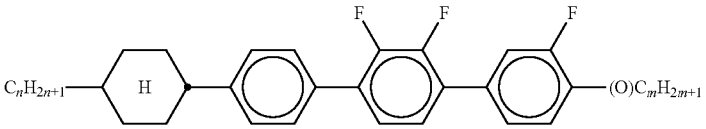
CPYG-n-(O)m
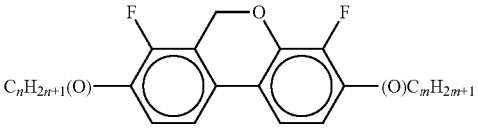
DFDBC-n(O)-(O)m
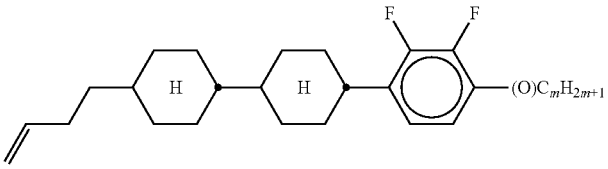
CCY-V2-(O)m
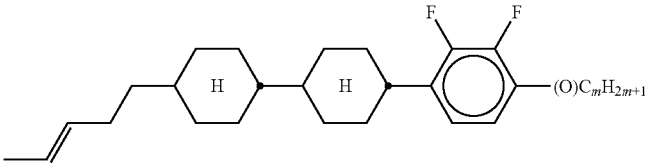
CCY-1V2-(O)m
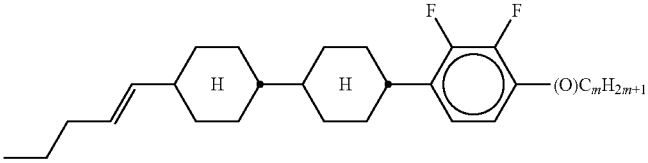
CCY-3V-(O)m TABLE B-continued
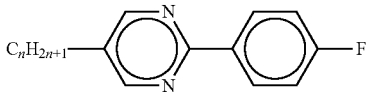
PYP-nF
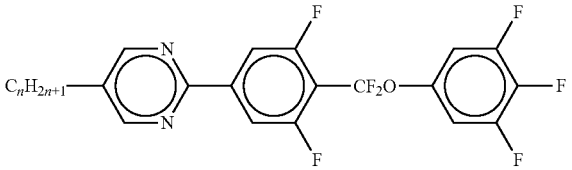
MUQU-n-F
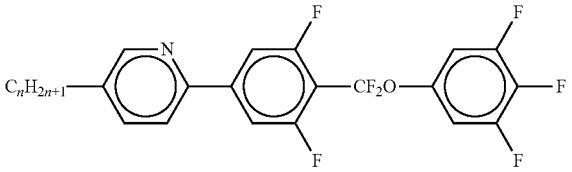
NUQU-n-F
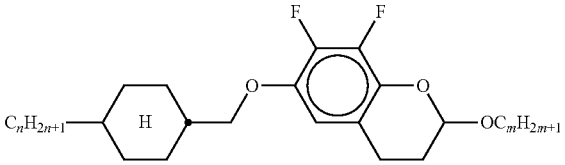
COChrom-n-Om
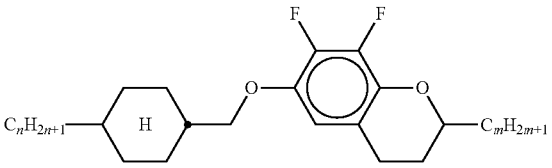
COChrom-n-m
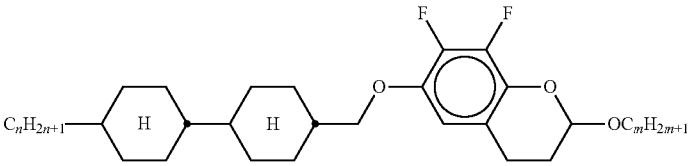
CCOChrom-n-Om
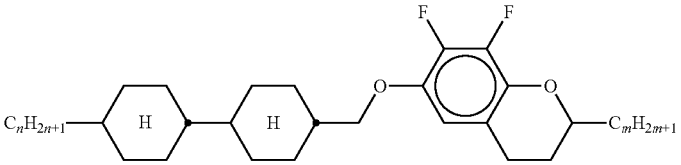
CCOChrom-n-m TABLE B-continued
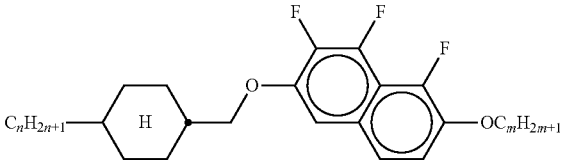
CONaph-n-Om
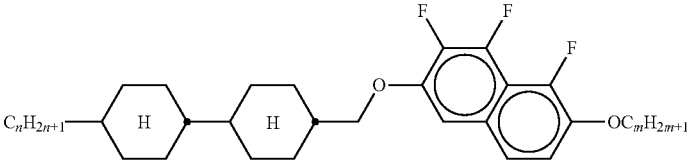
CCONaph-n-Om
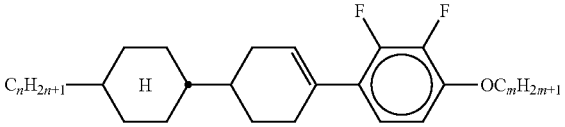
CLY-n-Om
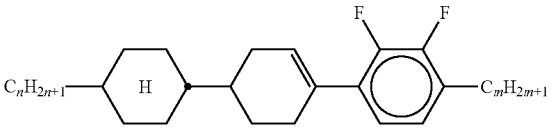
CLY-n-m
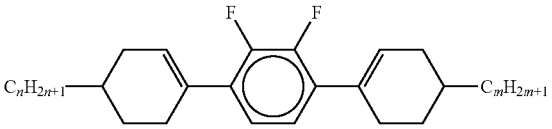
LYLI-n-m
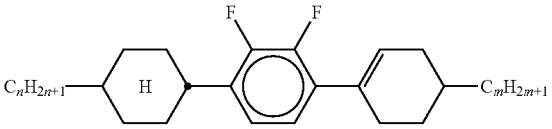
CYLI-n-m
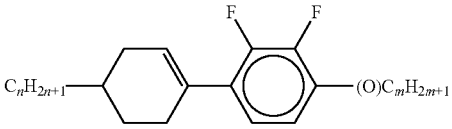
LY-n-(O)m
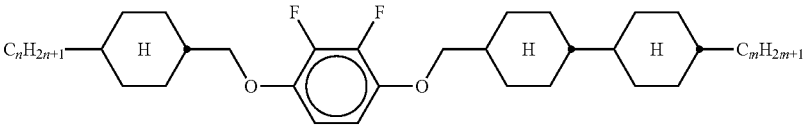
COYOICC-n-m TABLE B-continued
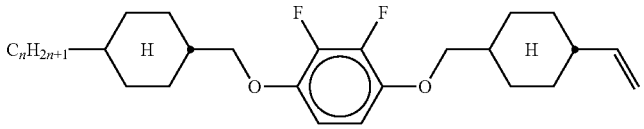
COYOIC-n-V
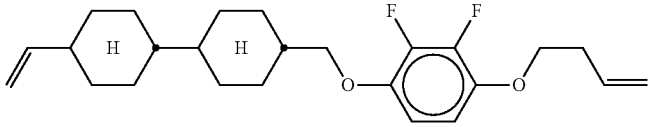
CCOY-V-O2V
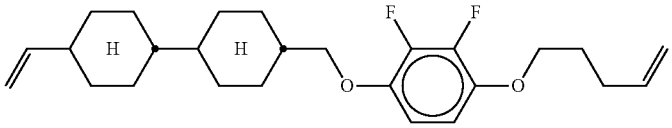
CCOY-V-O3V
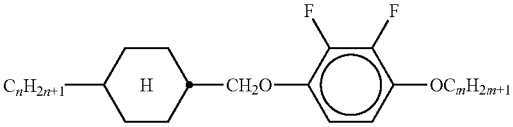
COY-n-Om
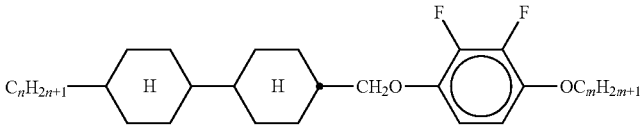
CCOY-n-Om
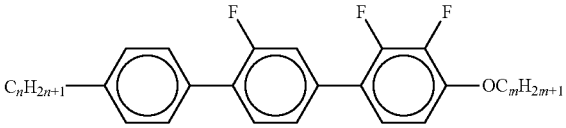
PGIY-n-Om
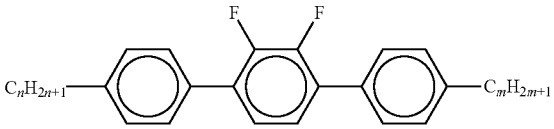
PYP-n-m
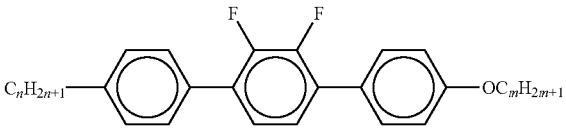
PYP-n-Om
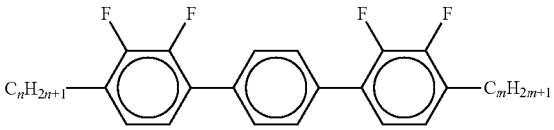
YPY-n-m TABLE B-continued
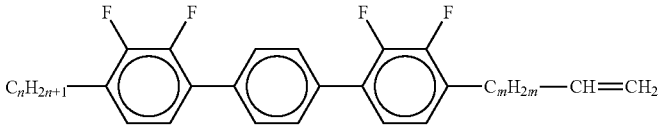
YPY-n-mV
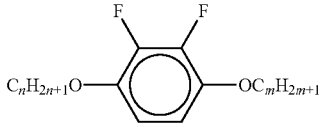
Y-nO-Om
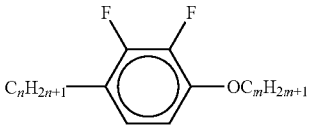
Y-n-Om
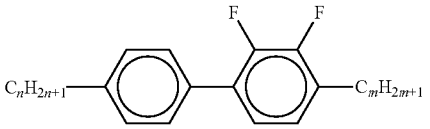
PY-n-m
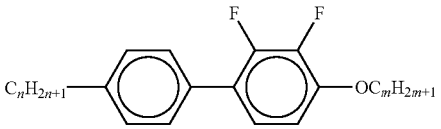
PY-n-Om
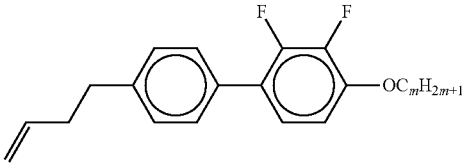
PY-V2-Om
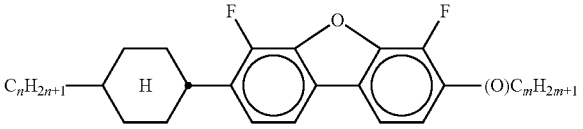
C-DFDBF-n-(O)m
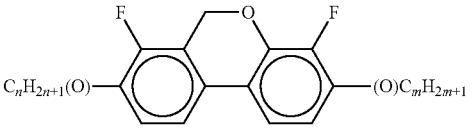
DFDBC-n(O)-(O)m TABLE B-continued
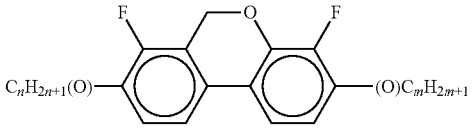
DFDBC-n(O)-(O)m
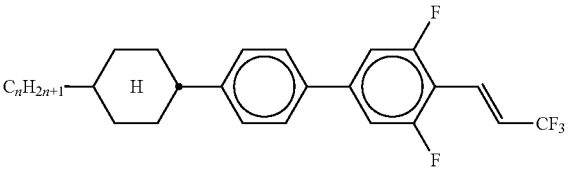
CPU-n-VT
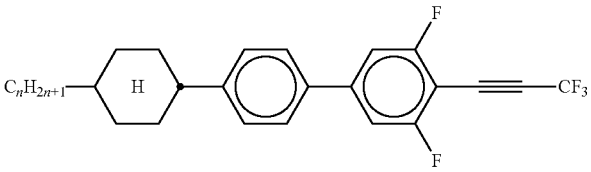
CPU-n-AT
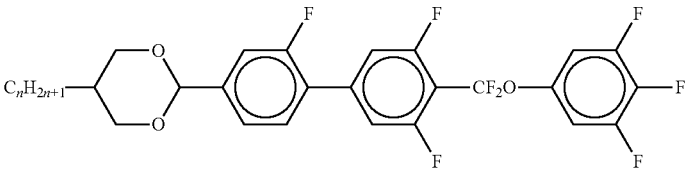
DGUQU-n-F
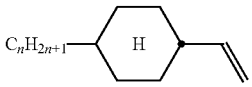
C-n-V
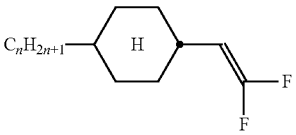
C-n-XF
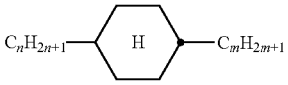
C-n-m
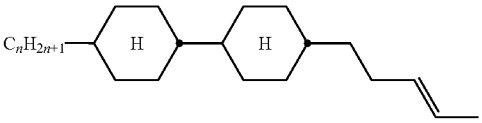
CC-n-2V1

TABLE B-continued
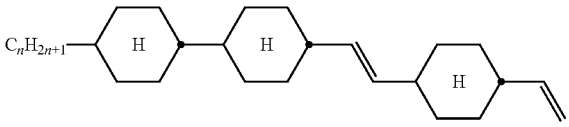
CCVC-n-V
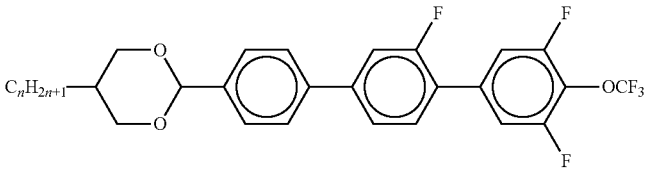
DPGU-n-OT
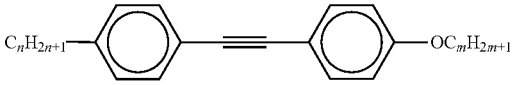
PTP-nOm
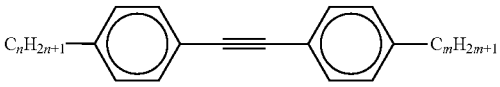
PTP-nm
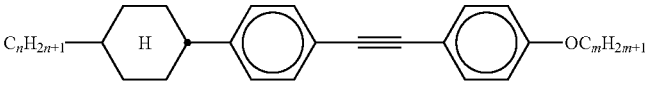
CPTP-nOm
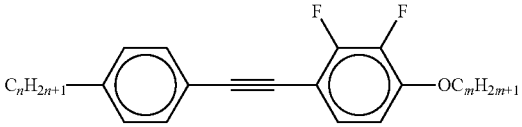
PTP-nOmFF
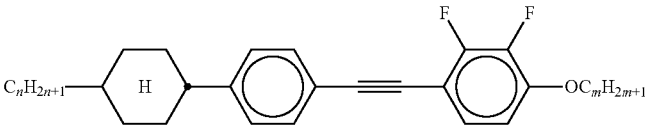
CPTP-nOmFF
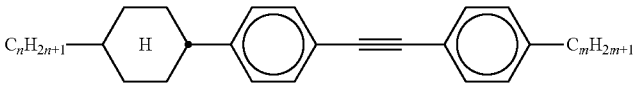
CPTP-n-m
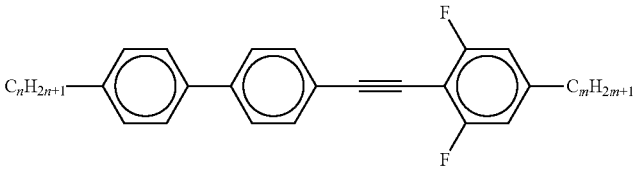
PPTUI-n-m
(n = 1-15; (O)$C_nH_{2n+1}$ means $C_nH_{2n+1}$ or $OC_nH_{2n+1}$)

Particular preference is given to liquid-crystalline mixtures which comprise at least one, two, three, four or more compounds from Table B besides one or more compounds of the formula I.

TABLE C

Table C indicates possible dopants, which are generally added to the liquid-crystalline mixtures. The mixtures preferably comprise 0-10% by weight, in particular 0.01-5% by weight and particularly preferably 0.01-3% by weight, of dopants.

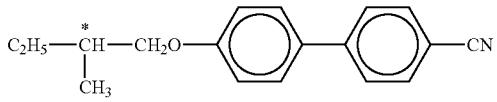

C 15

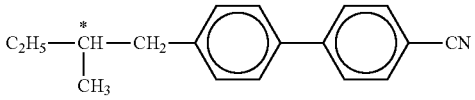

CB 15

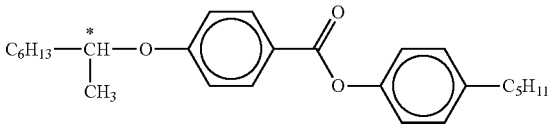

CM 21

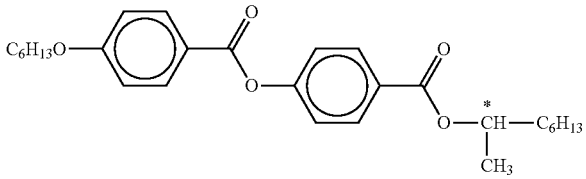

R/S-811

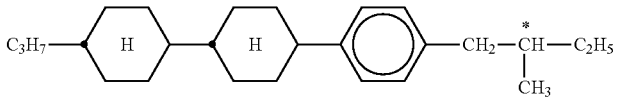

CM 44

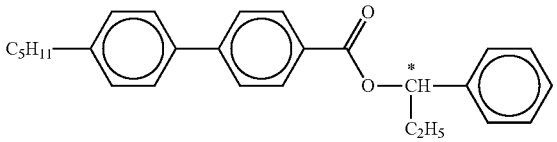

CM 45

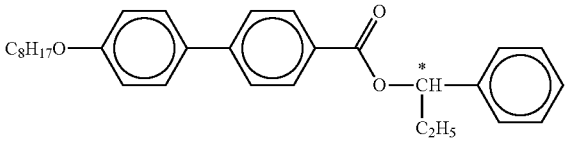

CM 47

TABLE C-continued
Table C indicates possible dopants, which are generally added to the liquid-crystalline mixtures. The mixtures preferably comprise 0-10% by weight, in particular 0.01-5% by weight and particularly preferably 0.01-3% by weight, of dopants.
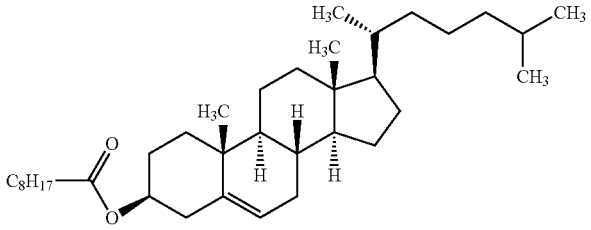
CN
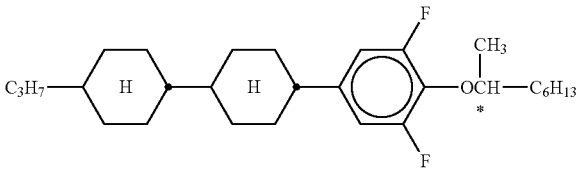
R/S-2011
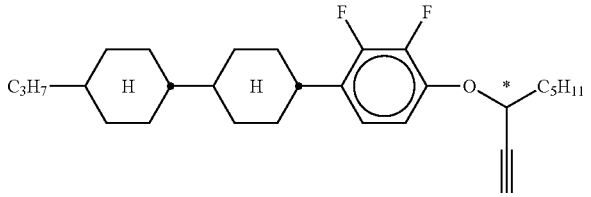
R/S-3011
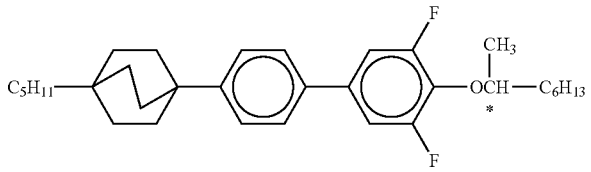
R/S-4011
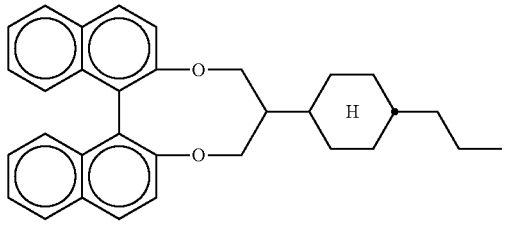
R/S-5011
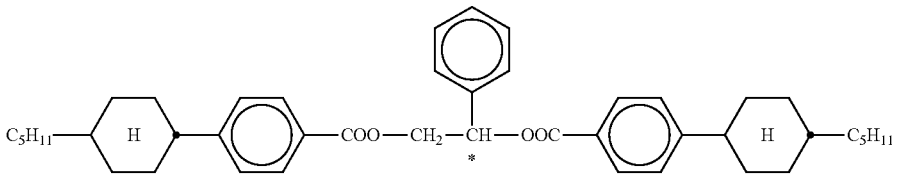
R/S-1011

Stabilisers, which can be added, for example, to the liquid-crystalline mixtures in amounts of 0-10% by weight, are shown below.
TABLE D
Stabilizers, which can be added, for example, to the liquid-crystalline mixtures in amounts of 0-10% by weight, are shown below.
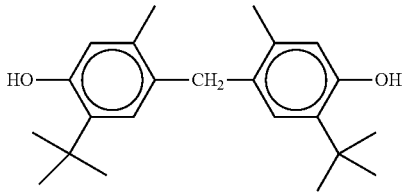
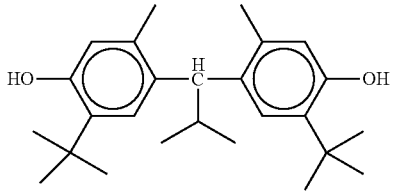
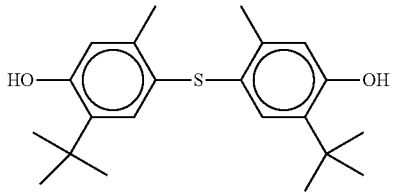
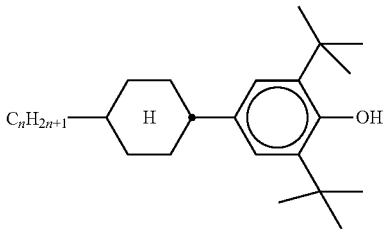
n = 1, 2, 3, 4, 5, 6 or 7
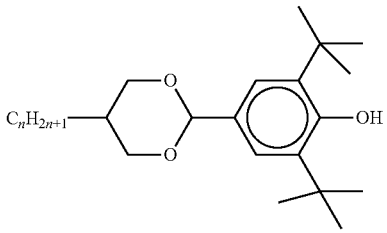
n = 1, 2, 3, 4, 5, 6 or 7
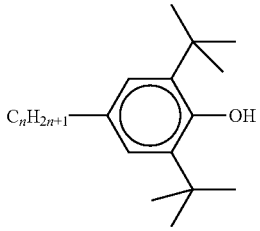
n = 1, 2, 3, 4, 5, 6 or 7

TABLE D-continued
Stabilizers, which can be added, for example, to the liquid-crystalline mixtures in amounts of 0-10% by weight, are shown below.
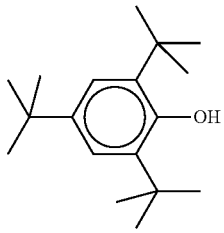
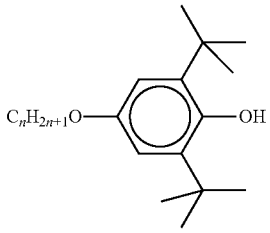
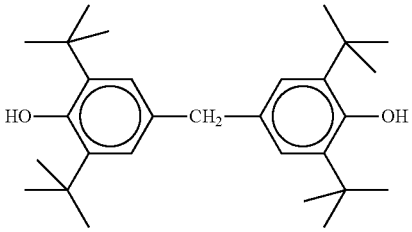
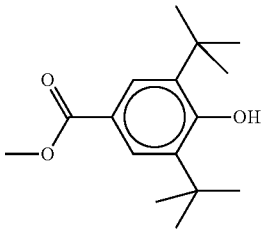
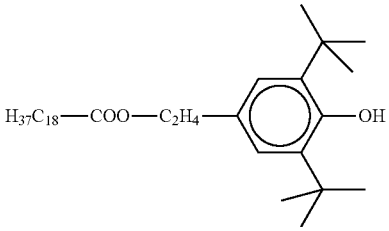
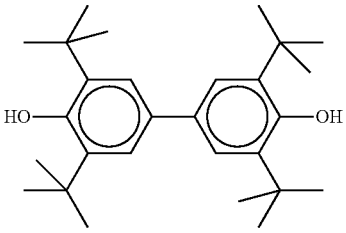

TABLE D-continued
Stabilizers, which can be added, for example, to the liquid-crystalline mixtures in amounts of 0-10% by weight, are shown below.
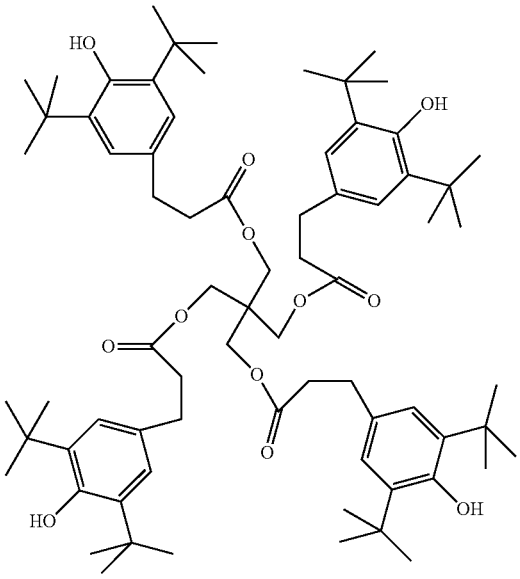
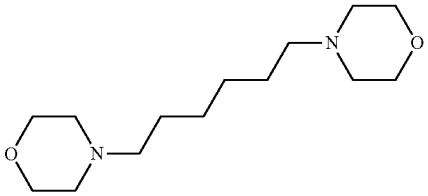
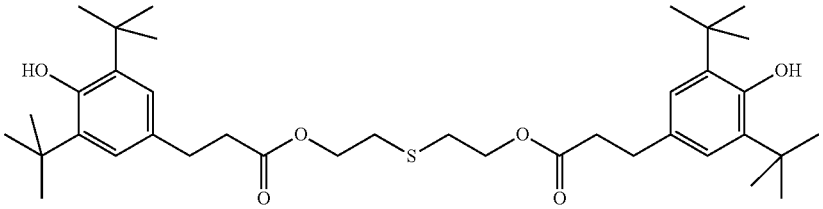
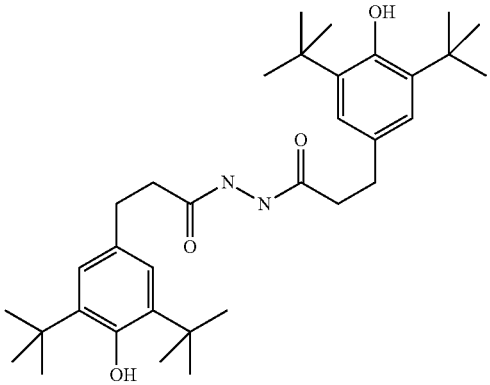

TABLE D-continued
Stabilizers, which can be added, for example, to the liquid-crystalline mixtures in amounts of 0-10% by weight, are shown below.
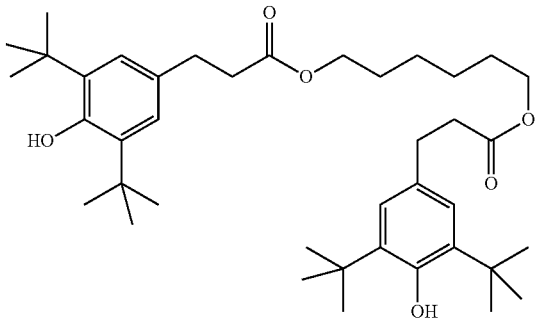
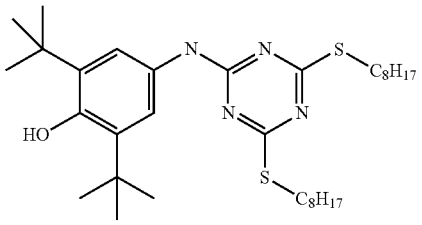
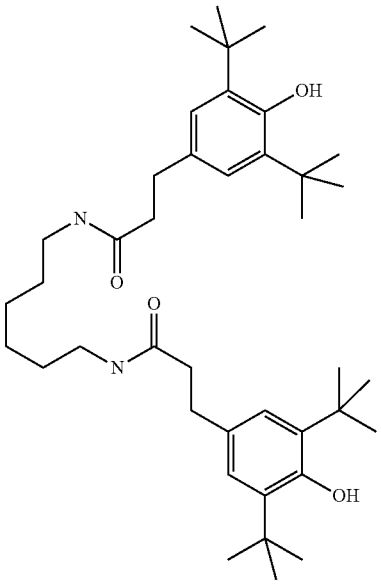

TABLE D-continued
Stabilizers, which can be added, for example, to the liquid-crystalline mixtures in amounts of 0-10% by weight, are shown below.
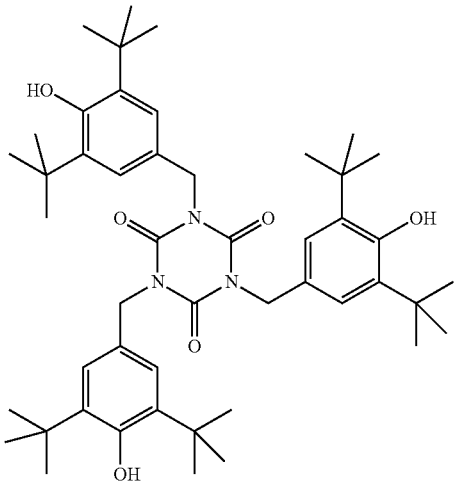
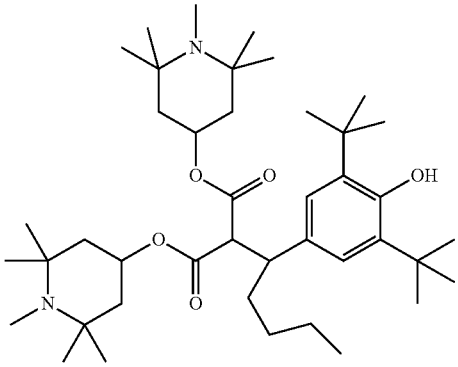
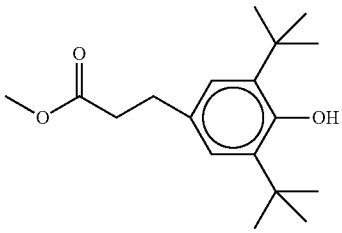
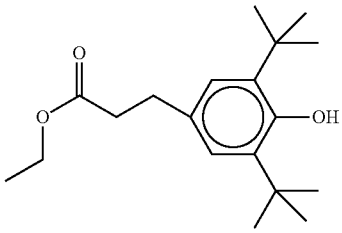
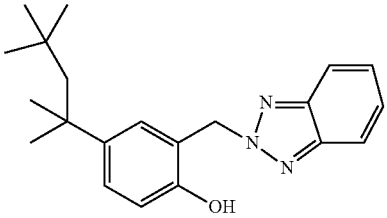

TABLE D-continued
| Stabilizers, which can be added, for example, to the liquid-crystalline mixtures in amounts of 0-10% by weight, are shown below. |
|---|
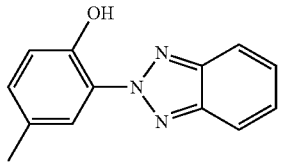
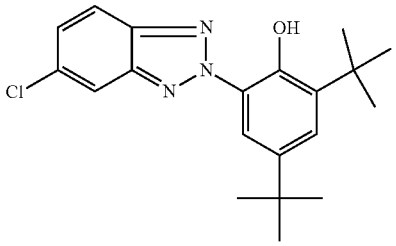
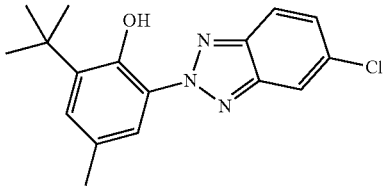
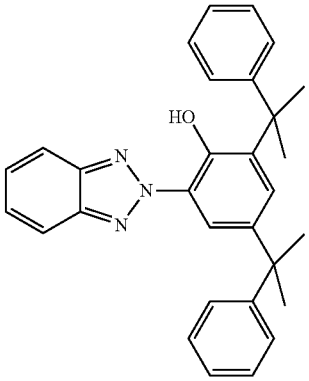
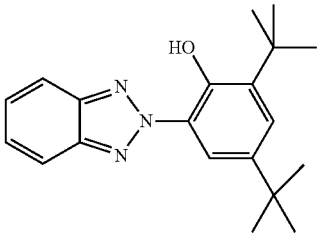
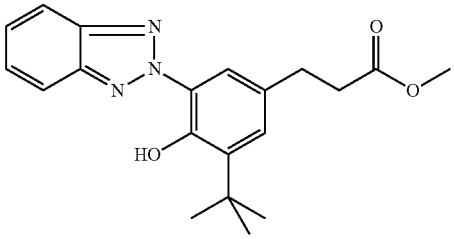

TABLE D-continued
Stabilizers, which can be added, for example, to the liquid-crystalline mixtures in amounts of 0-10% by weight, are shown below.
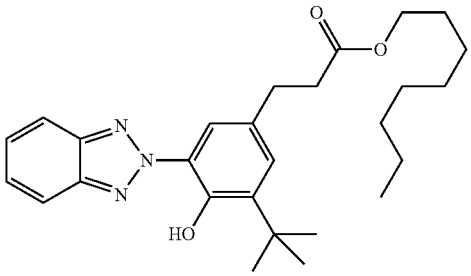
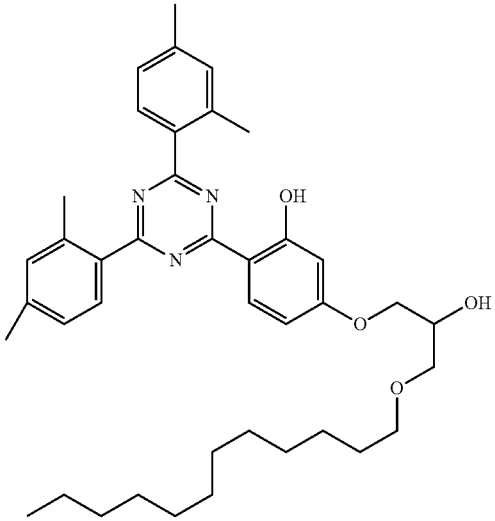
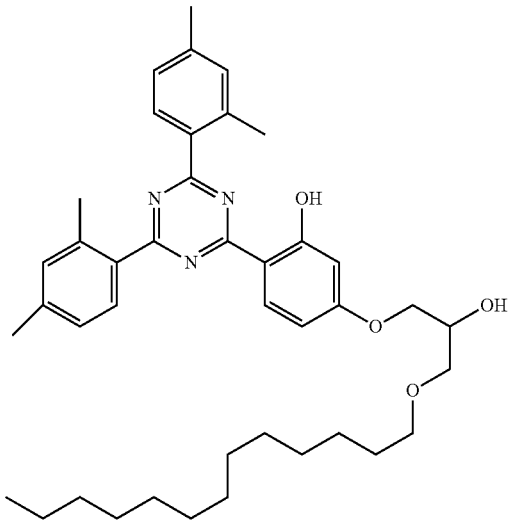

TABLE D-continued
Stabilizers, which can be added, for example, to the liquid-crystalline mixtures in amounts of 0-10% by weight, are shown below.
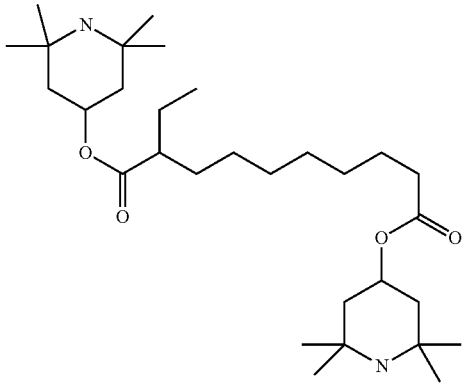
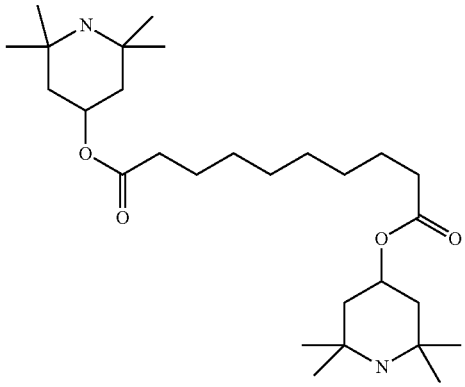
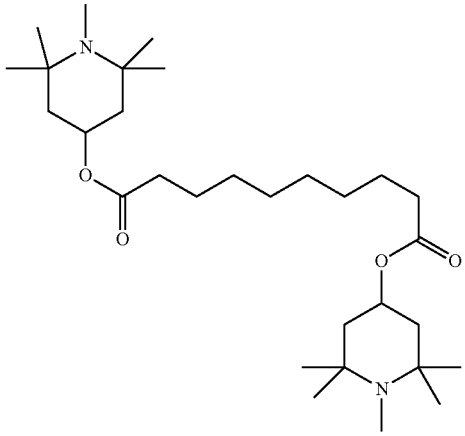

TABLE D-continued
Stabilizers, which can be added, for example, to the liquid-crystalline mixtures in amounts of 0-10% by weight, are shown below.
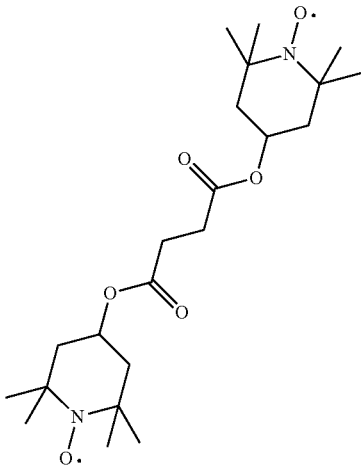
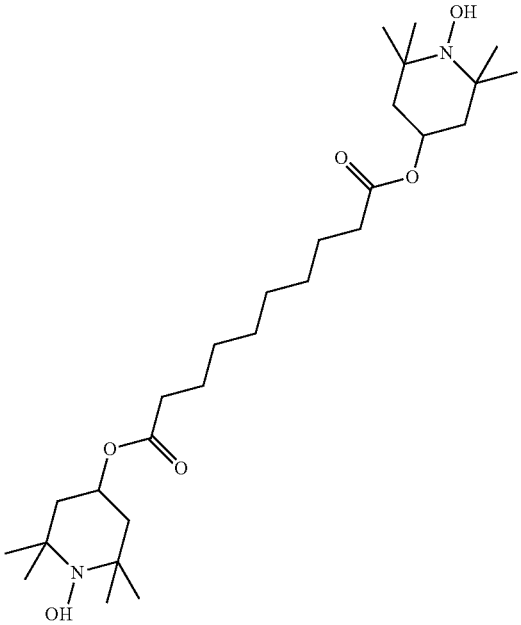
(n = 1-12)
Suitable polymerisable compounds (reactive mesogens) for use in the mixtures according to the invention, preferably in PSA and PS-VA applications or PS-IPS/FFS applications, are shown below in Table E:

TABLE E

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-1

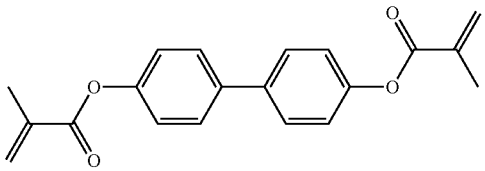

RM-2

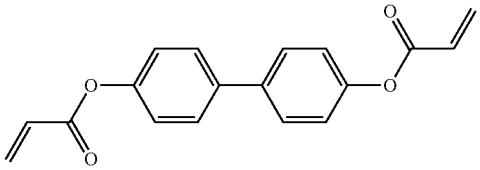

RM-3

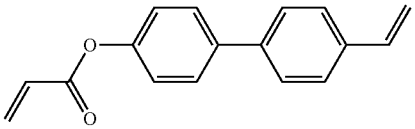

RM-4

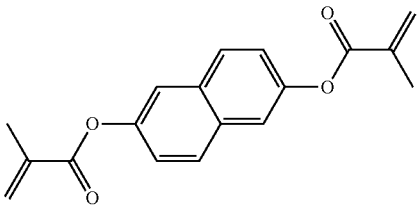

RM-5

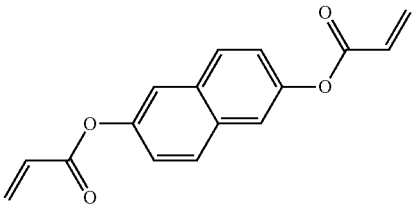

RM-6

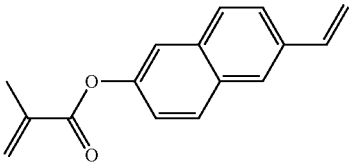

RM-7

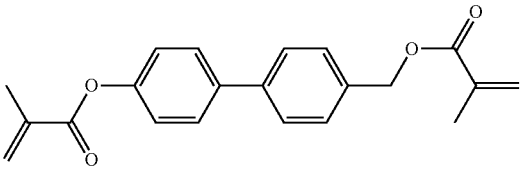

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-8

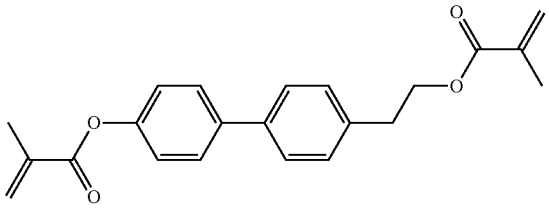

RM-9

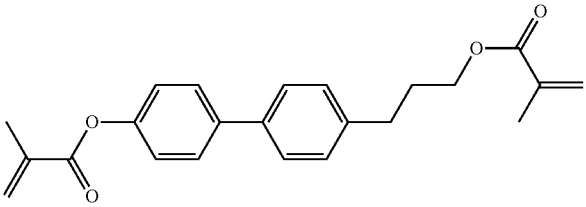

RM-10

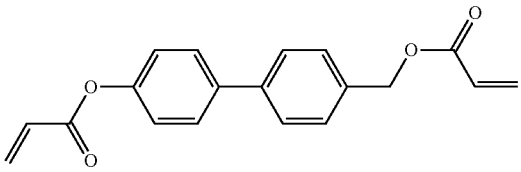

RM-11

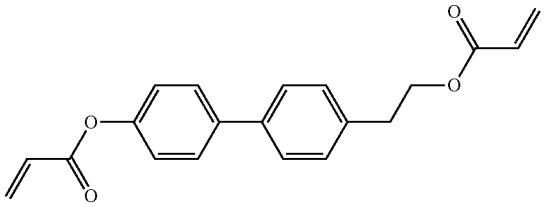

RM-12

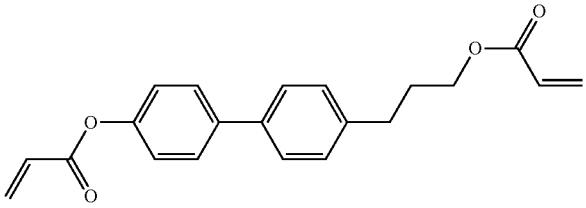

RM-13

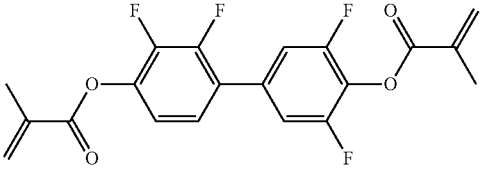

RM-14

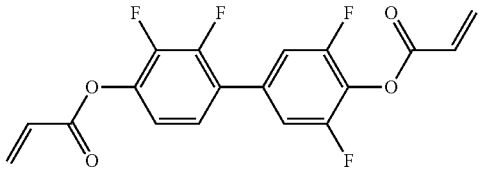

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

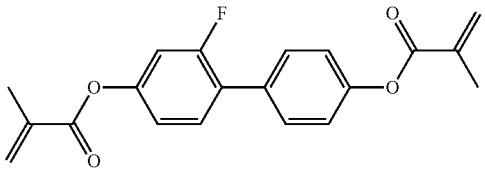
RM-15

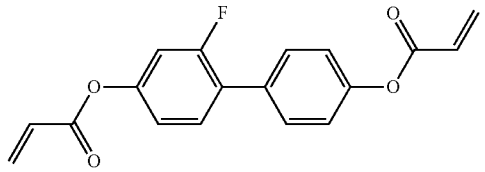
RM-16

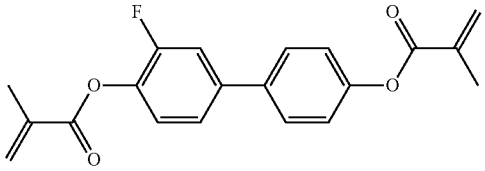
RM-17

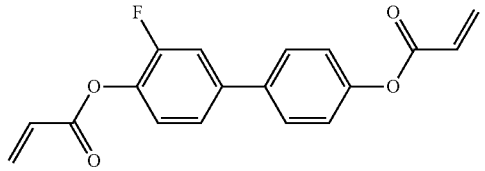
RM-18

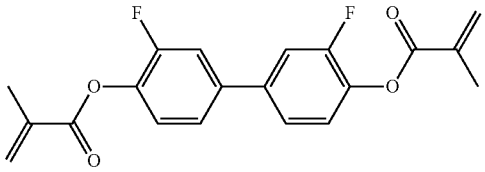
RM-19

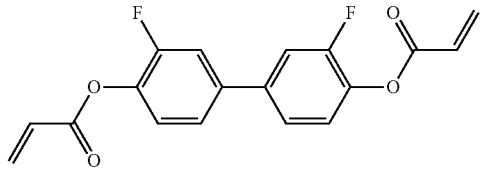
RM-20

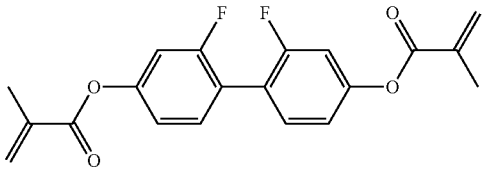
RM-21

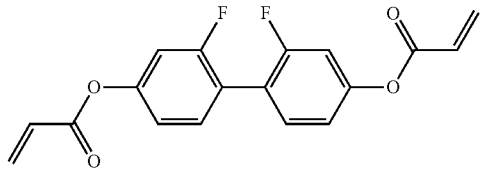
RM-22

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

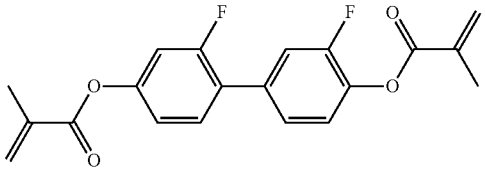
RM-23

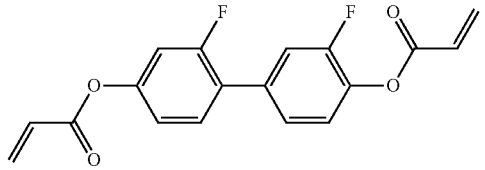
RM-24

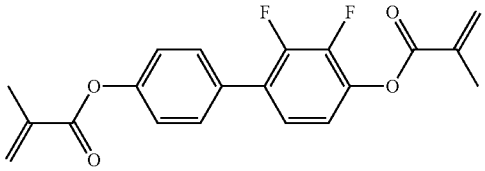
RM-25

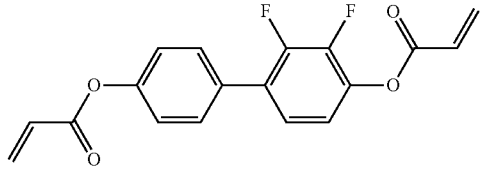
RM-26

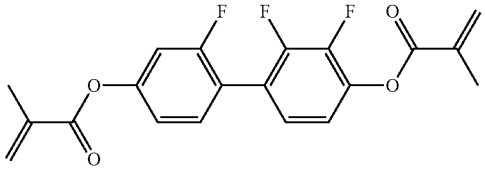
RM-27

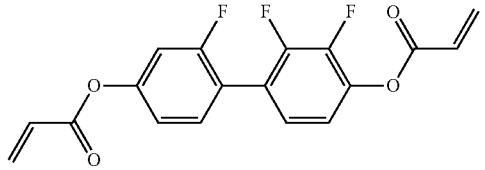
RM-28

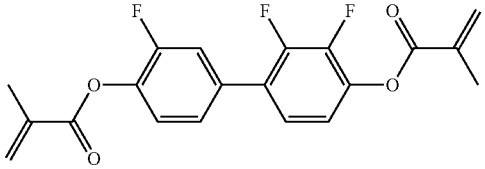
RM-29

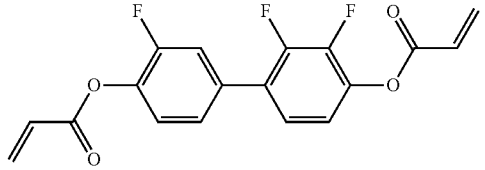
RM-30

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-31

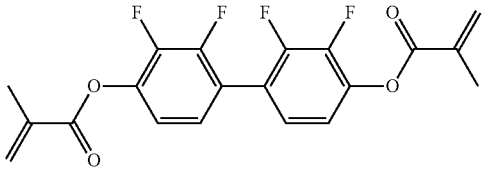

RM-32

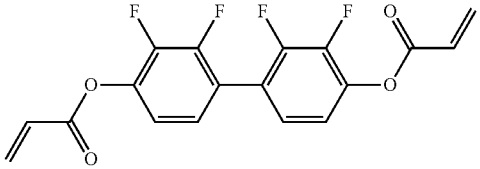

RM-33

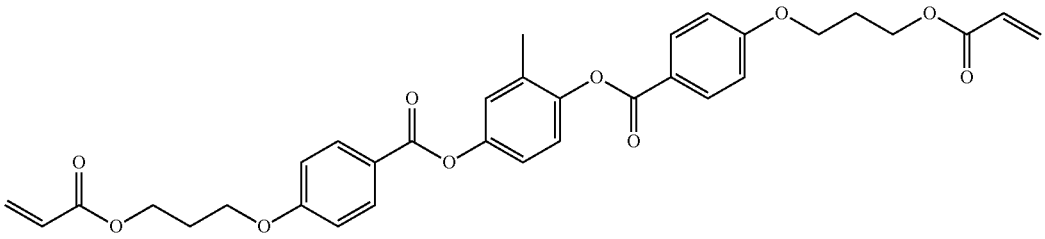

RM-34

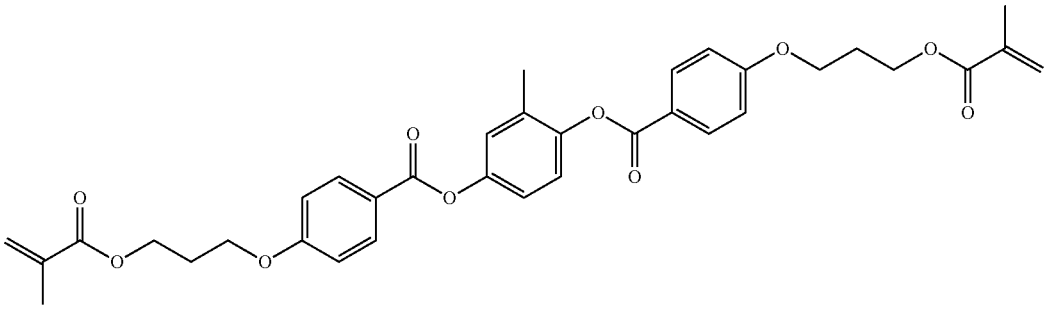

RM-35

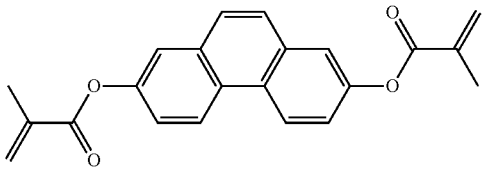

RM-36

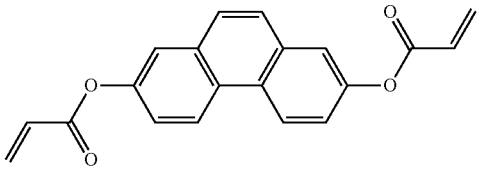

RM-37

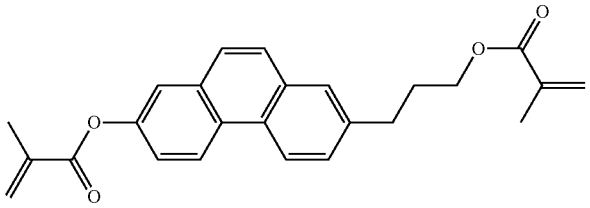

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-38

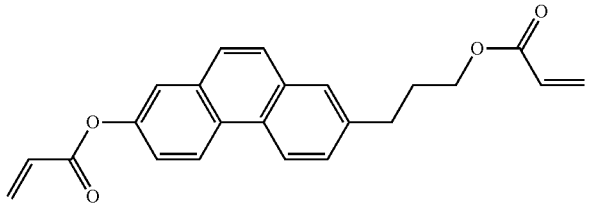

RM-39

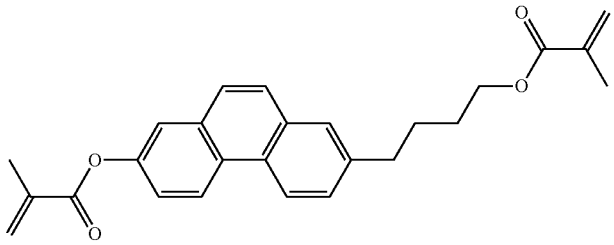

RM-40

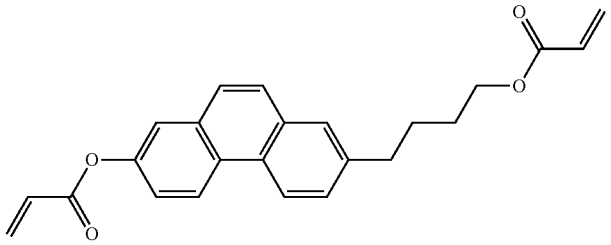

RM-41

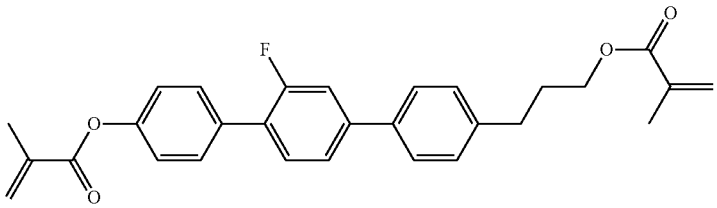

RM-42

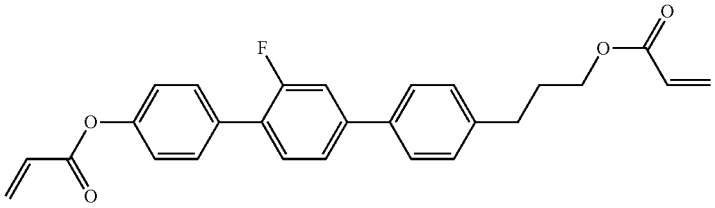

RM-43

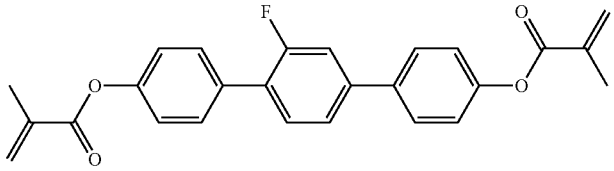

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-44

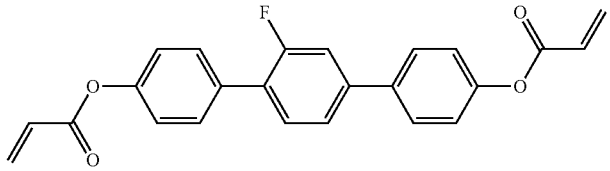

RM-45

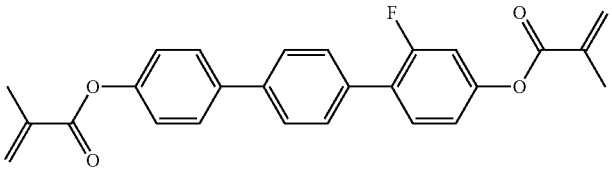

RM-46

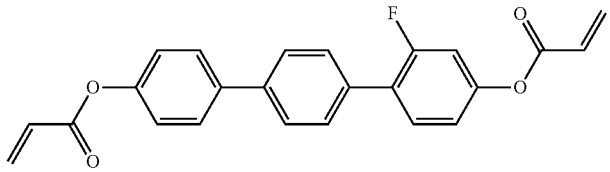

RM-47

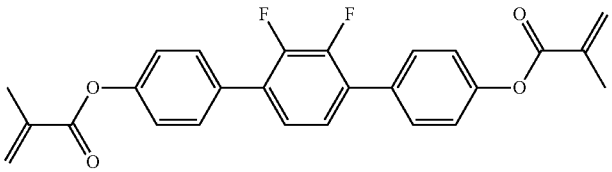

RM-48

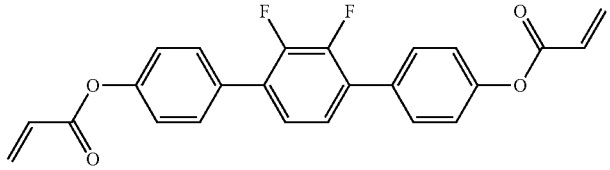

RM-49

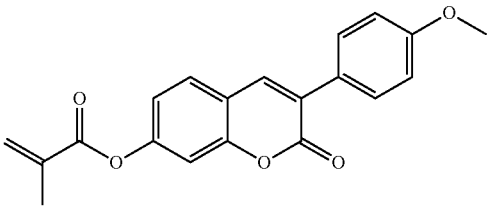

RM-50

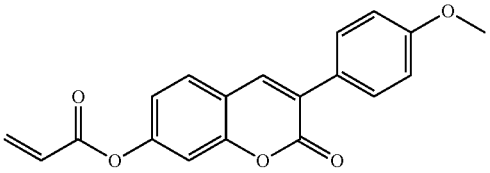

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-51

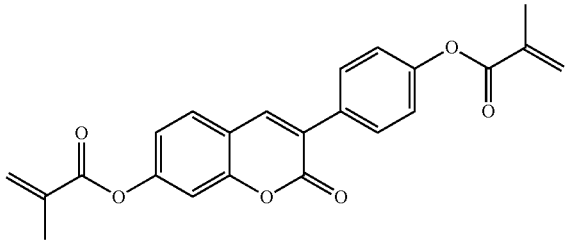

RM-52

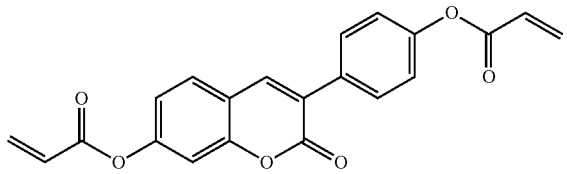

RM-53

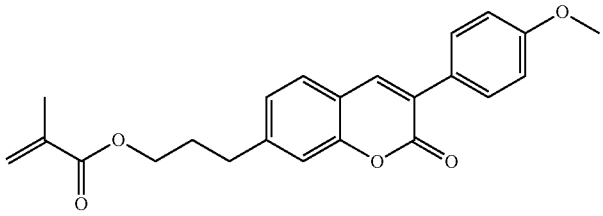

RM-54

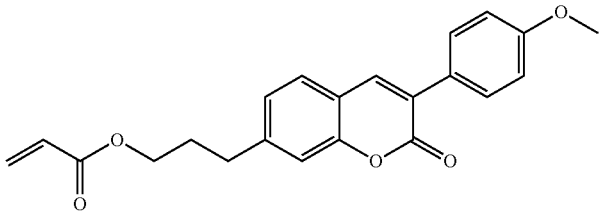

RM-55

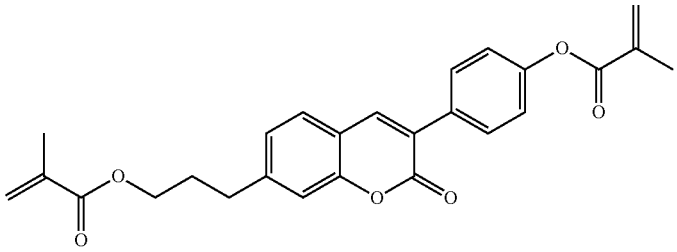

RM-56

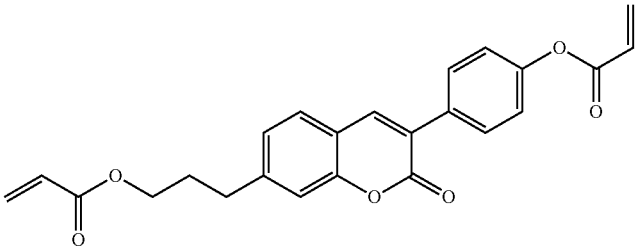

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-57

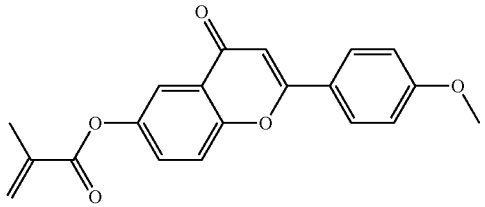

RM-58

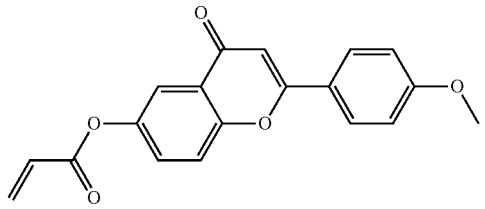

RM-59

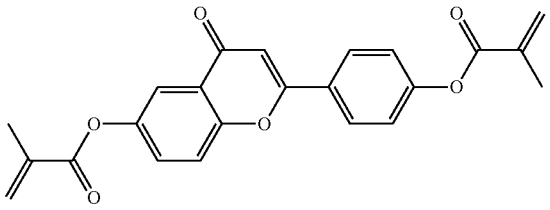

RM-60

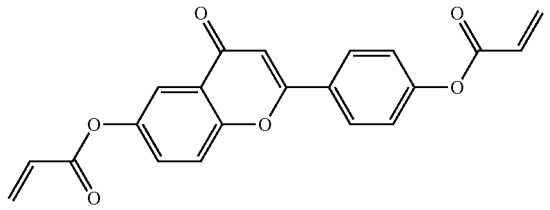

RM-61

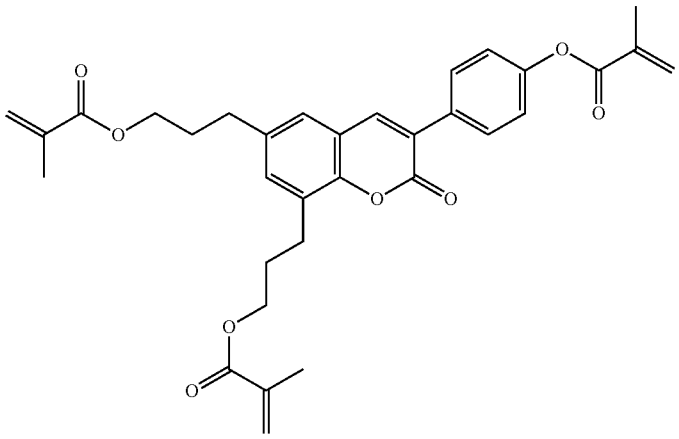

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-62

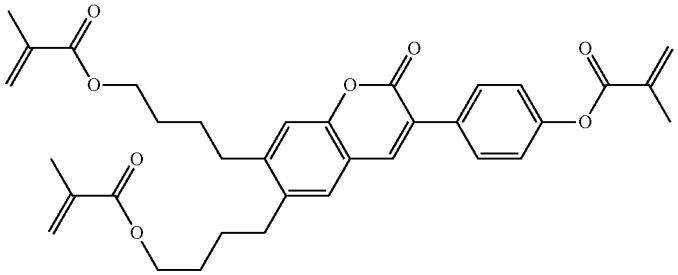

RM-63

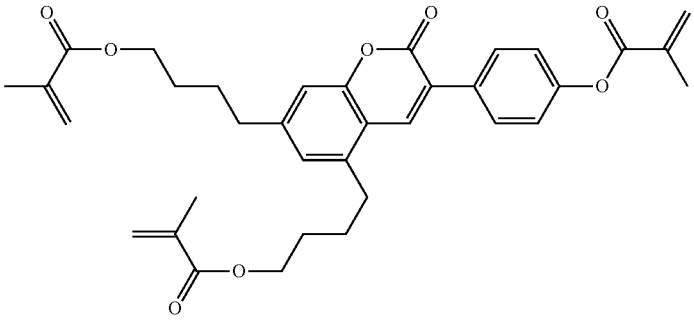

RM-64

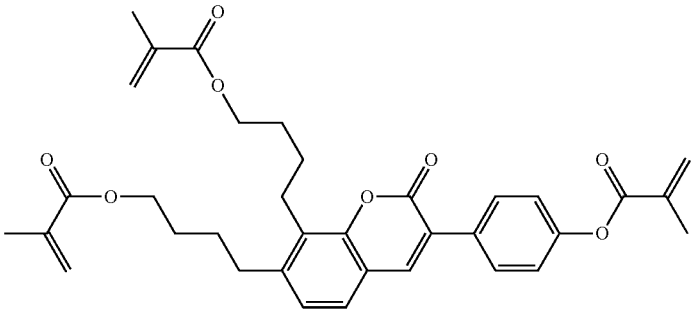

RM-65

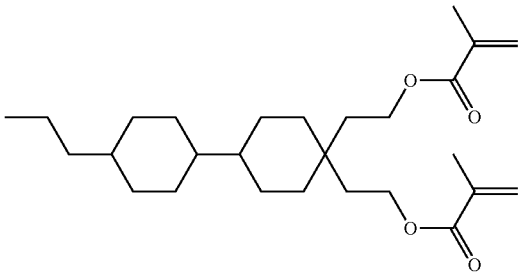

RM-66

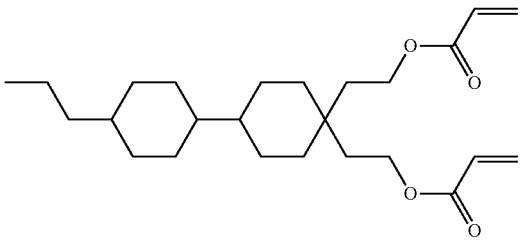

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-67

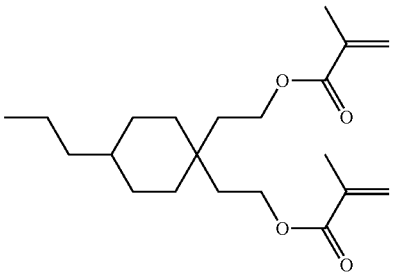

RM-68

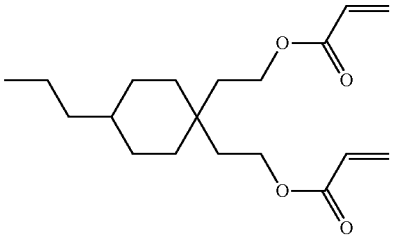

RM-69

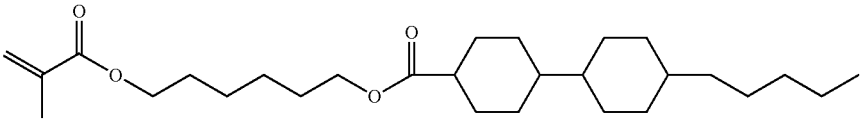

RM-70

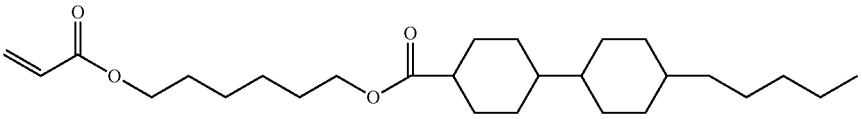

RM-71

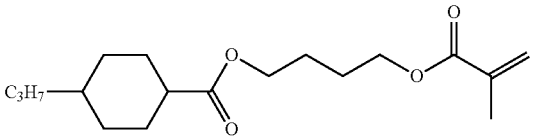

RM-72

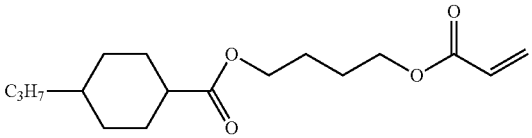

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-73

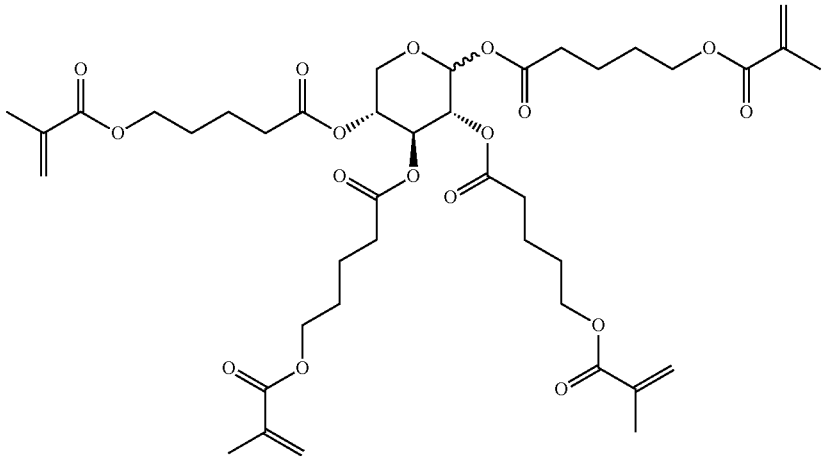

RM-74

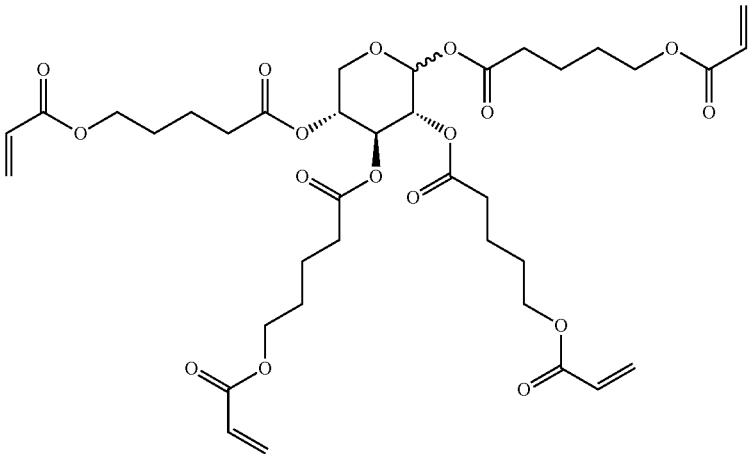

RM-75

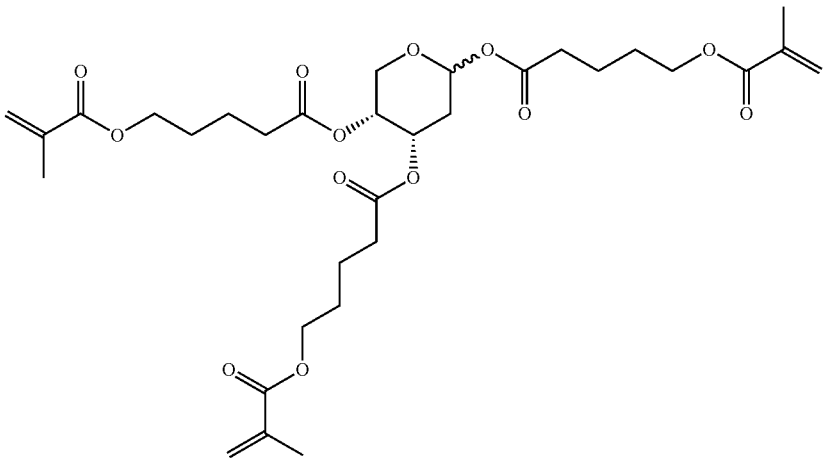

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-76

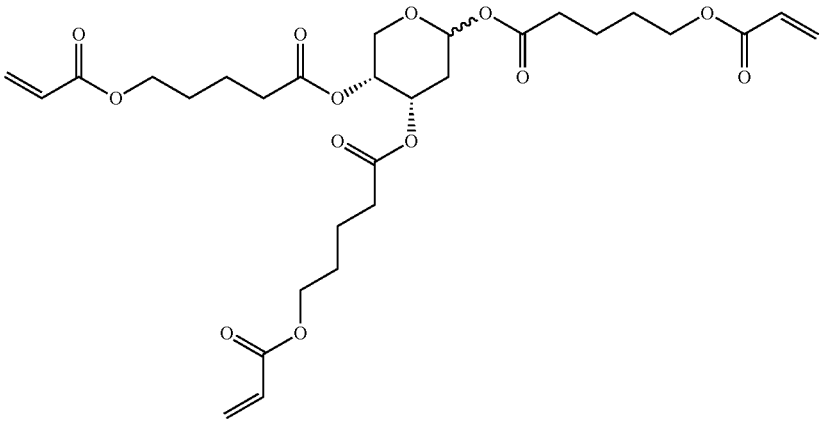

RM-77

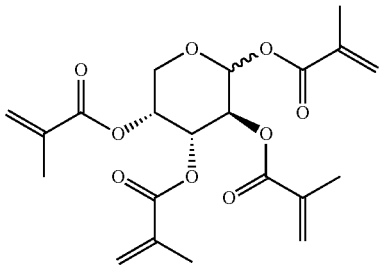

RM-78

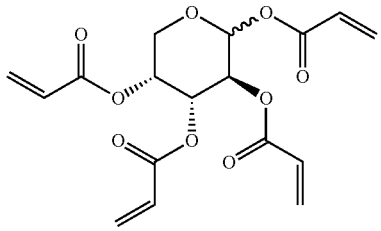

RM-79

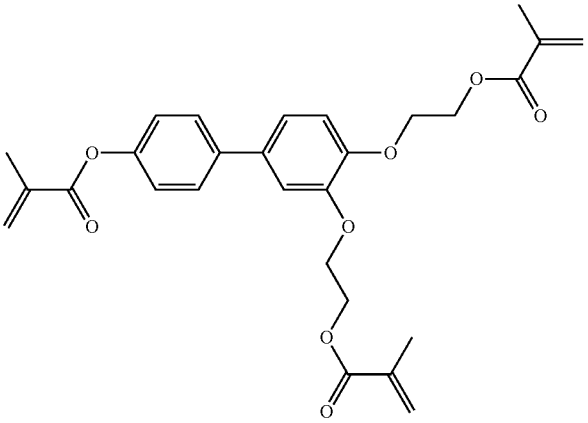

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-80

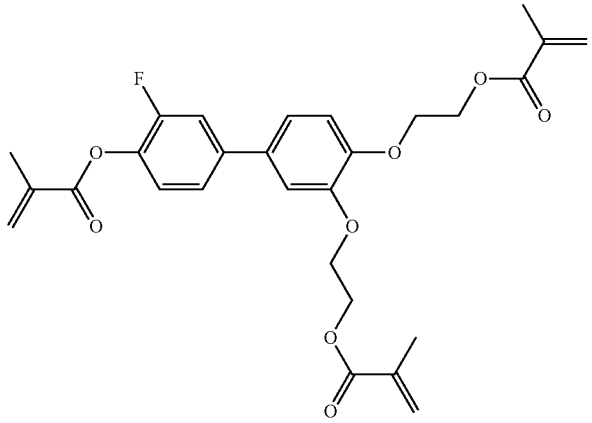

RM-81

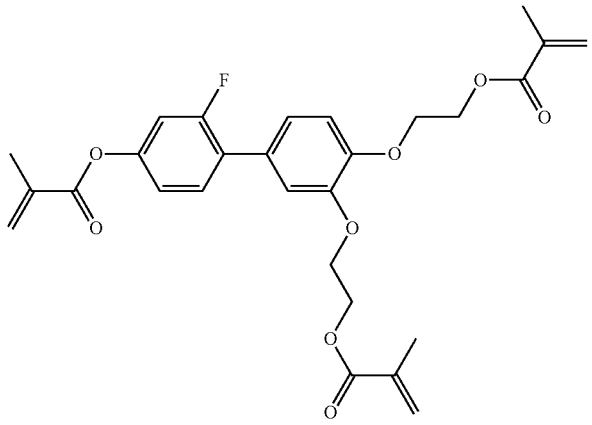

RM-82

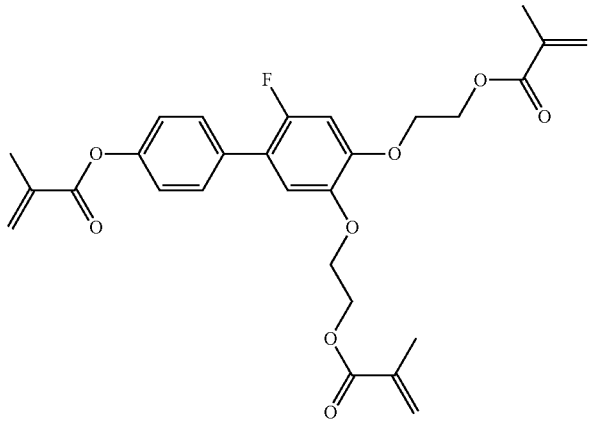

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-83

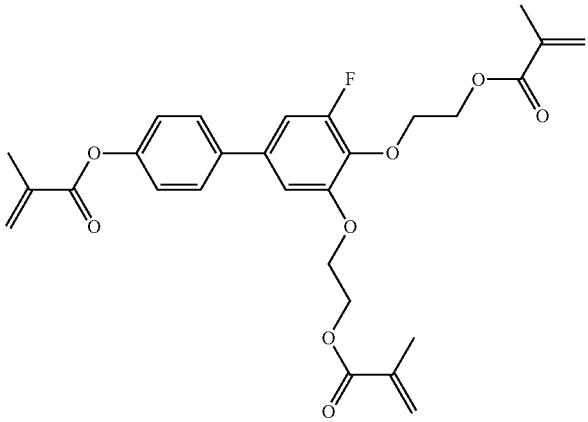

RM-84

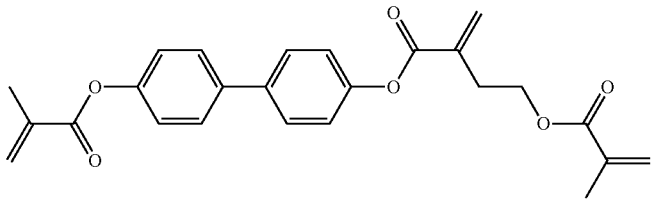

RM-85

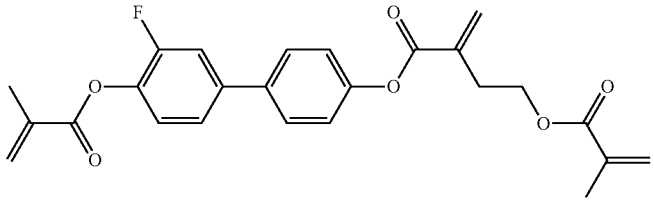

RM-86

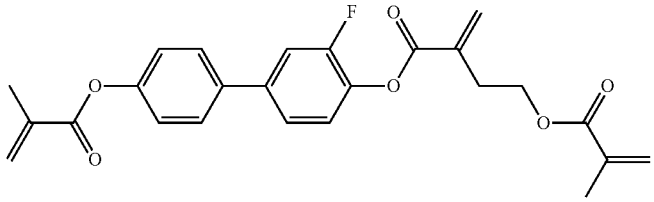

RM-87

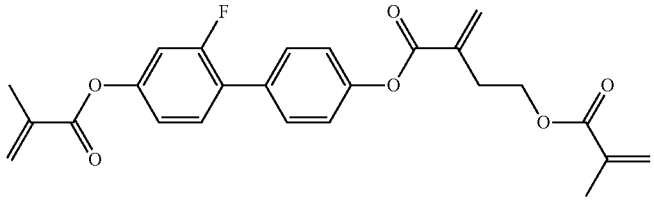

RM-88

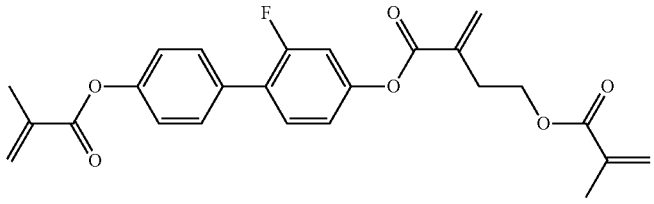

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-89

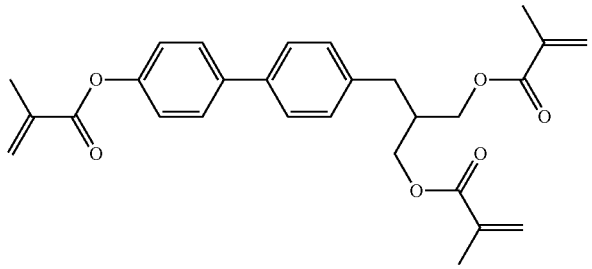

RM-90

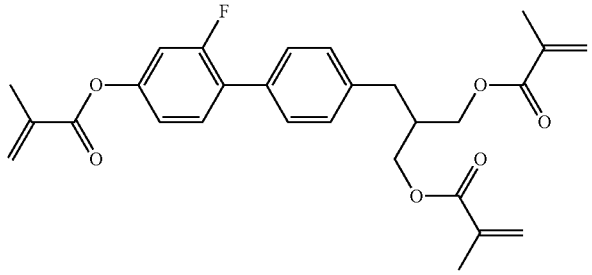

RM-91

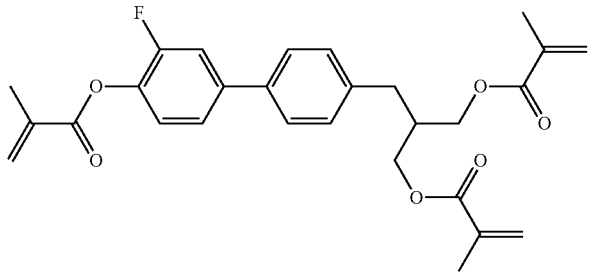

RM-92

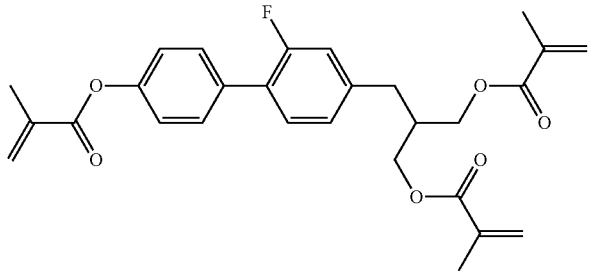

RM-93

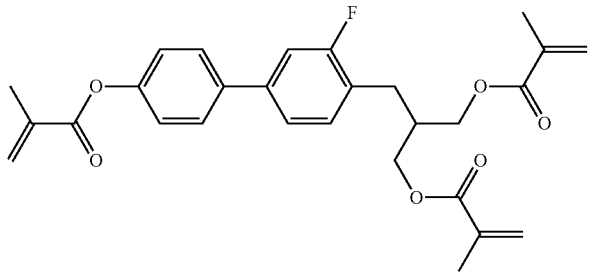

TABLE E-continued

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

RM-94

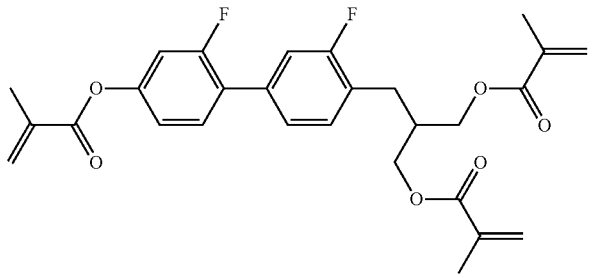

RM-95

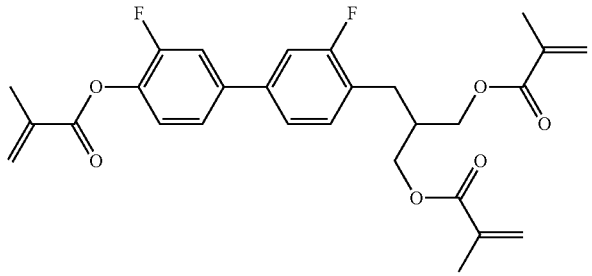

Table E shows example compounds which can preferably be used as reactive mesogenic compounds in the liquid-crystalline mixtures according to the invention. If the liquid-crystalline mixtures comprise one or more reactive compounds, they are preferably employed in amounts of 0.01-5% by weight. It may be necessary also to add an initiator or a mixture of two or more initiators for the polymerisation. The initiator or the initiator mixture is preferably added in amounts of 0.001-2% by weight, based on the mixture. A suitable initiator is, for example, Irgacure (BASF) or Irganox (BASF).

In a preferred embodiment, the liquid-crystalline mixtures comprise one or more compounds selected from the group of the compounds from Table E.

EXAMPLES

The following working examples are intended to explain the invention without restricting it.

Above and below, percent data denote percent by weight. All temperatures are indicated in degrees Celsius. m.p. denotes melting point, cl.p.=clearing point. Furthermore, C=crystalline state, N=nematic phase, S=smectic phase and I=isotropic phase. The data between these symbols represent the transition temperatures. Furthermore, $V_o$ denotes threshold voltage, capacitive [V] at 20° C.

Δn denotes the optical anisotropy measured at 20° C. and 589 nm

Δ∈ denotes the dielectric anisotropy at 20° C. and 1 kHz cl.p. denotes clearing point [° C.]

$K_1$ denotes elastic constant, "splay" deformation at 20° C., [pN]

$K_3$ denotes elastic constant, "bend" deformation at 20° C., [pN]

$\gamma_1$ denotes rotational viscosity measured at 20° C. [mPa·s], determined by the rotation method in a magnetic field LTS denotes low-temperature stability (nematic phase), determined in test cells.

The following examples are intended to explain the invention without limiting it.

Above and below, percentages are percent by weight. All temperatures are indicated in degrees Celsius.

Working Examples

Example 1

A liquid-crystalline mixture, preferably for PS-VA applications, of the composition

| | |
|---|---|
| CCH-35 | 9.47% |
| CCH-501 | 4.99% |
| CCY-2-1 | 9.47% |
| CCY-3-1 | 10.47% |
| CCY-3-O2 | 10.47% |
| CCY-5-O2 | 9.47% |
| CPY-2-O2 | 11.96% |
| CY-3-O4 | 8.97% |
| CY-5-O4 | 10.97% |
| RM-1 | 0.30% |
| PCH-53 | 13.46% |

is dispensed into a container using the filling device described in FIG. 1 and FIG. 2.

Example 2

A liquid-crystalline mixture, preferably for PS-VA applications, of the composition

| | |
|---|---|
| BCH-32 | 7.48% |
| CCH-23 | 21.93% |
| CCH-34 | 3.49% |
| CCY-3-O3 | 6.98% |
| CCY-4-O2 | 7.98% |
| CPY-2-O2 | 10.97% |
| CPY-3-O2 | 10.97% |
| CY-3-O2 | 15.45% |
| RM-1 | 0.30% |
| PCH-301 | 12.46% |
| PCH-302 | 1.99% |

is dispensed into a container using the filling device described in FIG. 1 and FIG. 2.

Example 3

A liquid-crystalline mixture, preferably for PS-VA applications, of the composition

| | |
|---|---|
| CC-3-V1 | 7.98% |
| CCH-23 | 17.95% |
| CCH-34 | 3.99% |
| CCH-35 | 6.98% |
| CCP-3-1 | 4.99% |
| CCY-3-O2 | 12.46% |
| CPY-2-O2 | 7.98% |
| CPY-3-O2 | 10.97% |
| CY-3-O2 | 15.45% |
| RM-1 | 0.30% |
| PY-3-O2 | 10.97% |

is dispensed into a container using the filling device described in FIG. 1 and FIG. 2.

Example 4

A liquid-crystalline mixture, preferably for PS-VA applications, of the composition

| | |
|---|---|
| CC-3-V1 | 8.97% |
| CCH-23 | 12.96% |
| CCH-34 | 6.23% |
| CCH-35 | 7.73% |
| CCP-3-1 | 3.49% |
| CCY-3-O2 | 12.21% |
| CPY-2-O2 | 6.73% |
| CPY-3-O2 | 11.96% |
| CY-3-O2 | 11.47% |
| RM-1 | 0.30% |
| PP-1-2V1 | 4.24% |
| PY-3-O2 | 13.71% |

is dispensed into a container using the filling device described in FIG. 1 and FIG. 2.

Example 5

A liquid-crystalline mixture, preferably for TN-TFT applications, of the composition

| | |
|---|---|
| CBC-33 | 3.50% |
| CC-3-V | 38.00% |
| CC-3-V1 | 10.00% |
| CCP-V-1 | 3.00% |
| CCP-V2-1 | 9.00% |
| PGP-2-3 | 5.00% |
| PGP-2-4 | 5.00% |
| PGU-2-F | 8.00% |

-continued

| | |
|---|---|
| PGU-3-F | 9.00% |
| PUQU-3-F | 9.50% |

is dispensed into a container using the filling device described in FIG. 1 and FIG. 2.

Example 6

A liquid-crystalline mixture, preferably for IPS or FFS applications, of the composition

| | |
|---|---|
| APUQU-3-F | 4.50% |
| CC-3-V | 44.00% |
| CC-3-V1 | 12.00% |
| CCP-V-1 | 11.00% |
| CCP-V2-1 | 9.00% |
| PGP-2-3 | 6.00% |
| PGUQU-3-F | 6.00% |
| PP-1-2V1 | 7.00% |
| PPGU-3-F | 0.50% |

is dispensed into a container using the filling device described in FIG. 1 and FIG. 2.

Example 7

A liquid-crystalline mixture, preferably for IPS or FFS applications, of the composition

| | |
|---|---|
| APUQU-3-F | 8.00% |
| CBC-33 | 3.00% |
| CC-3-V | 34.00% |
| CC-3-V1 | 2.50% |
| CCGU-3-F | 4.00% |
| CCP-30CF$_3$ | 4.00% |
| CCP-3F.F.F | 4.50% |
| CCP-50CF$_3$ | 3.00% |
| CCP-V-1 | 10.00% |
| CCQU-3-F | 10.00% |
| CPGU-3-OT | 6.00% |
| PGUQU-3-F | 4.00% |
| PUQU-3-F | 7.00% |

is dispensed into a container using the filling device described in FIG. 1 and FIG. 2.

Example 8

A liquid-crystalline mixture, preferably for IPS or FFS applications, of the composition

| | |
|---|---|
| APUQU-2-F | 5.00% |
| APUQU-3-F | 7.50% |
| BCH-3F.F.F | 7.00% |
| CC-3-V | 40.50% |
| CC-3-V1 | 6.00% |
| CCP-V-1 | 9.50% |
| CPGU-3-OT | 5.00% |
| PGP-2-3 | 6.00% |
| PGP-2-4 | 6.00% |
| PPGU-3-F | 0.50% |
| PUQU-3-F | 7.00% |

is dispensed into a container using the filling device described in FIG. 1 and FIG. 2.

Example 9

A liquid-crystalline mixture, preferably for TN-TFT applications, of the composition

| | |
|---|---|
| APUQU-2-F | 8.00% |
| APUQU-3-F | 8.00% |
| BCH-32 | 7.00% |
| CC-3-V | 43.00% |
| CCP-V-1 | 9.00% |
| PGP-2-3 | 7.00% |
| PGP-2-4 | 6.00% |
| PUQU-2-F | 5.00% |
| PUQU-3-F | 7.00% |

is dispensed into a container using the filling device described in FIG. 1 and FIG. 2.

Example 10

A liquid-crystalline mixture, preferably for TN-TFT applications, of the composition

| | |
|---|---|
| BCH-5F.F | 8.00% |
| CBC-33F | 3.00% |
| CC-3-V | 22.00% |
| CCGU-3-F | 6.00% |
| CCP-3F.F.F | 8.00% |
| CCP-5F.F.F | 4.00% |
| CCP-V-1 | 13.00% |
| CCP-V2-1 | 11.00% |
| CCQU-3-F | 5.00% |
| CCQU-5-F | 4.00% |
| PUQU-3-F | 16.00% |

is dispensed into a container using the filling device described in FIG. 1 and FIG. 2.

Example 11

A liquid-crystalline mixture, preferably for TN-TFT applications, of the composition

| | |
|---|---|
| CBC-33F | 3.00% |
| CBC-53F | 3.00% |
| CC-3-V | 17.00% |
| CC-3-V1 | 4.00% |
| CCP-3F.F.F | 8.00% |
| CCPC-33 | 3.00% |
| CCPC-34 | 3.00% |
| CCP-V-1 | 5.00% |
| CCP-V2-1 | 2.00% |
| CCQU-2-F | 1.50% |
| CCQU-3-F | 10.00% |
| CCQU-5-F | 10.00% |
| CGU-3-F | 6.00% |
| PGP-2-3 | 7.50% |
| PP-1-2V1 | 7.00% |
| PUQU-3-F | 10.00% |

is dispensed into a container using the filling device described in FIG. 1 and FIG. 2.

Example 12

A liquid-crystalline mixture, preferably for TN-TFT applications, of the composition

| | |
|---|---|
| APUQU-2-F | 1.00% |
| BCH-3F.F.F | 15.00% |
| CC-3-V | 33.50% |
| CC-3-V1 | 2.00% |
| CCGU-3-F | 1.00% |
| CCPC-33 | 2.00% |
| CCP-V-1 | 4.50% |
| BCH-2F | 5.00% |
| BCH-3F | 5.00% |
| PGP-2-3 | 8.50% |
| PGUQU-3-F | 7.80% |
| PP-1-2V1 | 11.00% |
| PPGU-3-F | 0.20% |
| PUQU-3-F | 3.50% |

is dispensed into a container using the filling device described in FIG. 1 and FIG. 2.

Example 13

A liquid-crystalline mixture, preferably for IPS or FFS applications, of the composition

| | |
|---|---|
| APUQU-2-F | 2.00% |
| APUQU-3-F | 6.00% |
| CC-3-V | 42.00% |
| CCP-3-1 | 3.00% |
| CCP-3-3 | 3.00% |
| CCP-3F.F.F | 8.00% |
| CCP-V-1 | 1.50% |
| CCQU-3-F | 7.00% |
| CCQU-5-F | 3.00% |
| CPGU-3-OT | 6.50% |
| PGUQU-3-F | 5.00% |
| PGUQU-4-F | 4.00% |
| PGUQU-5-F | 4.00% |
| PPGU-3-F | 0.50% |
| PUQU-3-F | 4.50% |

is dispensed into a container using the filling device described in FIG. 1 and FIG. 2.

Example 14

A liquid-crystalline mixture, preferably for TN-TFT applications, of the composition

| | |
|---|---|
| CC-3-V | 49.50% |
| CCP-3-1 | 1.50% |
| CCP-V-1 | 6.00% |
| CPGU-3-OT | 7.00% |
| PGP-2-3 | 8.50% |
| PGP-2-4 | 5.50% |
| PGUQU-3-F | 7.00% |
| PGUQU-4-F | 4.00% |
| PP-1-2V1 | 2.50% |
| PPGU-3-F | 0.50% |
| PUQU-3-F | 8.00% |

is dispensed into a container using the filling device described in FIG. 1 and FIG. 2.

Example 15

A liquid-crystalline mixture, preferably for VA applications, of the composition

| | |
|---|---|
| BCH-32 | 6.00% |
| CCH-23 | 18.00% |
| CCH-34 | 8.00% |
| CCP-3-1 | 12.00% |
| CCP-3-3 | 3.00% |
| CCY-3-O2 | 6.00% |
| CPY-2-O2 | 6.00% |
| CPY-3-O2 | 7.00% |
| CY-3-O2 | 14.00% |
| CY-3-O4 | 8.00% |
| CY-5-O2 | 9.00% |
| PYP-2-3 | 3.00% |

is dispensed into a container using the filling device described in FIG. 1 and FIG. 2.

Example 16

A liquid-crystalline mixture, preferably for PS-VA applications, of the composition

| | |
|---|---|
| CC-3-V1 | 7.98% |
| CCH-23 | 17.95% |
| CCH-34 | 3.99% |
| CCH-35 | 6.98% |
| CCP-3-1 | 4.99% |
| CCY-3-O2 | 12.46% |
| CPY-2-O2 | 7.98% |
| CPY-3-O2 | 10.97% |
| CY-3-O2 | 15.45% |
| RM-17 | 0.30% |
| PY-3-O2 | 10.97% |

is dispensed into a container using the filling device described in FIG. 1 and FIG. 2.

Example 17

A liquid-crystalline mixture, preferably for VA applications, of the composition

| | |
|---|---|
| CC-3-V | 29.50% |
| PP-1-3 | 11.00% |
| PY-3-O2 | 12.00% |
| CCP-3-1 | 9.50% |
| CCOY-2-O2 | 18.00% |
| CCOY-3-O2 | 13.00% |
| GPP-5-2 | 7.00% |

is dispensed into a container using the filling device described in FIG. 1 and FIG. 2.

Mixture Examples 1 to 17 may additionally also comprise one or more, preferably one or two, stabiliser(s) and/or a dopant from Tables C and D.

The liquid-crystal mixtures of Examples 18-168 shown below are dispensed into a container analogously using the filling device described in FIG. 1 and FIG. 2.

Example 18

| | | | |
|---|---|---|---|
| CCY-3-O1 | 7.50% | Clearing point [° C.]: | 81.5 |
| CCY-4-O2 | 3.50% | $\Delta n$ [589 nm, 20° C.]: | 0.1082 |
| CLY-3-O2 | 7.00% | $\Delta\varepsilon$ [1 kHz, 20° C.]: | −2.7 |
| CPY-2-O2 | 10.00% | $\varepsilon_{\parallel}$ [1 kHz, 20° C.]: | 3.4 |
| CPY-3-O2 | 10.00% | $\varepsilon_{\perp}$ [1 kHz, 20° C.] | 6.1 |
| PYP-2-3 | 9.00% | $\gamma_1$ [mPa · s, 20° C.]: | 88 |
| CC-3-V | 45.00% | $K_1$ [pN, 20° C.]: | 13.4 |
| PY-1-O4 | 4.00% | $K_3$ [pN, 20° C.]: | 15.3 |
| PY-3-O2 | 2.00% | $V_0$ [20° C., V]: | 2.53 |
| Y-4O-O4 | 2.00% | | |

Example 19

| | | | |
|---|---|---|---|
| CCY-3-O1 | 7.50% | Clearing point [° C.]: | 81 |
| CCY-4-O2 | 5.00% | $\Delta n$ [589 nm, 20° C.]: | 0.1054 |
| CLY-3-O2 | 7.00% | $\Delta\varepsilon$ [1 kHz, 20° C.]: | −2.6 |
| CPY-2-O2 | 10.00% | $\varepsilon_{\parallel}$ [1 kHz, 20° C.]: | 3.4 |
| CPY-3-O2 | 8.50% | $\varepsilon_{\perp}$ [1 kHz, 20° C.]: | 6.0 |
| PYP-2-3 | 9.00% | $\gamma_1$ [mPa · s, 20° C.]: | 86 |
| CC-3-V | 45.50% | $K_1$ [pN, 20° C.]: | 13.3 |
| PY-1-O4 | 5.00% | $K_3$ [pN, 20° C.]: | 15.1 |
| Y-4O-O4 | 2.50% | $V_0$ [20° C., V]: | 2.54 |

Example 20

| | | | |
|---|---|---|---|
| CC-3-2V1 | 4.00% | Clearing point [° C.]: | 100 |
| CC-3-V | 37.50% | $\Delta n$ [589 nm, 20° C.]: | 0.1047 |
| CC-3-V1 | 5.00% | $\Delta\varepsilon$ [1 kHz, 20° C.]: | 3.9 |
| CCP-V-1 | 13.00% | $\varepsilon_{\parallel}$ [1 kHz, 20° C.]: | 6.6 |
| CCP-V2-1 | 7.50% | $\varepsilon_{\perp}$ [1 kHz, 20° C.]: | 2.7 |
| CCVC-3-V | 6.00% | $\gamma_1$ [mPa · s, 20° C.]: | 72 |
| CDUQU-3-F | 1.00% | $K_1$ [pN, 20° C.]: | 15.1 |
| CPGP-5-2 | 3.00% | $K_3$ [pN, 20° C.]: | 17.4 |
| DGUQU-4-F | 2.00% | $V_0$ [20° C., V]: | 2.07 |
| PGP-2-3 | 5.00% | | |
| PGP-2-4 | 3.00% | | |
| PGUQU-3-F | 4.00% | | |
| PGUQU-4-F | 3.50% | | |
| PPGU-3F | 0.50% | | |
| PUQU-3F | 5.00% | | |

Example 21

| | | | |
|---|---|---|---|
| APUQU-2-F | 1.50% | Clearing point [° C.]: | 100 |
| APUQU-3-F | 5.00% | $\Delta n$ [589 nm, 20° C.]: | 0.1056 |
| CC-3-2V1 | 4.00% | $\Delta\varepsilon$ [1 kHz, 20° C.]: | 4.0 |
| CC-3-V | 36.00% | $\varepsilon_{\parallel}$ [1 kHz, 20° C.]: | 6.8 |
| CC-3-V1 | 5.00% | $\varepsilon_{\perp}$ [1 kHz, 20° C.]: | 2.8 |
| CCP-V-1 | 13.00% | $\gamma_1$ [mPa · s, 20° C.]: | 71 |
| CCP-V2-1 | 9.50% | $K_1$ [pN, 20° C.]: | 15.4 |
| CCVC-3-V | 4.00% | $K_3$ [pN, 20° C.]: | 17.7 |

-continued

| | | | |
|---|---|---|---|
| CDUQU-3-F | 3.00% | $V_0$ [20° C., V]: | 2.07 |
| DGUQU-4-F | 2.00% | | |
| PGP-1-2V | 5.50% | | |
| PGP-2-2V | 7.00% | | |
| PPGU-3-F | 0.50% | | |
| PUQU-3-F | 4.00% | | |

Example 22

| | | | |
|---|---|---|---|
| CC-3-V1 | 9.00% | Clearing point [° C.]: | 74.7 |
| CCH-23 | 18.00% | Δn [589 nm, 20° C.]: | 0.0982 |
| CCH-34 | 3.00% | Δε [1 kHz, 20° C.]: | −3.4 |
| CCH-35 | 7.00% | $\varepsilon_{\parallel}$ [1 kHz, 20° C.]: | 3.5 |
| CCP-3-1 | 5.50% | $\varepsilon_{\perp}$ [1 kHz, 20° C.]: | 6.9 |
| CCY-3-O2 | 11.50% | $\gamma_1$ [mPa · s, 20° C.]: | 108 |
| CPY-2-O2 | 8.00% | $K_1$ [pN, 20° C.]: | 14.9 |
| CPY-3-O2 | 11.00% | $K_3$ [pN, 20° C.]: | 15.9 |
| CY-3-O2 | 15.50% | $V_0$ [20° C., V]: | 2.28 |
| PY-3-O2 | 11.50% | | |

Example 22a

The mixture from Example 22 is additionally mixed with 0.001% of Irganox® 1076 (octadecyl 3-(3,5-di-tert-butyl-4-hydroxyphenyl)propionate, BASF) and 0.45% of RM-1.

Example 23

| | | | |
|---|---|---|---|
| CC-3-V | 15.00% | Clearing point [° C.]: | 85 |
| CPGP-4-3 | 2.00% | Δn [589 nm, 20° C.]: | 0.1981 |
| CPGP-5-2 | 2.00% | Δε [1 kHz, 20° C.]: | 9.9 |
| CPTP-301 | 6.00% | $\varepsilon_{\parallel}$ [1 kHz, 20° C.]: | 13.6 |
| DGUQU-4-F | 3.00% | $\varepsilon_{\perp}$ [1 kHz, 20° C.]: | 3.7 |
| PCH-301 | 7.00% | $\gamma_1$ [mPa · s, 20° C.]: | 123 |
| PGP-2-2V | 14.50% | $K_1$ [pN, 20° C.]: | 15.1 |
| PGUQU-3-F | 7.50% | $K_3$ [pN, 20° C.]: | 15.1 |
| PGUQU-4-F | 7.00% | $V_0$ [20° C., V]: | 1.29 |
| PGUQU-5-F | 6.00% | | |
| PP-1-2V1 | 12.00% | | |
| PTP-102 | 6.00% | | |
| PTP-201 | 6.00% | | |
| PUQU-3-F | 6.00% | | |

Example 24

| | | | |
|---|---|---|---|
| CC-3-V | 28.00% | Clearing point [° C.]: | 84.8 |
| CC-3-V1 | 3.00% | Δn [589 nm, 20° C.]: | 0.1078 |
| CCP-3-1 | 3.00% | Δε [1 kHz, 20° C.]: | −4.1 |
| CCY-3-O2 | 9.00% | $\varepsilon_{\parallel}$ [1 kHz, 20° C.]: | 3.7 |
| CCY-4-O2 | 9.00% | $\varepsilon_{\perp}$ [1 kHz, 20° C.]: | 7.8 |
| CLY-3-O2 | 6.00% | $\gamma_1$ [mPa · s, 20° C.]: | 122 |
| CLY-3-O3 | 6.00% | $K_1$ [pN, 20° C.]: | 14.8 |
| CPY-2-O2 | 7.00% | | |
| CPY-3-O2 | 9.00% | | |
| PY-3-O2 | 8.00% | | |
| PY-4-O2 | 4.00% | | |
| PYP-2-4 | 2.50% | | |
| Y-4O-O4 | 5.50% | | |

Example 24a

The mixture from Example 24 is additionally stabilised with
0.04% of

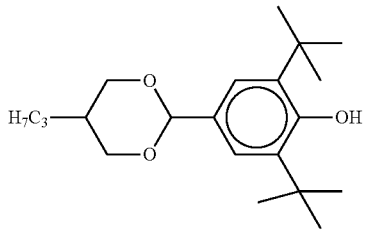

and
0.01% of

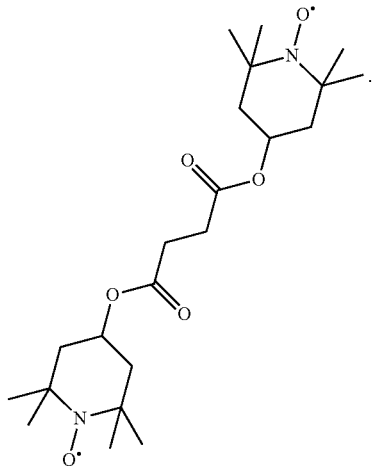

Example 25

| | | | |
|---|---|---|---|
| CC-3-V | 28.00% | Clearing point [° C.]: | 80 |
| CC-3-V1 | 5.00% | Δn [589 nm, 20° C.]: | 0.1082 |
| CCP-3-1 | 2.50% | Δε [1 kHz, 20° C.]: | −4.1 |
| CCY-3-O2 | 10.00% | $\varepsilon_{\parallel}$ [1 kHz, 20° C.]: | 3.8 |
| CCY-4-O2 | 2.50% | $\varepsilon_{\perp}$ [1 kHz, 20° C.]: | 7.9 |
| CLY-3-O2 | 6.50% | $\gamma_1$ [mPa · s, 20° C.]: | 113 |
| CLY-3-O3 | 6.50% | $K_1$ [pN, 20° C.]: | 14.5 |
| CPY-2-O2 | 9.00% | | |
| CPY-3-O2 | 10.00% | | |
| PY-3-O2 | 10.00% | | |
| PY-4-O2 | 5.00% | | |
| Y-4O-O4 | 5.00% | | |

Example 25a

The mixture from Example 25 is additionally stabilised with
0.04% of

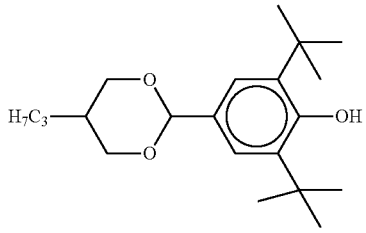

and 0.01% of

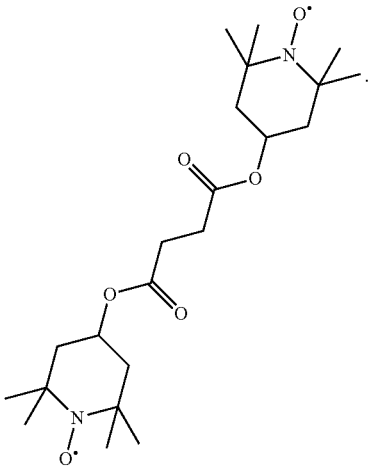

Example 26

| | | | |
|---|---|---|---|
| CC-3-V | 29.00% | Clearing point [° C.]: | 75.1 |
| CC-3-V1 | 5.00% | Δn [589 nm, 20° C.]: | 0.1075 |
| CCP-3-1 | 3.00% | Δε [1 kHz, 20° C.]: | −4.0 |
| CCY-3-O2 | 10.00% | $\varepsilon_{\parallel}$ [1 kHz, 20° C.]: | 3.8 |
| CLY-3-O2 | 6.00% | $\varepsilon_{\perp}$ [1 kHz, 20° C.]: | 7.7 |
| CLY-3-O3 | 6.00% | $\gamma_1$ [mPa · s, 20° C.]: | 103 |
| CPY-2-O2 | 9.00% | $K_1$ [pN, 20° C.]: | 14.3 |
| CPY-3-O2 | 10.00% | | |
| PY-3-O2 | 10.00% | | |
| PY-4-O2 | 7.00% | | |
| Y-4O-O4 | 5.00% | | |

Example 26a

The mixture from Example 26 is additionally stabilised with 0.04% of

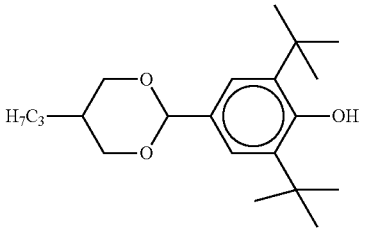

and 0.015% of

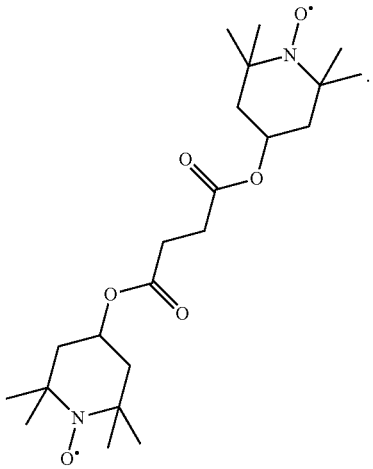

Example 27

| | | | |
|---|---|---|---|
| CC-3-V | 29.00% | Clearing point [° C.]: | 80.1 |
| CCY-3-O1 | 8.00% | Δn [589 nm, 20° C.]: | 0.1052 |
| CCY-3-O2 | 6.00% | Δε [1 kHz, 20° C.]: | −4.7 |
| CCY-4-O2 | 2.00% | $\varepsilon_{\parallel}$ [1 kHz, 20° C.]: | 3.9 |
| CLY-3-O2 | 8.50% | $\varepsilon_{\perp}$ [1 kHz, 20° C.]: | 8.7 |
| CLY-3-O3 | 7.50% | $\gamma_1$ [mPa · s, 20° C.]: | 125 |
| CPY-2-O2 | 10.00% | $K_1$ [pN, 20° C.]: | 14.0 |
| CPY-3-O2 | 7.50% | | |
| CY-3-O2 | 6.50% | | |
| PY-3-O2 | 10.00% | | |
| Y-4O-O4 | 5.00% | | |

Example 27a

The mixture from Example 27 is additionally stabilised with 0.04% of

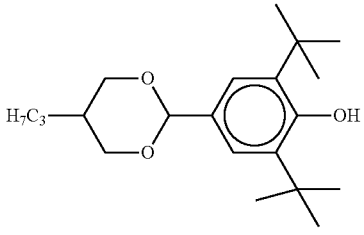

and 0.02% of

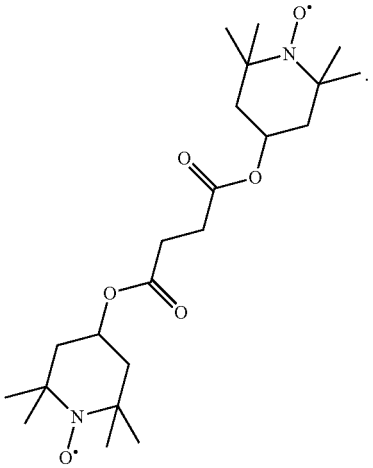

Example 28

| | | | |
|---|---|---|---|
| CC-3-V | 37.00% | Clearing point [° C.]: | 75.2 |
| CCY-3-O1 | 5.00% | Δn [589 nm, 20° C.]: | 0.1012 |
| CCY-3-O2 | 5.00% | Δε [1 kHz, 20° C.]: | −3.8 |
| CCY-4-O2 | 4.00% | $\varepsilon_{\parallel}$ [1 kHz, 20° C.]: | 3.6 |
| CLY-3-O2 | 7.00% | $\varepsilon_{\perp}$ [1 kHz, 20° C.]: | 7.5 |
| CPY-2-O2 | 9.00% | $\gamma_1$ [mPa · s, 20° C.]: | 97 |
| CPY-3-O2 | 10.00% | $K_1$ [pN, 20° C.]: | 13.3 |
| CY-3-O2 | 12.00% | $K_3$ [pN, 20° C.]: | 15.3 |
| PY-3-O2 | 11.00% | $V_0$ [20° C., V]: | 2.12 |

Example 28a

The mixture from Example 28 is additionally stabilised with 0.04% of

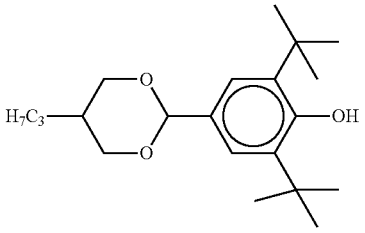

and 0.015% of

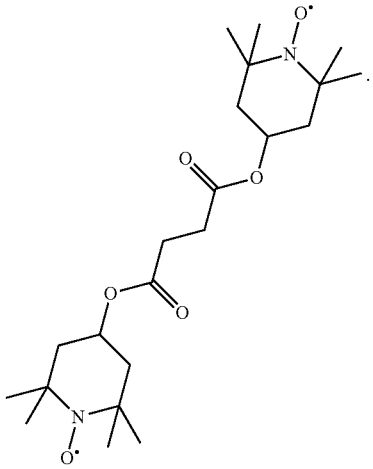

Example 29

| | | | |
|---|---|---|---|
| CY-3-O2 | 15.00% | Clearing point [° C.]: | 80.4 |
| CY-5-O2 | 12.50% | Δn [589 nm, 20° C.]: | 0.1038 |
| CCY-3-O1 | 2.50% | Δε [1 kHz, 20° C.]: | −3.3 |
| CCY-4-O2 | 5.00% | $\varepsilon_{\parallel}$ [1 kHz, 20° C.]: | 3.5 |
| CPY-2-O2 | 8.00% | $\varepsilon_{\perp}$ [1 kHz, 20° C.]: | 6.8 |
| CPY-3-O2 | 8.00% | $\gamma_1$ [mPa · s, 20° C.]: | 137 |
| CCY-2-1 | 6.00% | $K_1$ [pN, 20° C.]: | 14.2 |
| CCY-3-1 | 6.00% | $K_3$ [pN, 20° C.]: | 14.2 |
| CCH-23 | 15.00% | $V_0$ [20° C., V]: | 2.18 |
| CCH-34 | 5.00% | | |
| CCH-301 | 1.50% | | |
| BCH-32 | 15.50% | | |

Example 29a

The mixture from Example 29 is additionally stabilised with 0.01% of

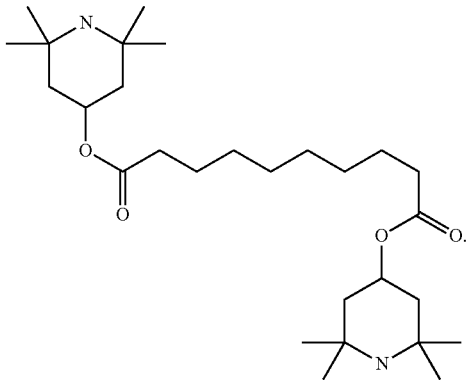

Example 30

| | | | |
|---|---|---|---|
| CY-3-O2 | 15.00% | Clearing point [° C.]: | 100 |
| CY-3-O4 | 20.00% | Δn [589 nm, 20° C.]: | 0.0968 |

-continued

| | | | |
|---|---|---|---|
| CY-5-O2 | 7.50% | Δε [1 kHz, 20° C.]: | −5.9 |
| CCY-3-O2 | 6.50% | $\varepsilon_{\parallel}$ [1 kHz, 20° C.]: | 4.0 |
| CCY-3-O3 | 6.50% | $\varepsilon_{\perp}$ [1 kHz, 20° C.]: | 9.9 |
| CCY-4-O2 | 6.50% | $\gamma_1$ [mPa · s, 20° C.]: | 324 |
| CCY-5-O2 | 6.50% | $K_1$ [pN, 20° C.]: | 15.1 |
| CPY-2-O2 | 5.50% | $K_3$ [pN, 20° C.]: | 17.2 |
| CPY-3-O2 | 5.00% | $V_0$ [20° C., V]: | 1.80 |
| CC-4-V | 3.00% | | |
| CH-33 | 3.00% | | |
| CH-35 | 2.00% | | |
| CH-43 | 3.00% | | |
| CH-45 | 2.00% | | |
| CCPC-33 | 4.00% | | |
| CCPC-34 | 4.00% | | |

Example 31

| | | | |
|---|---|---|---|
| CY-3-O2 | 11.00% | Clearing point [° C.]: | 101 |
| CY-3-O4 | 18.00% | Δn [589 nm, 20° C.]: | 0.1662 |
| CCY-3-O2 | 6.00% | Δε [1 kHz, 20° C.]: | −6.1 |
| CCY-3-O3 | 6.00% | $\varepsilon_{\parallel}$ [1 kHz, 20° C.]: | 4.2 |
| CCY-4-O2 | 6.00% | $\varepsilon_{\perp}$ [1 kHz, 20° C.]: | 10.3 |
| CCY-5-O2 | 6.00% | $\gamma_1$ [mPa · s, 20° C.]: | 363 |
| CPY-3-O2 | 6.00% | $K_1$ [pN, 20° C.]: | 16.5 |
| CC-4-V | 3.00% | $K_3$ [pN, 20° C.]: | 22.00 |
| CPTP-3-1 | 5.00% | $V_0$ [20° C., V]: | 2.00 |
| PTP-302FF | 10.00% | | |
| PTP-502FF | 10.00% | | |
| CPTP-302FF | 5.00% | | |
| CPTP-502FF | 5.00% | | |
| CCPC-33 | 3.00% | | |

Example 32

| | | | |
|---|---|---|---|
| CY-3-O2 | 8.00% | Clearing point [° C.]: | 101 |
| CY-3-O4 | 13.00% | Δn [589 nm, 20° C.]: | 0.0970 |
| CCY-3-O2 | 6.50% | Δε [1 kHz, 20° C.]: | −2.1 |
| CPY-2-O2 | 3.50% | $\varepsilon_{\parallel}$ [1 kHz, 20° C.]: | 3.2 |
| CPY-3-O2 | 8.00% | $\varepsilon_{\perp}$ [1 kHz, 20° C.]: | 5.3 |
| CCH-301 | 5.00% | $\gamma_1$ [mPa · s, 20° C.]: | 136 |
| CC-4-V | 12.00% | $K_1$ [pN, 20° C.]: | 14.8 |
| CC-5-V | 8.00% | $K_3$ [pN, 20° C.]: | 18.3 |
| CCP-V-1 | 13.00% | $V_0$ [20° C., V]: | 3.11 |
| CCP-V2-1 | 13.00% | | |
| BCH-32 | 5.00% | | |
| CCPC-33 | 5.00% | | |

Example 33

| | | | |
|---|---|---|---|
| CY-3-O4 | 12.00% | Clearing point [° C.]: | 101 |
| CC-4-V | 13.00% | Δn [589 nm, 20° C.]: | 0.1660 |
| CC-5-V | 9.50% | Δε [1 kHz, 20° C.]: | −2.1 |
| CCP-V-1 | 10.50% | $\varepsilon_{\parallel}$ [1 kHz, 20° C.]: | 3.4 |
| CCP-V2-1 | 10.00% | $\varepsilon_{\perp}$ [1 kHz, 20° C.]: | 5.5 |
| PTP-102 | 3.00% | $\gamma_1$ [mPa · s, 20° C.]: | 151 |
| CPTP-3-1 | 5.00% | $K_1$ [pN, 20° C.]: | 16.2 |
| CPTP-3-2 | 5.00% | $K_3$ [pN, 20° C.]: | 19.8 |
| PTP-302FF | 9.50% | $V_0$ [20° C., V]: | 3.25 |
| PTP-502FF | 9.50% | | |
| CPTP-302FF | 6.50% | | |
| CPTP-502FF | 6.50% | | |

Example 34

| | | | |
|---|---|---|---|
| CY-3-O2 | 15.00% | Clearing point [° C.]: | 71.9 |
| CCY-3-O1 | 6.00% | Δn [589 nm, 20° C.]: | 0.1203 |
| CCY-3-O2 | 8.00% | Δε [1 kHz, 20° C.]: | −8.1 |
| CCY-3-O3 | 5.50% | $\varepsilon_{\parallel}$ [1 kHz, 20° C.]: | 5.2 |
| CCY-4-O2 | 8.00% | $\varepsilon_{\perp}$ [1 kHz, 20° C.]: | 13.3 |
| CCY-5-O2 | 8.00% | $\gamma_1$ [mPa · s, 20° C.]: | 253 |
| CPY-2-O2 | 1.50% | $K_1$ [pN, 20° C.]: | 13.2 |
| CPY-3-O2 | 10.00% | $K_3$ [pN, 20° C.]: | 15.7 |
| CLY-3-O2 | 8.00% | $V_0$ [20° C., V]: | 1.46 |
| PY-3-O2 | 6.00% | | |
| PY-1-O4 | 8.00% | | |
| PY-4-O2 | 8.00% | | |
| Y-4O-O4 | 8.00% | | |

Example 35

| | | | |
|---|---|---|---|
| CC-3-V1 | 8.00% | Clearing point [° C.]: | 75.5 |
| CCH-23 | 18.00% | Δn [589 nm, 20° C.]: | 0.0978 |
| CCH-34 | 4.00% | Δε [1 kHz, 20° C.]: | −3.5 |
| CCH-35 | 7.00% | $\varepsilon_{\parallel}$ [1 kHz, 20° C.]: | 3.5 |
| CCP-3-1 | 5.00% | $\varepsilon_{\perp}$ [1 kHz, 20° C.]: | 6.9 |
| CCY-3-O2 | 12.50% | $\gamma_1$ [mPa · s, 20° C.]: | 111 |
| CPY-2-O2 | 8.00% | $K_1$ [pN, 20° C.]: | 14.9 |
| CPY-3-O2 | 11.00% | $K_3$ [pN, 20° C.]: | 15.8 |
| CY-3-O2 | 15.50% | $V_0$ [20° C., V]: | 2.26 |
| PY-3-O2 | 11.00% | | |

Example 35a

The mixture from Example 35 is additionally mixed with 0.3% of RM-1

RM-1

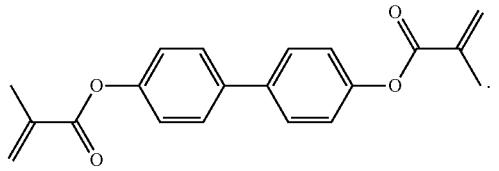

Example 36

| | | | |
|---|---|---|---|
| BCH-32 | 1.50% | Clearing point [° C.]: | 74.8 |
| CC-3-V | 15.50% | Δn [589 nm, 20° C.]: | 0.1035 |
| CC-3-V1 | 11.00% | Δε [1 kHz, 20° C.]: | −3.1 |
| CCH-23 | 12.00% | $\varepsilon_{\parallel}$ [1 kHz, 20° C.]: | 3.4 |
| CCH-34 | 3.50% | $\varepsilon_{\perp}$ [1 kHz, 20° C.]: | 6.5 |
| CCY-3-O2 | 11.50% | $\gamma_1$ [mPa · s, 20° C.]: | 95 |
| CCY-5-O2 | 0.50% | $K_1$ [pN, 20° C.]: | 14.1 |
| CPY-2-O2 | 8.50% | $K_3$ [pN, 20° C.]: | 15.4 |
| CPY-3-O2 | 12.00% | $V_0$ [20° C., V]: | 2.36 |
| CY-3-O2 | 9.50% | | |
| PY-3-O2 | 11.50% | | |
| PYP-2-3 | 3.00% | | |

Example 36a

The mixture from Example 36 is additionally mixed with 0.001% of Irganox® 1076 (octadecyl 3-(3,5-di-tert-butyl-4-hydroxyphenyl)propionate, BASF) and 0.3% of RM-1.

Example 37

| | | | |
|---|---|---|---|
| CC-3-V | 30.50% | Clearing point [° C.]: | 79.8 |
| CC-3-V1 | 4.50% | Δn [589 nm, 20° C.]: | 0.1022 |
| CCY-3-O1 | 5.00% | Δε [1 kHz, 20° C.]: | −4.0 |
| CCY-3-O2 | 6.00% | $\epsilon_{\parallel}$ [1 kHz, 20° C.]: | 3.6 |
| CCY-3-O3 | 4.00% | $\epsilon_{\perp}$ [1 kHz, 20° C.]: | 7.6 |
| CLY-3-O2 | 8.00% | $\gamma_1$ [mPa · s, 20° C.]: | 114 |
| CPY-2-O2 | 8.00% | $K_1$ [pN, 20° C.]: | 14.5 |
| CPY-3-O2 | 11.00% | $K_3$ [pN, 20° C.]: | 16.7 |
| CY-3-O2 | 15.00% | $V_0$ [20° C., V]: | 2.14 |
| PY-3-O2 | 8.00% | | |

Example 38

| | | | |
|---|---|---|---|
| CY-3-O2 | 15.00% | Clearing point [° C.]: | 80.4 |
| CY-5-O2 | 12.50% | Δn [589 nm, 20° C.]: | 0.1038 |
| CCY-3-O1 | 2.50% | Δε [1 kHz, 20° C.]: | −3.3 |
| CCY-4-O2 | 5.00% | $\epsilon_{\parallel}$ [1 kHz, 20° C.]: | 3.5 |
| CPY-2-O2 | 8.00% | $\epsilon_{\perp}$ [1 kHz, 20° C.]: | 6.8 |
| CPY-3-O2 | 8.00% | $\gamma_1$ [mPa · s, 20° C.]: | 137 |
| CCY-2-1 | 6.00% | $K_1$ [pN, 20° C.]: | 14.2 |
| CCY-3-1 | 6.00% | $K_3$ [pN, 20° C.]: | 14.2 |
| CCH-23 | 15.00% | $V_0$ [20° C., V]: | 2.18 |
| CCH-34 | 5.00% | | |
| CCH-301 | 1.50% | | |
| BCH-32 | 15.50% | | |

Example 39

| | | | |
|---|---|---|---|
| CY-3-O2 | 15.00% | Clearing point [° C.]: | 80.5 |
| CY-3-O4 | 4.00% | Δn [589 nm, 20° C.]: | 0.1025 |
| CY-5-O2 | 6.50% | Δε [1 kHz, 20° C.]: | −3.4 |
| CCY-3-O1 | 5.00% | $\epsilon_{\parallel}$ [1 kHz, 20° C.]: | 3.5 |
| CCY-3-O3 | 2.00% | $\epsilon_{\perp}$ [1 kHz, 20° C.]: | 6.9 |
| CCY-4-O2 | 6.00% | $\gamma_1$ [mPa · s, 20° C.]: | 141 |
| CPY-2-O2 | 7.00% | $K_1$ [pN, 20° C.]: | 14.0 |
| CPY-3-O2 | 7.00% | $K_3$ [pN, 20° C.]: | 14.1 |
| CCY-2-1 | 6.00% | $V_0$ [20° C., V]: | 2.16 |
| CCY-3-1 | 6.00% | | |
| CCH-23 | 15.50% | | |
| CCH-34 | 5.00% | | |
| BCH-32 | 13.00% | | |
| PP-1-4 | 2.00% | | |

Example 40

| | | | |
|---|---|---|---|
| PGUQU-3-F | 4.00% | Clearing point [° C.]: | 85.4 |
| CCQU-3-F | 7.50% | Δn [589 nm, 20° C.]: | 0.1028 |
| PUQU-3-F | 15.50% | Δε [1 kHz, 20° C.]: | 9.9 |
| APUQU-2-F | 4.00% | $\epsilon_{\parallel}$ [1 kHz, 20° C.]: | 13.3 |
| APUQU-3-F | 7.50% | $\epsilon_{\perp}$ [1 kHz, 20° C.]: | 3.4 |
| CC-3-V | 27.50% | $\gamma_1$ [mPa · s, 20° C.]: | 82 |
| CCP-3-V1 | 6.00% | $K_1$ [pN, 20° C.]: | 12.6 |
| CCP-V-1 | 13.00% | $K_3$ [pN, 20° C.]: | 15.3 |
| CCP-V2-1 | 10.00% | $V_0$ [20° C., V]: | 1.19 |
| PPGU-3-F | 0.50% | | |
| BCH-3F.F | 4.50% | | |

Example 40a

The mixture from Example 40 is additionally stabilised with 0.01% of

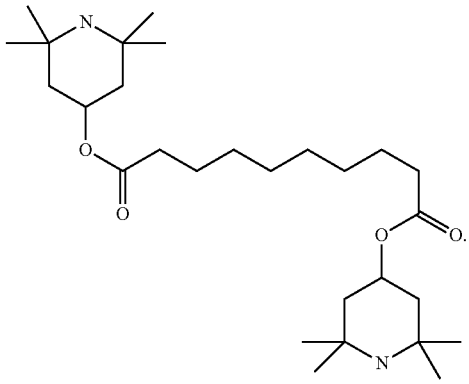

Example 41

| | | | |
|---|---|---|---|
| CC-3-V | 30.50% | Clearing point [° C.]: | 80.1 |
| CC-3-V1 | 4.50% | Δn [589 nm, 20° C.]: | 0.1033 |
| CCY-3-O1 | 6.00% | Δε [1 kHz, 20° C.]: | −4.0 |
| CCY-3-O2 | 8.00% | $\epsilon_{\parallel}$ [1 kHz, 20° C.]: | 3.6 |
| CLY-3-O2 | 8.00% | $\epsilon_{\perp}$ [1 kHz, 20° C.]: | 7.6 |
| CPY-2-O2 | 8.00% | $\gamma_1$ [mPa · s, 20° C.]: | 113 |
| CPY-3-O2 | 12.00% | $K_1$ [pN, 20° C.]: | 14.4 |
| CY-3-O2 | 15.00% | $K_3$ [pN, 20° C.]: | 17.0 |
| PY-3-O2 | 8.00% | $V_0$ [20° C., V]: | 2.16 |

Example 41a

The mixture from Example 41 is additionally stabilised with 0.3% of

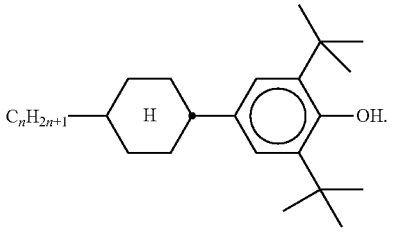

Example 42

| | | | |
|---|---|---|---|
| CC-3-V | 28.50% | Clearing point [° C.]: | 74.6 |
| CC-3-V1 | 7.00% | Δn [589 nm, 20° C.]: | 0.1040 |
| CCY-3-O2 | 12.50% | Δε [1 kHz, 20° C.]: | −3.0 |
| CCY-4-O2 | 5.25% | $\epsilon_{\parallel}$ [1 kHz, 20° C.]: | 3.5 |
| CPY-3-O2 | 9.75% | $\epsilon_{\perp}$ [1 kHz, 20° C.]: | 6.5 |
| CY-3-O2 | 15.00% | $\gamma_1$ [mPa · s, 20° C.]: | 98 |
| CY-3-O4 | 4.75% | $K_1$ [pN, 20° C.]: | 13.2 |
| CY-5-O2 | 1.00% | $K_3$ [pN, 20° C.]: | 15.5 |
| PCH-301 | 3.25% | $V_0$ [20° C., V]: | 2.4 |
| PPGU-3-F | 0.50% | | |
| PYP-2-3 | 12.50% | | |

Example 42a

The mixture from Example 42 is additionally mixed with 0.001% of Irganox® 1076 (octadecyl 3-(3,5-di-tert-butyl-4-hydroxyphenyl)propionate, BASF) and 0.45% of RM-1.

Example 43

| | | | |
|---|---|---|---|
| CC-3-V | 36.50% | Clearing point [° C.]: | 75 |
| CC-3-V1 | 2.00% | Δn [589 nm, 20° C.]: | 0.1015 |
| CCY-3-O1 | 8.00% | Δε [1 kHz, 20° C.]: | −3.7 |
| CCY-3-O2 | 6.00% | $\epsilon_{\parallel}$ [1 kHz, 20° C.]: | 3.7 |
| CCY-4-O2 | 2.50% | $\epsilon_{\perp}$ [1 kHz, 20° C.]: | 7.3 |
| CLY-3-O2 | 8.00% | $\gamma_1$ [mPa · s, 20° C.]: | 97 |
| CLY-3-O3 | 2.00% | $K_1$ [pN, 20° C.]: | 13.8 |
| CPY-2-O2 | 10.00% | $K_3$ [pN, 20° C.]: | 15 |
| CPY-3-O2 | 3.00% | $V_0$ [20° C., V]: | 2.14 |
| CY-3-O2 | 5.50% | | |
| PY-3-O2 | 13.00% | | |
| PY-1-O4 | 3.50% | | |

Example 44

| | | | |
|---|---|---|---|
| BCH-32 | 4.50% | Clearing point [° C.]: | 75.5 |
| CCH-23 | 14.00% | Δn [589 nm, 20° C.]: | 0.0938 |
| CCH-301 | 7.00% | Δε [1 kHz, 20° C.]: | −2.5 |
| CCH-34 | 9.00% | $\epsilon_{\parallel}$ [1 kHz, 20° C.]: | 3.3 |
| CCH-35 | 5.50% | $\epsilon_{\perp}$ [1 kHz, 20° C.]: | 5.8 |
| CCP-3-1 | 10.00% | $\gamma_1$ [mPa · s, 20° C.]: | 89 |
| CY-3-O2 | 5.00% | $K_1$ [pN, 20° C.]: | 13.5 |
| CY-V-O2 | 7.00% | $K_3$ [pN, 20° C.]: | 14.5 |
| CCY-3-O1 | 5.00% | $V_0$ [20° C., V]: | 2.54 |
| CCY-3-O2 | 9.00% | | |
| CPY-V-O2 | 10.00% | | |
| PCH-302 | 5.00% | | |
| PY-V2-O2 | 9.00% | | |

Example 45

| | | | |
|---|---|---|---|
| BCH-32 | 1.50% | Clearing point [° C.]: | 75 |
| CC-3-V | 37.00% | Δn [589 nm, 20° C.]: | 0.0960 |
| CCP-3-1 | 8.00% | Δε [1 kHz, 20° C.]: | −2.6 |
| CY-3-O2 | 15.00% | $\epsilon_{\parallel}$ [1 kHz, 20° C.]: | 3.4 |
| CCY-3-O1 | 7.00% | $\epsilon_{\perp}$ [1 kHz, 20° C.]: | 6.0 |
| CCY-3-O2 | 9.50% | $\gamma_1$ [mPa · s, 20° C.]: | 79 |
| CPY-3-O2 | 8.50% | $K_1$ [pN, 20° C.]: | 13.0 |
| PCH-302 | 5.50% | $K_3$ [pN, 20° C.]: | 16.0 |
| PY-V-O2 | 8.00% | $V_0$ [20° C., V]: | 2.6 |

Example 46

| | | | |
|---|---|---|---|
| BCH-32 | 1.00% | Clearing point [° C.]: | 75 |
| CC-3-V | 41.00% | Δn [589 nm, 20° C.]: | 0.0948 |
| CCP-3-1 | 8.50% | Δε [1 kHz, 20° C.]: | −2.3 |
| CY-3-O2 | 13.00% | $\epsilon_{\parallel}$ [1 kHz, 20° C.]: | 3.2 |
| CCY-3-O1 | 6.50% | $\epsilon_{\perp}$ [1 kHz, 20° C.]: | 5.5 |
| CCY-3-O2 | 8.50% | $\gamma_1$ [mPa · s, 20° C.]: | 70 |
| CPY-3-O2 | 6.00% | $K_1$ [pN, 20° C.]: | 13.4 |
| PCH-302 | 7.00% | $K_3$ [pN, 20° C.]: | 16.5 |
| PY-1V-O2 | 8.50% | $V_0$ [20° C., V]: | 2.84 |

Example 47

| | | | |
|---|---|---|---|
| PY-3-O2 | 7.50% | Clearing point [° C.]: | 74 |
| PY-1V-O2 | 4.00% | Δn [589 nm, 20° C.]: | 0.1094 |
| CY-3-O2 | 14.50% | Δε [1 kHz, 20° C.]: | −3.0 |
| CCY-3-O1 | 3.00% | $\epsilon_{\parallel}$ [1 kHz, 20° C.]: | 3.6 |
| CCY-3-O2 | 9.00% | $\epsilon_{\perp}$ [1 kHz, 20° C.]: | 6.6 |
| CPY-2-O2 | 7.50% | $\gamma_1$ [mPa · s, 20° C.]: | 85 |
| CPY-3-O2 | 9.00% | $K_1$ [pN, 20° C.]: | 12.9 |
| CC-3-V | 37.00% | $K_3$ [pN, 20° C.]: | 14.6 |
| BCH-32 | 8.00% | $V_0$ [20° C., V]: | 2.34 |
| PPGU-3-F | 0.50% | | |

Example 48

| | | | |
|---|---|---|---|
| PY-3-O2 | 8.00% | Clearing point [° C.]: | 74.5 |
| PY-3V-O2 | 5.00% | Δn [589 nm, 20° C.]: | 0.1086 |
| CY-3-O2 | 11.50% | Δε [1 kHz, 20° C.]: | −3.0 |
| CCY-3-O1 | 10.00% | $\epsilon_{\parallel}$ [1 kHz, 20° C.]: | 3.6 |
| CCY-3-O2 | 4.00% | $\epsilon_{\perp}$ [1 kHz, 20° C.]: | 6.6 |
| CPY-2-O2 | 10.00% | $\gamma_1$ [mPa · s, 20° C.]: | 87 |
| CPY-3-O2 | 7.00% | $K_1$ [pN, 20° C.]: | 12.9 |
| CC-3-V | 37.50% | $K_3$ [pN, 20° C.]: | 14.1 |
| BCH-32 | 6.50% | $V_0$ [20° C., V]: | 2.30 |
| PPGU-3-F | 0.50% | | |

Example 49

| | | | |
|---|---|---|---|
| PY-V2-O2 | 12.00% | Clearing point [° C.]: | 76 |
| CY-V-O2 | 9.00% | Δn [589 nm, 20° C.]: | 0.1087 |
| CCY-3-O1 | 9.00% | Δε [1 kHz, 20° C.]: | −3.1 |
| CCY-V2-O2 | 8.00% | $\varepsilon_{\parallel}$ [1 kHz, 20° C.]: | 3.7 |
| CPY-2-O2 | 8.00% | $\varepsilon_{\perp}$ [1 kHz, 20° C.]: | 6.9 |
| CPY-V-O2 | 10.50% | $\gamma_1$ [mPa · s, 20° C.]: | 83 |
| CC-3-V | 36.50% | $K_1$ [pN, 20° C.]: | 12.4 |
| BCH-32 | 6.50% | $K_3$ [pN, 20° C.]: | 14.7 |
| PPGU-3-F | 0.50% | $V_0$ [20° C., V]: | 2.28 |

Example 50

| | | | |
|---|---|---|---|
| PY-V2-O2 | 11.50% | Clearing point [° C.]: | 75.5 |
| CY-3-O2 | 11.00% | Δn [589 nm, 20° C.]: | 0.1074 |
| CCY-3-O1 | 9.00% | Δε [1 kHz, 20° C.]: | −3.1 |
| CCY-3-O2 | 4.00% | $\varepsilon_{\parallel}$ [1 kHz, 20° C.]: | 3.7 |
| CPY-2-O2 | 12.00% | $\varepsilon_{\perp}$ [1 kHz, 20° C.]: | 6.8 |
| CPY-3-O2 | 9.00% | $\gamma_1$ [mPa · s, 20° C.]: | 87 |
| CC-3-V | 37.00% | $K_1$ [pN, 20° C.]: | 13.0 |
| BCH-32 | 6.00% | $K_3$ [pN, 20° C.]: | 14.7 |
| PPGU-3-F | 0.50% | $V_0$ [20° C., V]: | 2.29 |

Example 51

| | | | |
|---|---|---|---|
| PY-1V-O2 | 10.50% | Clearing point [° C.]: | 72 |
| CY-3-O2 | 18.00% | Δn [589 nm, 20° C.]: | 0.1068 |
| CCY-3-O1 | 7.00% | Δε [1 kHz, 20° C.]: | −3.1 |
| CCY-3-O2 | 5.00% | $\varepsilon_{\parallel}$ [1 kHz, 20° C.]: | 3.6 |
| CPY-2-O2 | 7.00% | $\varepsilon_{\perp}$ [1 kHz, 20° C.]: | 6.7 |

-continued

| | | | |
|---|---|---|---|
| CPY-3-O2 | 8.00% | $\gamma_1$ [mPa · s, 20° C.]: | 78 |
| CC-3-V | 41.00% | $K_1$ [pN, 20° C.]: | 12.6 |
| BCH-32 | 3.00% | $K_3$ [pN, 20° C.]: | 14.6 |
| PPGU-3-F | 0.50% | $V_0$ [20° C., V]: | 2.30 |

Example 52

| | | | |
|---|---|---|---|
| PY-V2-O2 | 10.50% | Clearing point [° C.]: | 75 |
| CY-3-O2 | 10.00% | Δn [589 nm, 20° C.]: | 0.1070 |
| CCY-3-O1 | 6.00% | Δε [1 kHz, 20° C.]: | −3.3 |
| CCY-3-O2 | 9.00% | $\varepsilon_{\parallel}$ [1 kHz, 20° C.]: | 3.7 |
| CPY-2-O2 | 8.00% | $\varepsilon_{\perp}$ [1 kHz, 20° C.]: | 7.0 |
| CPY-3-O2 | 12.00% | $\gamma_1$ [mPa · s, 20° C.]: | 90 |
| CC-3-V | 35.00% | $K_1$ [pN, 20° C.]: | 12.7 |
| BCH-32 | 6.50% | $K_3$ [pN, 20° C.]: | 14.5 |
| PPGU-3-F | 0.50% | $V_0$ [20° C., V]: | 2.23 |
| Y-4O-O4 | 2.50% | LTS (bulk) [−20° C.]: | >1000 h |
| | | LTS (bulk) [−30° C.]: | >1000 h |

Example 53

| | | | |
|---|---|---|---|
| PY-1V-O2 | 10.00% | Clearing point [° C.]: | 73.5 |
| CY-3-O2 | 18.00% | Δn [589 nm, 20° C.]: | 0.1084 |
| CCY-3-O1 | 6.00% | Δε [1 kHz, 20° C.]: | −3.2 |
| CCY-3-O2 | 6.00% | $\varepsilon_{\parallel}$ [1 kHz, 20° C.]: | 3.6 |
| CPY-2-O2 | 7.00% | $\varepsilon_{\perp}$ [1 kHz, 20° C.]: | 6.8 |
| CPY-3-O2 | 9.00% | $\gamma_1$ [mPa · s, 20° C.]: | 82 |
| CC-3-V | 40.00% | $K_1$ [pN, 20° C.]: | 12.8 |
| BCH-32 | 3.50% | $K_3$ [pN, 20° C.]: | 14.9 |
| PPGU-3-F | 0.50% | $V_0$ [20° C., V]: | 2.3 |

Example 54

| | | | |
|---|---|---|---|
| PY-V2-O2 | 11.50% | Clearing point [° C.]: | 74.5 |
| CY-3-O2 | 10.00% | Δn [589 nm, 20° C.]: | 0.1071 |
| CCY-3-O1 | 4.50% | Δε [1 kHz, 20° C.]: | −3.4 |
| CCY-3-O2 | 11.00% | $\varepsilon_{\parallel}$ [1 kHz, 20° C.]: | 3.8 |
| CPY-2-O2 | 7.00% | $\varepsilon_{\perp}$ [1 kHz, 20° C.]: | 7.1 |
| CPY-3-O2 | 12.50% | $\gamma_1$ [mPa · s, 20° C.]: | 91 |
| CC-3-V | 34.50% | $K_1$ [pN, 20° C.]: | 12.7 |
| BCH-32 | 6.00% | $K_3$ [pN, 20° C.]: | 14.6 |
| PPGU-3-F | 0.50% | $V_0$ [20° C., V]: | 2.2 |
| Y-4O-O4 | 2.50% | | |

Example 55

| | | | |
|---|---|---|---|
| PY-V2-O2 | 14.00% | Clearing point [° C.]: | 74.5 |
| CY-3-O2 | 10.50% | Δn [589 nm, 20° C.]: | 0.1075 |
| CCY-3-O1 | 5.00% | Δε [1 kHz, 20° C.]: | −3.2 |
| CCY-3-O2 | 10.00% | $\varepsilon_{\parallel}$ [1 kHz, 20° C.]: | 3.6 |
| CPY-2-O2 | 9.00% | $\varepsilon_{\perp}$ [1 kHz, 20° C.]: | 6.8 |
| CPY-3-O2 | 12.00% | $\gamma_1$ [mPa · s, 20° C.]: | 90 |
| CC-3-V | 36.50% | $K_1$ [pN, 20° C.]: | 11.7 |
| BCH-32 | 2.50% | $K_3$ [pN, 20° C.]: | 14.1 |
| PPGU-3-F | 0.50% | $V_0$ [20° C., V]: | 2.21 |

Example 56

| | | | |
|---|---|---|---|
| PY-3V-O2 | 10.50% | Clearing point [° C.]: | 74.5 |
| CY-3-O2 | 15.00% | Δn [589 nm, 20° C.]: | 0.1073 |
| CCY-3-O1 | 7.50% | Δε [1 kHz, 20° C.]: | −3.0 |
| CCY-3-O2 | 4.00% | $\varepsilon_{\parallel}$ [1 kHz, 20° C.]: | 3.6 |
| CPY-2-O2 | 11.00% | $\varepsilon_{\perp}$ [1 kHz, 20° C.]: | 6.6 |
| CPY-3-O2 | 8.00% | $\gamma_1$ [mPa · s, 20° C.]: | 84 |
| CC-3-V | 40.50% | $K_1$ [pN, 20° C.]: | 12.8 |
| BCH-32 | 3.00% | $K_3$ [pN, 20° C.]: | 14.1 |
| PPGU-3-F | 0.50% | $V_0$ [20° C., V]: | 2.29 |

Example 57

| | | | |
|---|---|---|---|
| CC-3-V | 36.50% | Clearing point [° C.]: | 73 |
| CY-3-O2 | 10.00% | Δn [589 nm, 20° C.]: | 0.1081 |
| CCY-3-O1 | 6.50% | Δε [1 kHz, 20° C.]: | −3.3 |
| CCY-3-O2 | 11.00% | $\varepsilon_{\parallel}$ [1 kHz, 20° C.]: | 3.5 |
| CCY-4-O2 | 6.00% | $\varepsilon_{\perp}$ [1 kHz, 20° C.]: | 6.8 |
| CPY-3-O2 | 8.50% | $\gamma_1$ [mPa · s, 20° C.]: | 90 |
| PY-3-O2 | 4.00% | $K_1$ [pN, 20° C.]: | 13.2 |
| PY-3V-O2 | 6.50% | $K_3$ [pN, 20° C.]: | 15.0 |
| PY-1-O4 | 4.50% | $V_0$ [20° C., V]: | 2.25 |
| PYP-2-3 | 3.00% | | |
| PP-1-2V1 | 3.50% | | |

Example 58

| | | | |
|---|---|---|---|
| PY-V2-O2 | 7.00% | Clearing point [° C.]: | 75.5 |
| CY-3-O2 | 10.00% | Δn [589 nm, 20° C.]: | 0.1086 |
| CY-1V2-O2 | 6.00% | Δε [1 kHz, 20° C.]: | −2.7 |
| CCY-3-O1 | 5.00% | $\varepsilon_{\parallel}$ [1 kHz, 20° C.]: | 3.5 |
| CCY-3-O2 | 2.00% | $\varepsilon_{\perp}$ [1 kHz, 20° C.]: | 6.2 |
| CPY-2-O2 | 12.00% | $\gamma_1$ [mPa · s, 20° C.]: | 85 |
| CPY-3-O2 | 10.00% | $K_1$ [pN, 20° C.]: | 12.8 |
| CC-3-V | 37.00% | $K_3$ [pN, 20° C.]: | 14.5 |
| BCH-32 | 10.50% | $V_0$ [20° C., V]: | 2.45 |
| PPGU-3-F | 0.50% | LTS (bulk) [−20° C.]: | >1000 h |

Example 59

| | | | |
|---|---|---|---|
| PY-V-O2 | 5.00% | Clearing point [° C.]: | 75 |
| PY-V2-O2 | 5.00% | Δn [589 nm, 20° C.]: | 0.1087 |
| PY-3-O2 | 3.00% | Δε [1 kHz, 20° C.]: | −3.1 |
| CY-V-O2 | 4.00% | $\varepsilon_{\parallel}$ [1 kHz, 20° C.]: | 3.7 |
| CY-3-O2 | 3.00% | $\varepsilon_{\perp}$ [1 kHz, 20° C.]: | 6.8 |
| CCY-3-O1 | 3.50% | $\gamma_1$ [mPa · s, 20° C.]: | 83 |
| CCY-3-O2 | 7.00% | $K_1$ [pN, 20° C.]: | 12.6 |
| CCY-4-O2 | 5.00% | $K_3$ [pN, 20° C.]: | 14.2 |
| CPY-2-O2 | 8.00% | $V_0$ [20° C., V]: | 2.28 |
| CPY-3-O2 | 10.00% | LTS (bulk) [−20° C.]: | >1000 h |
| CC-3-V | 38.00% | | |
| BCH-32 | 6.00% | | |
| PPGU-3-F | 0.50% | | |
| Y-4O-O4 | 2.00% | | |

Example 60

| | | | |
|---|---|---|---|
| PY-V2-O2 | 5.50% | Clearing point [° C.]: | 75.5 |
| PY-3-O2 | 8.00% | Δn [589 nm, 20° C.]: | 0.1075 |

-continued

| | | | |
|---|---|---|---|
| CY-V-O2 | 6.00% | Δε [1 kHz, 20° C.]: | −3.1 |
| CCY-3-O1 | 5.50% | $\varepsilon_{\parallel}$ [1 kHz, 20° C.]: | 3.7 |
| CCY-3-O2 | 5.00% | $\varepsilon_{\perp}$ [1 kHz, 20° C.]: | 6.8 |
| CCY-4-O2 | 4.00% | $\gamma_1$ [mPa · s, 20° C.]: | 88 |
| CPY-2-O2 | 8.00% | $K_1$ [pN, 20° C.]: | 12.6 |
| CPY-3-O2 | 9.00% | $K_3$ [pN, 20° C.]: | 14.0 |
| CC-3-V | 35.00% | $V_0$ [20° C., V]: | 2.26 |
| BCH-32 | 8.00% | LTS (bulk) [−20° C.]: | >1000 h |
| PPGU-3-F | 0.50% | LTS (bulk) [−30° C.]: | >1000 h |
| Y-4O-O4 | 2.00% | | |

Example 61

| | | | |
|---|---|---|---|
| PY-V-O2 | 5.50% | Clearing point [° C.]: | 74.5 |
| PY-3-O2 | 4.50% | Δn [589 nm, 20° C.]: | 0.1098 |
| CY-3-O2 | 11.00% | Δε [1 kHz, 20° C.]: | −3.0 |
| CCY-3-O2 | 10.50% | $\varepsilon_{\parallel}$ [1 kHz, 20° C.]: | 3.7 |
| CPY-2-O2 | 10.00% | $\varepsilon_{\perp}$ [1 kHz, 20° C.]: | 6.7 |
| CPY-3-O2 | 11.00% | $\gamma_1$ [mPa · s, 20° C.]: | 85 |
| CC-3-V | 37.00% | $K_1$ [pN, 20° C.]: | 12.9 |
| BCH-32 | 8.00% | $K_3$ [pN, 20° C.]: | 14.5 |
| PPGU-3-F | 0.50% | $V_0$ [20° C., V]: | 2.31 |
| Y-4O-O4 | 2.00% | LTS (bulk) [−20° C.]: | >1000 h |
| | | LTS (bulk) [−30° C.]: | >1000 h |

Example 62

| | | | |
|---|---|---|---|
| PY-3-O2 | 6.00% | Clearing point [° C.]: | 75 |
| PY-V2-O2 | 6.00% | Δn [589 nm, 20° C.]: | 0.1079 |
| CY-3-O2 | 12.00% | Δε [1 kHz, 20° C.]: | −3.2 |
| CCY-3-O1 | 4.00% | $\varepsilon_{\parallel}$ [1 kHz, 20° C.]: | 3.7 |
| CCY-3-O2 | 9.50% | $\varepsilon_{\perp}$ [1 kHz, 20° C.]: | 6.9 |
| CPY-2-O2 | 9.50% | $\gamma_1$ [mPa · s, 20° C.]: | 91 |
| CPY-3-O2 | 10.00% | $K_1$ [pN, 20° C.]: | 13.1 |
| CC-3-V | 35.50% | $K_3$ [pN, 20° C.]: | 14.9 |
| BCH-32 | 7.00% | $V_0$ [20° C., V]: | 2.29 |
| PPGU-3-F | 0.50% | LTS (bulk) [−20° C.]: | >1000 h |
| | | LTS (bulk) [−30° C.]: | >1000 h |

Example 63

| | | | |
|---|---|---|---|
| PY-3-O2 | 6.00% | Clearing point [° C.]: | 75 |
| PY-1V2-O2 | 6.50% | Δn [589 nm, 20° C.]: | 0.1088 |
| CY-3-O2 | 13.00% | Δε [1 kHz, 20° C.]: | −3.3 |
| CCY-3-O2 | 12.00% | $\varepsilon_{\parallel}$ [1 kHz, 20° C.]: | 3.7 |
| CPY-2-O2 | 8.00% | $\varepsilon_{\perp}$ [1 kHz, 20° C.]: | 6.9 |
| CPY-3-O2 | 12.00% | $\gamma_1$ [mPa · s, 20° C.]: | 93 |
| CC-3-V | 36.00% | $K_1$ [pN, 20° C.]: | 13.5 |
| BCH-32 | 6.00% | $K_3$ [pN, 20° C.]: | 15.6 |
| PPGU-3-F | 0.50% | $V_0$ [20° C., V]: | 2.32 |

Example 64

| | | | |
|---|---|---|---|
| PY-3-O2 | 4.50% | Clearing point [° C.]: | 75 |
| PY-V2-O2 | 6.00% | Δn [589 nm, 20° C.]: | 0.1078 |
| CY-3-O2 | 10.00% | Δε [1 kHz, 20° C.]: | −3.1 |
| CCY-3-O1 | 2.00% | $\varepsilon_{\parallel}$ [1 kHz, 20° C.]: | 3.7 |
| CCY-3-O2 | 11.00% | $\varepsilon_{\perp}$ [1 kHz, 20° C.]: | 6.8 |
| CPY-2-O2 | 8.00% | $\gamma_1$ [mPa · s, 20° C.]: | 88 |
| CPY-3-O2 | 12.00% | $K_1$ [pN, 20° C.]: | 13.0 |

-continued

| | | | |
|---|---|---|---|
| CC-3-V | 36.00% | $K_3$ [pN, 20° C.]: | 14.8 |
| BCH-32 | 8.00% | $V_0$ [20° C., V]: | 2.31 |
| PPGU-3-F | 0.50% | LTS (bulk) [−30° C.] | >1000 h |
| Y-4O-O4 | 2.00% | | |

Example 64a

The mixture from Example 64 is additionally stabilised with 0.01% of

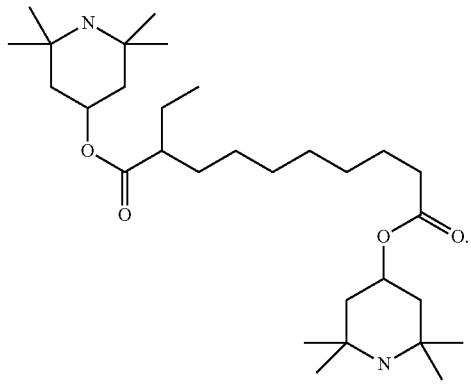

Example 65

| | | | |
|---|---|---|---|
| BCH-32 | 6.00% | Clearing point [° C.]: | 77 |
| CCH-23 | 16.00% | Δn [589 nm, 20° C.]: | 0.0953 |
| CCH-301 | 3.50% | Δε [1 kHz, 20° C.]: | −2.5 |
| CCH-34 | 6.00% | $\varepsilon_{\parallel}$ [1 kHz, 20° C.]: | 3.3 |
| CCH-35 | 6.00% | $\varepsilon_{\perp}$ [1 kHz, 20° C.]: | 5.8 |
| CCP-3-1 | 12.00% | $\gamma_1$ [mPa · s, 20° C.]: | 96 |
| CY-3-O2 | 15.00% | $K_1$ [pN, 20° C.]: | 14.6 |
| CCY-3-O1 | 5.00% | $K_3$ [pN, 20° C.]: | 15.6 |
| CCY-3-O2 | 7.00% | $V_0$ [20° C., V]: | 2.66 |
| CPY-3-O2 | 8.50% | LTS (bulk) [−20° C.] | >1000 h |
| PCH-302 | 6.00% | LTS (bulk) [−30° C.] | >1000 h |
| PY-V2-O2 | 9.00% | | |

Example 66

| | | | |
|---|---|---|---|
| BCH-32 | 4.00% | Clearing point [° C.]: | 76 |
| CC-3-V | 34.50% | Δn [589 nm, 20° C.]: | 0.0955 |
| CCP-3-1 | 10.00% | Δε [1 kHz, 20° C.]: | −2.5 |
| CY-3-O2 | 14.00% | $\varepsilon_{\parallel}$ [1 kHz, 20° C.]: | 3.4 |
| CCY-3-O1 | 6.00% | $\varepsilon_{\perp}$ [1 kHz, 20° C.]: | 5.9 |
| CCY-3-O2 | 9.00% | $\gamma_1$ [mPa · s, 20° C.]: | 82 |
| CPY-3-O2 | 9.00% | $K_1$ [pN, 20° C.]: | 13.4 |
| PCH-302 | 4.50% | $K_3$ [pN, 20° C.]: | 16.2 |
| PY-V2-O2 | 9.00% | $V_0$ [20° C., V]: | 2.66 |
| | | LTS (bulk) [−20° C.]: | >1000 h |
| | | LTS (bulk) [−30° C.]: | >1000 h |

Example 67

| | | | |
|---|---|---|---|
| BCH-32 | 6.50% | Clearing point [° C.]: | 76.5 |
| CCH-23 | 16.00% | Δn [589 nm, 20° C.]: | 0.0933 |
| CCH-301 | 4.50% | Δε [1 kHz, 20° C.]: | −2.5 |
| CCH-34 | 8.00% | $\varepsilon_{\parallel}$ [1 kHz, 20° C.]: | 3.3 |
| CCH-35 | 6.00% | $\varepsilon_{\perp}$ [1 kHz, 20° C.]: | 5.8 |
| CCP-3-1 | 8.50% | $\gamma_1$ [mPa · s, 20° C.]: | 96 |
| CY-3-O2 | 15.00% | $K_1$ [pN, 20° C.]: | 14.3 |
| CCY-3-O1 | 5.50% | $K_3$ [pN, 20° C.]: | 15.0 |
| CCY-3-O2 | 8.00% | $V_0$ [20° C., V]: | 2.57 |
| CPY-3-O2 | 9.00% | | |
| PCH-302 | 4.50% | | |
| PY-V2-O2 | 8.50% | | |

Example 68

| | | | |
|---|---|---|---|
| Y-4O-O4 | 7.00% | Clearing point [° C.]: | 75.5 |
| PY-1-O4 | 2.00% | Δn [589 nm, 20° C.]: | 0.1062 |
| CCY-3-O1 | 2.50% | Δε [1 kHz, 20° C.]: | −2.2 |
| CCY-3-O2 | 8.00% | $\varepsilon_{\parallel}$ [1 kHz, 20° C.]: | 3.4 |
| CPY-3-O2 | 10.00% | $\varepsilon_{\perp}$ [1 kHz, 20° C.]: | 5.5 |
| PYP-2-3 | 8.50% | $\gamma_1$ [mPa · s, 20° C.]: | 90 |
| CCH-23 | 19.00% | $K_1$ [pN, 20° C.]: | 14.5 |
| CCH-34 | 6.00% | $K_3$ [pN, 20° C.]: | 14.2 |
| CCH-35 | 6.00% | $V_0$ [20° C., V]: | 2.70 |
| PCH-302 | 8.00% | | |
| BCH-32 | 7.00% | | |
| CCP-3-1 | 10.00% | | |
| PY-V2-O2 | 6.00% | | |

Example 69

| | | | |
|---|---|---|---|
| BCH-32 | 7.00% | Clearing point [° C.]: | 75 |
| CCH-23 | 16.00% | Δn [589 nm, 20° C.]: | 0.0930 |
| CCH-301 | 3.50% | Δε [1 kHz, 20° C.]: | −2.5 |
| CCH-34 | 6.50% | $\varepsilon_{\parallel}$ [1 kHz, 20° C.]: | 3.3 |
| CCH-35 | 6.50% | $\varepsilon_{\perp}$ [1 kHz, 20° C.]: | 5.8 |
| CCP-3-1 | 9.50% | $\gamma_1$ [mPa · s, 20° C.]: | 93 |
| CY-3-O2 | 7.50% | $K_1$ [pN, 20° C.]: | 13.7 |
| CY-V1-O2 | 7.00% | $K_3$ [pN, 20° C.]: | 14.1 |
| CCY-3-O1 | 6.00% | $V_0$ [20° C., V]: | 2.52 |
| CCY-3-O2 | 9.00% | LTS (bulk) [−20° C.] | >1000 h |
| CPY-3-O2 | 7.00% | | |
| PCH-302 | 5.00% | | |
| PY-V2-O2 | 9.50% | | |

Example 70

| | | | |
|---|---|---|---|
| BCH-32 | 7.00% | Clearing point [° C.]: | 74 |
| CCH-23 | 15.00% | Δn [589 nm, 20° C.]: | 0.0921 |
| CCH-301 | 4.00% | Δε [1 kHz, 20° C.]: | −2.5 |
| CCH-34 | 8.00% | $\varepsilon_{\parallel}$ [1 kHz, 20° C.]: | 3.4 |
| CCH-35 | 7.00% | $\varepsilon_{\perp}$ [1 kHz, 20° C.]: | 5.9 |
| CCP-3-1 | 8.00% | $\gamma_1$ [mPa · s, 20° C.]: | 95 |
| CY-3-O2 | 9.00% | $K_1$ [pN, 20° C.]: | 13.4 |
| CY-V1-O2 | 7.00% | $K_3$ [pN, 20° C.]: | 14.1 |
| CCY-3-O1 | 9.00% | $V_0$ [20° C., V]: | 2.49 |
| CCY-3-O2 | 7.00% | | |
| CPY-1V-O1 | 7.00% | | |
| PCH-302 | 4.00% | | |
| PY-V2-O2 | 8.00% | | |

Example 71

| | | | |
|---|---|---|---|
| BCH-32 | 7.00% | Clearing point [° C.]: | 77 |
| CCH-23 | 13.00% | Δn [589 nm, 20° C.]: | 0.0935 |
| CCH-301 | 3.00% | Δε [1 kHz, 20° C.]: | −2.4 |
| CCH-34 | 10.00% | $\varepsilon_{\parallel}$ [1 kHz, 20° C.]: | 3.3 |
| CCH-35 | 6.00% | $\varepsilon_{\perp}$ [1 kHz, 20° C.]: | 5.7 |
| CCP-3-1 | 10.50% | $\gamma_1$ [mPa · s, 20° C.]: | 97 |
| CY-3-O2 | 8.50% | $K_1$ [pN, 20° C.]: | 14.1 |
| CY-V1-O2 | 5.50% | $K_3$ [pN, 20° C.]: | 14.6 |
| CCY-3-O1 | 10.00% | $V_0$ [20° C., V]: | 2.62 |
| CCY-3-O2 | 6.00% | | |
| CPY-1V-O1 | 5.50% | | |
| PCH-302 | 6.00% | | |
| PY-V2-O2 | 9.00% | | |

Example 72

| | | | |
|---|---|---|---|
| CY-3-O2 | 9.50% | Clearing point [° C.]: | 75 |
| PY-V-O2 | 9.50% | Δn [589 nm, 20° C.]: | 0.1101 |
| CCY-3-O2 | 9.00% | Δε [1 kHz, 20° C.]: | −3.0 |
| CCY-4-O2 | 6.00% | $\varepsilon_{\parallel}$ [1 kHz, 20° C.]: | 3.5 |
| CPY-2-O2 | 5.00% | $\varepsilon_{\perp}$ [1 kHz, 20° C.]: | 6.5 |
| CPY-3-O2 | 9.50% | $\gamma_1$ [mPa · s, 20° C.]: | 100 |
| CCH-34 | 10.00% | $K_1$ [pN, 20° C.]: | 13.4 |
| CCH-23 | 21.00% | $K_3$ [pN, 20° C.]: | 14.3 |
| PYP-2-3 | 7.00% | $V_0$ [20° C., V]: | 2.31 |
| CCP-3-1 | 3.00% | | |
| PCH-301 | 10.50% | | |

Example 73

| | | | |
|---|---|---|---|
| PY-3-O2 | 11.00% | Clearing point [° C.]: | 75 |
| PY-1V-O2 | 8.00% | Δn [589 nm, 20° C.]: | 0.1100 |
| CY-3-O2 | 5.00% | Δε [1 kHz, 20° C.]: | −3.4 |
| CCY-3-O2 | 9.00% | $\varepsilon_{\parallel}$ [1 kHz, 20° C.]: | 3.5 |
| CCY-3-O1 | 6.00% | $\varepsilon_{\perp}$ [1 kHz, 20° C.]: | 6.9 |
| CPY-2-O2 | 7.00% | $\gamma_1$ [mP · s, 20° C.]: | 107 |
| CPY-3-O2 | 10.00% | $K_1$ [pN, 20° C.]: | 14.3 |
| CCH-34 | 10.00% | $K_3$ [pN, 20° C.]: | 15.2 |
| CCH-23 | 21.00% | $V_0$ [20° C., V]: | 2.24 |
| CCP-3-1 | 4.00% | | |
| PCH-301 | 9.00% | | |

Example 74

| | | | |
|---|---|---|---|
| CY-3-O2 | 10.00% | Clearing point [° C.]: | 75 |
| PY-V-O2 | 9.00% | Δn [589 nm, 20° C.]: | 0.1099 |
| CCY-3-O2 | 9.00% | Δε [1 kHz, 20° C.]: | −3.2 |
| CCY-4-O2 | 7.00% | $\varepsilon_{\parallel}$ [1 kHz, 20° C.]: | 3.5 |
| CPY-2-O2 | 7.00% | $\varepsilon_{\perp}$ [1 kHz, 20° C.]: | 6.7 |
| CPY-3-O2 | 9.00% | $\gamma_1$ [mPa · s, 20° C.]: | 104 |
| CCH-34 | 11.00% | $K_1$ [pN, 20° C.]: | 13.2 |
| CCH-23 | 20.00% | $K_3$ [pN, 20° C.]: | 14.1 |
| PYP-2-3 | 7.00% | $V_0$ [20° C., V]: | 2.24 |
| CCP-3-1 | 1.00% | | |
| PCH-301 | 10.00% | | |

Example 75

| | | | |
|---|---|---|---|
| CY-3-O2 | 12.50% | Clearing point [° C.]: | 74 |
| PY-3-O2 | 4.00% | Δn [589 nm, 20° C.]: | 0.1026 |
| PY-V-O2 | 5.00% | Δε [1 kHz, 20° C.]: | −3.2 |
| CCY-3-O2 | 9.00% | $\varepsilon_{\parallel}$ [1 kHz, 20° C.]: | 3.5 |
| CCY-3-O1 | 6.00% | $\varepsilon_{\perp}$ [1 kHz, 20° C.]: | 6.7 |
| CCY-4-O2 | 2.00% | $\gamma_1$ [mPa · s, 20° C.]: | 102 |
| CPY-2-O2 | 7.00% | $K_1$ [pN, 20° C.]: | 13.5 |
| CPY-3-O2 | 9.00% | $K_3$ [pN, 20° C.]: | 14.1 |
| CCH-34 | 10.00% | $V_0$ [20° C., V]: | 2.22 |
| CCH-23 | 21.00% | LTS (bulk) [−20° C.]: | >1000 h |
| BCH-32 | 5.50% | | |
| PCH-301 | 8.00% | | |
| PYP-2-3 | 1.00% | | |

Example 76

| | | | |
|---|---|---|---|
| PY-3-O2 | 12.00% | Clearing point [° C.]: | 75 |
| PY-V-O2 | 5.00% | Δn [589 nm, 20° C.]: | 0.1112 |
| CCY-3-O2 | 10.00% | Δε [1 kHz, 20° C.]: | −3.1 |
| CCY-4-O2 | 9.50% | $\varepsilon_{\parallel}$ [1 kHz, 20° C.]: | 3.5 |
| CPY-2-O2 | 6.00% | $\varepsilon_{\perp}$ [1 kHz, 20° C.]: | 6.6 |
| CPY-3-O2 | 9.00% | $\gamma_1$ [mPa · s, 20° C.]: | 107 |
| CCH-34 | 5.50% | $K_1$ [pN, 20° C.]: | 13.7 |
| CCH-23 | 21.00% | $K_3$ [pN, 20° C.]: | 14.4 |
| PYP-2-3 | 4.50% | $V_0$ [20° C., V]: | 2.29 |
| CCH-35 | 4.00% | | |
| PCH-301 | 12.00% | | |
| BCH-32 | 1.50% | | |

Example 77

| | | | |
|---|---|---|---|
| PY-V-O2 | 8.00% | Clearing point [° C.]: | 74.8 |
| CY-3-O2 | 5.50% | Δn [589 nm, 20° C.]: | 0.1073 |
| CY-V-O2 | 11.00% | Δε [1 kHz, 20° C.]: | −3.1 |
| CCY-3-O1 | 4.00% | $\varepsilon_{\parallel}$ [1 kHz, 20° C.]: | 3.7 |
| CCY-3-O2 | 10.00% | $\varepsilon_{\perp}$ [1 kHz, 20° C.]: | 6.8 |
| CPY-3-O2 | 10.00% | $\gamma_1$ [mPa · s, 20° C.]: | 82 |
| CPY-V-O4 | 7.00% | $K_1$ [pN, 20° C.]: | 12.1 |
| CC-3-V | 37.00% | $K_3$ [pN, 20° C.]: | 14.6 |
| BCH-32 | 7.00% | $V_0$ [20° C., V]: | 2.30 |
| PPGU-3-F | 0.50% | | |

Example 78

| | | | |
|---|---|---|---|
| PY-3-O2 | 5.00% | Clearing point [° C.]: | 76 |
| PY-V2-O2 | 6.50% | Δn [589 nm, 20° C.]: | 0.1082 |
| CY-3-O2 | 12.00% | Δε [1 kHz, 20° C.]: | −3.2 |
| CCY-3-O1 | 5.00% | $\varepsilon_{\parallel}$ [1 kHz, 20° C.]: | 3.7 |
| CCY-3-O2 | 10.00% | $\varepsilon_{\perp}$ [1 kHz, 20° C.]: | 6.9 |
| CPY-V-O2 | 9.00% | $\gamma_1$ [mPa · s, 20° C.]: | 89 |
| CPY-V-O4 | 10.00% | $K_1$ [pN, 20° C.]: | 12.6 |
| CC-3-V | 35.00% | $K_3$ [pN, 20° C.]: | 14.6 |
| BCH-32 | 7.00% | $V_0$ [20° C., V]: | 2.26 |
| PPGU-3-F | 0.50% | | |

Example 78a

The mixture from Example 78 is additionally stabilised with 0.01% of

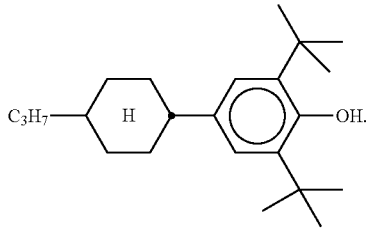

Example 78b

The mixture from Example 78 is additionally stabilised with 0.01% of

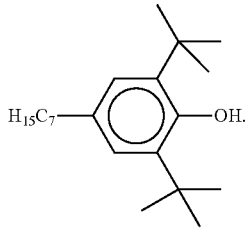

Example 79

| | | | |
|---|---|---|---|
| PY-V-O2 | 5.00% | Clearing point [° C.]: | 73.5 |
| PY-V2-O2 | 5.00% | Δn [589 nm, 20° C.]: | 0.1074 |
| PY-3-O2 | 3.00% | Δε [1 kHz, 20° C.]: | −2.9 |
| CY-V-O2 | 4.00% | $\varepsilon_{\parallel}$ [1 kHz, 20° C.]: | 3.7 |
| CY-3-O2 | 3.00% | $\varepsilon_{\perp}$ [1 kHz, 20° C.]: | 6.6 |
| CCY-3-O1 | 3.00% | $\gamma_1$ [mPa · s, 20° C.]: | 78 |
| CCY-3-O2 | 6.00% | $K_1$ [pN, 20° C.]: | 12.5 |
| CCY-4-O2 | 5.00% | $K_3$ [pN, 20° C.]: | 14.0 |
| CPY-2-O2 | 7.50% | $V_0$ [20° C., V]: | 2.33 |
| CPY-3-O2 | 10.00% | | |
| CC-3-V | 39.00% | | |
| BCH-32 | 7.00% | | |
| PPGU-3-F | 0.50% | | |
| Y-4O-O4 | 2.00% | | |

Example 80

| | | | |
|---|---|---|---|
| PY-V-O2 | 5.00% | Clearing point [° C.]: | 75 |
| CY-3-O2 | 8.00% | Δn [589 nm, 20° C.]: | 0.1078 |
| CY-V-O2 | 11.00% | Δε [1 kHz, 20° C.]: | −3.0 |
| CCY-3-O1 | 4.00% | $\varepsilon_{\parallel}$ [1 kHz, 20° C.]: | 3.7 |
| CCY-3-O2 | 7.00% | $\varepsilon_{\perp}$ [1 kHz, 20° C.]: | 6.7 |
| CPY-3-O2 | 8.00% | $\gamma_1$ [mPa · s, 20° C.]: | 84 |
| CPY-V-O4 | 5.00% | $K_1$ [pN, 20° C.]: | 11.9 |
| CPY-V-O2 | 7.00% | $K_3$ [pN, 20° C.]: | 14.4 |
| CC-3-V | 35.50% | $V_0$ [20° C., V]: | 2.30 |
| BCH-32 | 9.00% | | |
| PPGU-3-F | 0.50% | | |

Example 81

| | | | |
|---|---|---|---|
| APUQU-2-F | 9.00% | Clearing point [° C.]: | 77.5 |
| APUQU-3-F | 8.50% | Δn [589 nm, 20° C.]: | 0.1087 |
| CC-3-V | 43.50% | Δε [1 kHz, 20° C.]: | 9.9 |
| CCP-30CF$_3$ | 7.50% | $\varepsilon_{\parallel}$ [1 kHz, 20° C.]: | 13.7 |
| CCP-V-1 | 7.00% | $\varepsilon_{\perp}$ [1 kHz, 20° C.]: | 3.8 |
| DPGU-4-F | 3.50% | $\gamma_1$ [mPa · s, 20° C.]: | 68 |
| PGP-2-2V | 4.00% | $K_1$ [pN, 20° C.]: | 12.4 |
| PGUQU-4-F | 4.50% | $K_3$ [pN, 20° C.]: | 13.1 |
| PUQU-3-F | 8.50% | $V_0$ [20° C., V]: | 1.18 |
| PY-3V-O2 | 4.00% | LTS (bulk) [−20° C.]: | >1000 h |
| | | LTS (bulk) [−30° C.]: | >1000 h |

Example 82

| | | | |
|---|---|---|---|
| PY-1V-O2 | 4.50% | Clearing point [° C.]: | 73.5 |
| PY-V2-O2 | 5.00% | Δn [589 nm, 20° C.]: | 0.1074 |
| CY-3-O2 | 10.00% | Δε [1 kHz, 20° C.]: | −2.8 |
| CY-V-O2 | 4.50% | $\varepsilon_{\parallel}$ [1 kHz, 20° C.]: | 3.6 |
| CCY-3-O1 | 6.00% | $\varepsilon_{\perp}$ [1 kHz, 20° C.]: | 6.4 |
| CCY-3-O2 | 3.00% | $\gamma_1$ [mPa · s, 20° C.]: | 78 |
| CPY-2-O2 | 9.00% | $K_1$ [pN, 20° C.]: | 12.5 |
| CPY-3-O2 | 10.00% | $K_3$ [pN, 20° C.]: | 14.3 |
| CC-3-V | 39.50% | $V_0$ [20° C., V]: | 2.40 |
| BCH-32 | 8.00% | | |
| PPGU-3-F | 0.50% | | |

Example 83

| | | | |
|---|---|---|---|
| PY-V2-O2 | 5.50% | Clearing point [° C.]: | 74 |
| PY-3-O2 | 6.00% | Δn [589 nm, 20° C.]: | 0.1074 |
| CY-V2-O2 | 5.00% | Δε [1 kHz, 20° C.]: | −2.9 |
| CY-3-O2 | 4.00% | $\varepsilon_{\parallel}$ [1 kHz, 20° C.]: | 3.7 |
| CCY-3-O1 | 3.00% | $\varepsilon_{\perp}$ [1 kHz, 20° C.]: | 6.6 |
| CCY-3-O2 | 3.00% | $\gamma_1$ [mPa · s, 20° C.]: | 85 |
| CCY-4-O2 | 6.00% | $K_1$ [pN, 20° C.]: | 12.6 |
| CPY-2-O2 | 8.00% | $K_3$ [pN, 20° C.]: | 13.9 |
| CPY-3-O2 | 12.00% | $V_0$ [20° C., V]: | 2.30 |
| CC-3-V | 36.50% | | |
| BCH-32 | 8.50% | | |
| PPGU-3-F | 0.50% | | |
| Y-4O-O4 | 2.00% | | |

Example 84

| | | | |
|---|---|---|---|
| PY-V2-O2 | 6.00% | Clearing point [° C.]: | 74.5 |
| PY-3-O2 | 6.00% | Δn [589 nm, 20° C.]: | 0.1086 |
| CY-1V2-O2 | 4.50% | Δε [1 kHz, 20° C.]: | −2.9 |
| CY-3-O2 | 4.00% | $\varepsilon_{\parallel}$ [1 kHz, 20° C.]: | 3.6 |
| CCY-3-O1 | 3.00% | $\varepsilon_{\perp}$ [1 kHz, 20° C.]: | 6.5 |
| CCY-3-O2 | 3.00% | $\gamma_1$ [mPa · s, 20° C.]: | 86 |
| CCY-4-O2 | 6.00% | $K_1$ [pN, 20° C.]: | 12.8 |
| CPY-2-O2 | 8.00% | $K_3$ [pN, 20° C.]: | 14.2 |
| CPY-3-O2 | 12.00% | $V_0$ [20° C., V]: | 2.33 |
| CC-3-V | 37.00% | | |
| BCH-32 | 8.00% | | |
| PPGU-3-F | 0.50% | | |
| Y-4O-O4 | 2.00% | | |

Example 85

| | | | |
|---|---|---|---|
| PY-V2-O2 | 6.50% | Clearing point [° C.]: | 74 |
| CY-3-O2 | 11.00% | Δn [589 nm, 20° C.]: | 0.1068 |
| CY-V2-O2 | 6.50% | Δε [1 kHz, 20° C.]: | −2.8 |
| CCY-3-O1 | 6.00% | $\varepsilon_{\parallel}$ [1 kHz, 20° C.]: | 3.6 |
| CCY-3-O2 | 2.00% | $\varepsilon_{\perp}$ [1 kHz, 20° C.]: | 6.4 |
| CPY-2-O2 | 10.00% | $\gamma_1$ [mPa · s, 20° C.]: | 85 |
| CPY-3-O2 | 12.00% | $K_1$ [pN, 20° C.]: | 12.3 |
| CC-3-V | 36.00% | $K_3$ [pN, 20° C.]: | 14.1 |
| BCH-32 | 9.50% | $V_0$ [20° C., V]: | 2.35 |
| PPGU-3-F | 0.50% | | |

Example 86

| | | | |
|---|---|---|---|
| PCH-504FF | 10.00% | Clearing point [° C.]: | 72 |
| PCH-502FF | 8.00% | Δn [589 nm, 20° C.]: | 0.1216 |
| PCH-304FF | 4.00% | Δε [1 kHz, 20° C.]: | −4.0 |
| CCP-V2-1 | 6.00% | $\varepsilon_{\parallel}$ [1 kHz, 20° C.]: | 3.9 |
| BCH-32 | 7.00% | $\varepsilon_{\perp}$ [1 kHz, 20° C.]: | 7.9 |
| CCH-35 | 5.00% | $\gamma_1$ [mPa · s, 20° C.]: | 125 |
| CC-5-V | 7.00% | $K_1$ [pN, 20° C.]: | 14.6 |
| CC-3-V1 | 10.00% | $K_3$ [pN, 20° C.]: | 14.7 |
| CPY-2-O2 | 10.00% | $V_0$ [20° C., V]: | 2.03 |
| CPY-3-O2 | 13.00% | | |
| PY-V2-O2 | 20.00% | | |

Example 87

| | | | |
|---|---|---|---|
| CY-3-O2 | 24.00% | Clearing point [° C.]: | 81 |
| PY-1V2-O2 | 7.00% | Δn [589 nm, 20° C.]: | 0.1019 |
| CCY-3-O3 | 4.00% | Δε [1 kHz, 20° C.]: | −3.1 |
| CCY-3-O2 | 5.00% | $\varepsilon_{\parallel}$ [1 kHz, 20° C.]: | 3.5 |
| CPY-2-O2 | 7.00% | $\varepsilon_{\perp}$ [1 kHz, 20° C.]: | 6.6 |
| CPY-3-O2 | 5.00% | $\gamma_1$ [mPa · s, 20° C.]: | 126 |
| CCP-3-3 | 9.00% | $K_1$ [pN, 20° C.]: | 14.9 |
| CCP-3-1 | 9.00% | $K_3$ [pN, 20° C.]: | 16.0 |
| BCH-32 | 5.00% | $V_0$ [20° C., V]: | 2.39 |
| CCH-34 | 10.00% | LTS (bulk) [−20° C.]: | >1000 h |
| CCH-25 | 10.00% | | |
| PCH-301 | 5.00% | | |

Example 88

| | | | |
|---|---|---|---|
| CY-3-O2 | 18.00% | Clearing point [° C.]: | 80.5 |
| PY-1V2-O2 | 6.00% | Δn [589 nm, 20° C.]: | 0.0949 |
| CCY-3-O2 | 8.00% | Δε [1 kHz, 20° C.]: | −3.1 |
| CCY-4-O2 | 4.00% | $\varepsilon_{\parallel}$ [1 kHz, 20° C.]: | 3.4 |
| CPY-2-O2 | 7.00% | $\varepsilon_{\perp}$ [1 kHz, 20° C.]: | 6.4 |
| CPY-3-O2 | 10.00% | $\gamma_1$ [mPa · s, 20° C.]: | 113 |
| CCH-34 | 8.00% | $K_1$ [pN, 20° C.]: | 14.9 |
| CCH-23 | 22.00% | $K_3$ [pN, 20° C.]: | 16.0 |
| CCP-3-3 | 7.00% | $V_0$ [20° C., V]: | 2.41 |
| CCP-3-1 | 7.00% | LTS (bulk) [−20° C.]: | >1000 h |
| PCH-301 | 3.00% | | |

Example 89

| | | | |
|---|---|---|---|
| CY-1V-O1V | 20.00% | Clearing point [° C.]: | 82.5 |
| PY-1V2-O2 | 7.00% | Δn [589 nm, 20° C.]: | 0.0987 |

-continued

| | | | |
|---|---|---|---|
| CY-3-O2 | 5.00% | Δε [1 kHz, 20° C.]: | −3.0 |
| CCY-3-O2 | 5.00% | $\varepsilon_{\parallel}$ [1 kHz, 20° C.]: | 3.4 |
| CCY-4-O2 | 5.00% | $\varepsilon_{\perp}$ [1 kHz, 20° C.]: | 6.4 |
| CPY-3-O2 | 10.00% | $\gamma_1$ [mPa · s, 20° C.]: | 109 |
| CCH-34 | 10.00% | $K_1$ [pN, 20° C.]: | 14.9 |
| CC-3-V1 | 11.00% | $K_3$ [pN, 20° C.]: | 18.9 |
| CC-2-V1 | 11.00% | $V_0$ [20° C., V]: | 2.66 |
| CCP-3-1 | 8.00% | LTS (bulk) [−20° C.]: | >1000 h |
| PCH-301 | 2.00% | | |
| CCVC-3-V | 6.00% | | |

Example 90

| | | | |
|---|---|---|---|
| CY-1V-O1V | 20.00% | Clearing point [° C.]: | 81 |
| PY-1V2-O2 | 5.00% | Δn [589 nm, 20° C.]: | 0.0953 |
| CY-3-O2 | 7.00% | Δε [1 kHz, 20° C.]: | −3.0 |
| CCY-3-O2 | 6.00% | $\varepsilon_{\parallel}$ [1 kHz, 20° C.]: | 3.4 |
| CCY-3-O1 | 6.00% | $\varepsilon_{\perp}$ [1 kHz, 20° C.]: | 6.4 |
| CPY-3-O2 | 8.00% | $\gamma_1$ [mPa · s, 20° C.]: | 106 |
| CCH-34 | 10.00% | $K_1$ [pN, 20° C.]: | 14.5 |
| CC-3-V1 | 11.00% | $K_3$ [pN, 20° C.]: | 18.6 |
| CC-2-V1 | 11.00% | $V_0$ [20° C., V]: | 2.63 |
| CCP-3-1 | 8.00% | LTS (bulk) [−20° C.]: | >1000 h |
| PCH-301 | 2.00% | | |
| CCVC-3-V | 6.00% | | |

Example 91

| | | | |
|---|---|---|---|
| CY-1V-O1V | 20.00% | Clearing point [° C.]: | 81.5 |
| PY-1V2-O2 | 6.00% | Δn [589 nm, 20° C.]: | 0.0947 |
| CY-3-O2 | 6.00% | Δε [1 kHz, 20° C.]: | −3.0 |
| CCY-3-O2 | 7.00% | $\varepsilon_{\parallel}$ [1 kHz, 20° C.]: | 3.4 |
| CCY-3-O1 | 7.00% | $\varepsilon_{\perp}$ [1 kHz, 20° C.]: | 6.4 |
| CPY-3-O2 | 6.00% | $\gamma_1$ [mPa · s, 20° C.]: | 104 |
| CCH-34 | 10.00% | $K_1$ [pN, 20° C.]: | 14.6 |
| CC-3-V1 | 12.00% | $K_3$ [pN, 20° C.]: | 18.6 |
| CC-2-V1 | 12.00% | $V_0$ [20° C., V]: | 2.64 |
| CCP-V2-1 | 4.00% | | |
| CCP-V-1 | 4.00% | | |
| CCVC-3-V | 6.00% | | |

Example 92

| | | | |
|---|---|---|---|
| CY-1V-O1V | 20.00% | Clearing point [° C.]: | 80.5 |
| PY-1V2-O2 | 5.00% | Δn [589 nm, 20° C.]: | 0.0962 |
| CY-3-O2 | 12.00% | Δε [1 kHz, 20° C.]: | −3.4 |
| CCY-3-O2 | 6.00% | $\varepsilon_{\parallel}$ [1 kHz, 20° C.]: | 3.5 |
| CCY-4-O2 | 6.00% | $\varepsilon_{\perp}$ [1 kHz, 20° C.]: | 6.9 |
| CPY-3-O2 | 8.00% | $\gamma_1$ [mPa · s, 20° C.]: | 112 |
| CCH-34 | 7.00% | $K_1$ [pN, 20° C.]: | 14.3 |
| CC-3-V1 | 11.00% | $K_3$ [pN, 20° C.]: | 18.5 |
| CC-2-V1 | 11.00% | $V_0$ [20° C., V]: | 2.45 |
| CCP-3-1 | 6.00% | | |
| CCVC-3-V | 8.00% | | |

Example 93

| | | | |
|---|---|---|---|
| CY-1V-O1V | 20.00% | Clearing point [° C.]: | 81.5 |
| PY-1V2-O2 | 7.00% | Δn [589 nm, 20° C.]: | 0.0932 |
| CY-3-O2 | 7.50% | Δε [1 kHz, 20° C.]: | −3.3 |

-continued

| | | | |
|---|---|---|---|
| CCY-3-O2 | 10.50% | $\varepsilon_{\parallel}$ [1 kHz, 20° C.]: | 3.4 |
| CCY-4-O2 | 10.00% | $\varepsilon_{\perp}$ [1 kHz, 20° C.]: | 6.7 |
| CC-3-V2 | 11.00% | $\gamma_1$ [mPa · s, 20° C.]: | 104 |
| CC-3-V1 | 11.00% | $K_1$ [pN, 20° C.]: | 14.9 |
| CC-2-V1 | 11.00% | $K_3$ [pN, 20° C.]: | 19.0 |
| CCP-3-1 | 6.00% | $V_0$ [20° C., V]: | 2.55 |
| CCVC-3-V | 6.00% | LTS (bulk) [−20° C.] | >1000 h |

Example 94

| | | | |
|---|---|---|---|
| CY-3-O2 | 12.00% | Clearing point [° C.]: | 80.0 |
| PY-1V2-O2 | 11.00% | Δn [589 nm, 20° C.]: | 0.0950 |
| CCY-3-O2 | 10.00% | Δε [1 kHz, 20° C.]: | −3.1 |
| CCY-4-O2 | 10.00% | $\varepsilon_{\parallel}$ [1 kHz, 20° C.]: | 3.3 |
| CPY-3-O2 | 10.00% | $\varepsilon_{\perp}$ [1 kHz, 20° C.]: | 6.4 |
| CCH-34 | 8.00% | $\gamma_1$ [mPa · s, 20° C.]: | 111 |
| CCH-23 | 22.00% | $K_1$ [pN, 20° C.]: | 15.1 |
| CCP-3-3 | 3.00% | $K_3$ [pN, 20° C.]: | 16.6 |
| CCP-3-1 | 7.00% | $V_0$ [20° C., V]: | 2.46 |
| PCH-301 | 7.00% | LTS (bulk) [−20° C.] | >1000 h |

Example 95

| | | | |
|---|---|---|---|
| CY-1V-O1V | 18.00% | Clearing point [° C.]: | 80.5 |
| PY-1V2-O2 | 4.00% | Δn [589 nm, 20° C.]: | 0.0943 |
| CY-3-O2 | 15.00% | Δε [1 kHz, 20° C.]: | −3.6 |
| CCY-3-O2 | 8.00% | $\varepsilon_{\parallel}$ [1 kHz, 20° C.]: | 3.5 |
| CCY-4-O2 | 7.00% | $\varepsilon_{\perp}$ [1 kHz, ° C.]: | 7.2 |
| CPY-3-O2 | 7.00% | $\gamma_1$ [mPa · s, 20° C.]: | 112 |
| CCH-34 | 7.00% | $K_1$ [pN, 20° C.]: | 14.2 |
| CC-3-V1 | 11.00% | $K_3$ [pN, 20° C.]: | 18.2 |
| CC-2-V1 | 11.00% | $V_0$ [20° C., V]: | 2.37 |
| CCP-3-1 | 3.00% | | |
| CCVC-3-V | 9.00% | | |

Example 96

| | | | |
|---|---|---|---|
| CY-1V-O1V | 18.00% | Clearing point [° C.]: | 80.5 |
| PY-1V2-O2 | 3.00% | Δn [589 nm, 20° C.]: | 0.0946 |
| CY-3-O2 | 16.00% | Δε [1 kHz, 20° C.]: | −3.7 |
| CCY-3-O2 | 10.00% | $\varepsilon_{\parallel}$ [1 kHz, 20° C.]: | 3.5 |
| CCY-4-O2 | 5.00% | $\varepsilon_{\perp}$ [1 kHz, 20° C.]: | 7.2 |
| CPY-3-O2 | 7.00% | $\gamma_1$ [mPa · s, 20° C.]: | 113 |
| CC-3-V2 | 7.00% | $K_1$ [pN, 20° C.]: | 14.2 |
| CC-3-V1 | 11.00% | $K_3$ [pN, 20° C.]: | 18.7 |
| CC-2-V1 | 11.00% | $V_0$ [20° C., V]: | 2.39 |
| CCP-3-1 | 3.00% | | |
| CCVC-3-V | 9.00% | | |

Example 97

| | | | |
|---|---|---|---|
| PY-3-O2 | 11.00% | Clearing point [° C.]: | 75 |
| PY-V2-O2 | 6.50% | Δn [589 nm, 20° C.]: | 0.1105 |
| CCY-3-O2 | 9.00% | Δε [1 kHz, 20° C.]: | −3.1 |
| CCY-4-O2 | 3.00% | $\varepsilon_{\parallel}$ [1 kHz, 20° C.]: | 3.5 |
| CCY-3-01 | 5.00% | $\varepsilon_{\perp}$ [1 kHz, 20° C.]: | 6.6 |
| CPY-2-O2 | 6.50% | $\gamma_1$ [mPa · s, 20° C.]: | 105 |
| CPY-3-O2 | 10.00% | $K_1$ [pN, 20° C.]: | 13.9 |
| CCH-34 | 10.00% | $K_3$ [pN, 20° C.]: | 14.3 |
| CCH-23 | 21.00% | $V_0$ [20° C., V]: | 2.28 |

-continued

| | | | |
|---|---|---|---|
| PYP-2-3 | 6.00% | LTS (bulk) [−20° C.] | >1000 h |
| CCP-3-1 | 3.00% | | |
| PCH-301 | 9.00% | | |

Example 98

| | | | |
|---|---|---|---|
| PY-3-O2 | 11.00% | Clearing point [° C.]: | 74 |
| PY-1V2-O2 | 7.50% | Δn [589 nm, 20° C.]: | 0.1107 |
| CCY-3-O2 | 9.00% | Δε [1 kHz, 20° C.]: | −3.0 |
| CCY-3-O1 | 5.50% | $\varepsilon_{\parallel}$ [1 kHz, 20° C.]: | 3.4 |
| CPY-2-O2 | 6.50% | $\varepsilon_{\perp}$ [1 kHz, 20° C.]: | 6.4 |
| CPY-3-O2 | 10.00% | $\gamma_1$ [mPa · s, 20° C.]: | 104 |
| CCH-34 | 10.00% | $K_1$ [pN, 20° C.]: | 14.0 |
| CCH-23 | 21.00% | $K_3$ [pN, 20° C.]: | 14.8 |
| PYP-2-3 | 5.50% | $V_0$ [20° C., V]: | 2.37 |
| CCP-3-1 | 4.00% | LTS (bulk) [−20° C.] | >1000 h |
| PCH-301 | 10.00% | | |

Example 99

| | | | |
|---|---|---|---|
| PY-3-O2 | 11.00% | Clearing point [° C.]: | 74 |
| PY-1V2-O2 | 8.00% | Δn [589 nm, 20° C.]: | 0.1119 |
| CY-3-O2 | 3.00% | Δε [1 kHz, 20° C.]: | −3.3 |
| CCY-3-O2 | 9.00% | $\varepsilon_{\parallel}$ [1 kHz, 20° C.]: | 3.5 |
| CCY-3-O1 | 6.00% | $\varepsilon_{\perp}$ [1 kHz, 20° C.]: | 6.8 |
| CPY-2-O2 | 6.50% | $\gamma_1$ [mPa · s, 20° C.]: | 108 |
| CPY-3-O2 | 10.00% | $K_1$ [pN, 20° C.]: | 14.3 |
| CCH-34 | 10.00% | $K_3$ [pN, 20° C.]: | 15.0 |
| CCH-23 | 21.00% | $V_0$ [20° C., V]: | 2.26 |
| PYP-2-3 | 5.00% | LTS (bulk) [−20° C.] | >1000 h |
| CCP-3-1 | 4.00% | | |
| PCH-301 | 6.50% | | |

Example 100

| | | | |
|---|---|---|---|
| CC-3-V | 39.00% | Clearing point [° C.]: | 74.5 |
| CC-3-V1 | 3.00% | Δn [589 nm, 20° C.]: | 0.1017 |
| CCP-V-1 | 8.00% | Δε [1 kHz, 20° C.]: | 3.2 |
| CCP-V2-1 | 12.00% | $\gamma_1$ [mPa · s, 20° C.]: | 64 |
| PGP-2-2V | 3.50% | $K_1$ [pN, 20° C.]: | 13 |
| PP-1-2V1 | 9.00% | $K_3$ [pN, 20° C.]: | 15.4 |
| PPGU-3-F | 1.00% | $V_0$ [20° C., V]: | 2.13 |
| PUQU-3-F | 15.50% | | |
| CCY-3-O2 | 9.00% | | |

Example 101

| | | | |
|---|---|---|---|
| BCH-32 | 5.00% | Clearing point [° C.]: | 75.3 |
| CC-3-V | 41.50% | Δn [589 nm, 20° C.]: | 0.0989 |
| CC-3-V1 | 8.50% | Δε [1 kHz, 20° C.]: | −1.9 |
| CCH-35 | 2.00% | $\varepsilon_{\parallel}$ [1 kHz, 20° C.]: | 3.2 |
| CCP-3-1 | 3.00% | $\varepsilon_{\perp}$ [1 kHz, 20° C.]: | 5.0 |
| CCY-3-O2 | 7.00% | $\gamma_1$ [mPa · s, 20° C.]: | 69 |
| CPY-2-O2 | 5.50% | $K_1$ [pN, 20° C.]: | 14.2 |
| CPY-3-O2 | 12.50% | $K_3$ [pN, 20° C.]: | 15.5 |
| PY-3-O2 | 15.00% | $V_0$ [20° C., V]: | 3.02 |

Example 101a

The mixture from Example 101 is additionally mixed with 0.001% of Irganox® 1076 (octadecyl 3-(3,5-di-tert-butyl-4-hydroxyphenyl)propionate, BASF) and 0.3% of RM-1.

Example 102

| | | | |
|---|---|---|---|
| CCY-3-O1 | 8.00% | Clearing point [° C.]: | 74.9 |
| CCY-4-O2 | 7.50% | Δn [589 nm, 20° C.]: | 0.1123 |
| CPY-2-O2 | 10.00% | Δε [1 kHz, 20° C.]: | −3.7 |
| CPY-3-O2 | 10.00% | $\varepsilon_{\parallel}$ [1 kHz, 20° C.]: | 3.7 |
| CC-3-V | 15.00% | $\varepsilon_{\perp}$ [1 kHz, 20° C.]: | 7.5 |
| PY-1-O4 | 5.00% | $\gamma_1$ [mPa · s, 20° C.]: | 121 |
| PY-3-O2 | 9.00% | $K_1$ [pN, 20° C.]: | 13.2 |
| PY-4-O2 | 5.00% | $K_3$ [pN, 20° C.]: | 15.5 |
| CC-3-V1 | 9.00% | $V_0$ [20° C., V]: | 2.15 |
| CCY-3-O2 | 6.50% | | |
| PCH-301 | 15.00% | | |

Example 102a

The mixture from Example 102 is additionally stabilised with 0.01% of

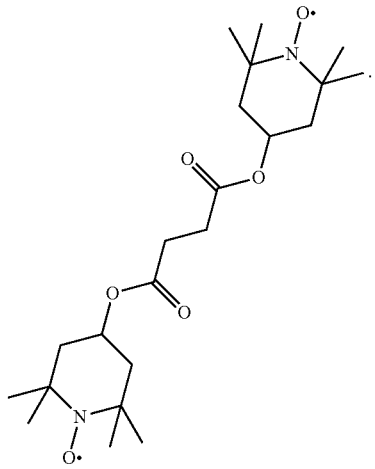

Example 103

| | | | |
|---|---|---|---|
| CY-3-O2 | 10.00% | Clearing point [° C.]: | 100 |
| CY-3-O4 | 20.00% | Δn [589 nm, 20° C.]: | 0.0865 |
| CY-5-O4 | 20.00% | Δε [1 kHz, 20° C.]: | −5.4 |
| CCY-3-O2 | 6.00% | $\varepsilon_{\parallel}$ [1 kHz, 20° C.]: | 3.9 |
| CCY-3-O3 | 6.00% | $\varepsilon_{\perp}$ [1 kHz, 20° C.]: | 9.3 |
| CCY-4-O2 | 6.00% | $\gamma_1$ [mPa · s, 20° C.]: | 347 |

-continued

| | | | |
|---|---|---|---|
| CCY-5-O2 | 6.00% | $K_1$ [pN, 20° C.]: | 15.6 |
| CH-33 | 3.00% | $K_3$ [pN, 20° C.]: | 16.6 |
| CH-35 | 3.50% | $V_0$ [20° C., V]: | 1.84 |
| CH-43 | 3.50% | | |
| CH-45 | 3.50% | | |
| CCPC-33 | 4.00% | | |
| CCPC-34 | 4.50% | | |
| CCPC-35 | 4.00% | | |

Example 104

| | | | |
|---|---|---|---|
| CY-3-O2 | 15.00% | Clearing point [° C.]: | 91 |
| CY-5-O2 | 12.00% | Δn [589 nm, 20° C.]: | 0.105 |
| CCY-3-O1 | 4.00% | Δε [1 kHz, 20° C.]: | −4.5 |
| CCY-3-O2 | 4.00% | $\gamma_1$ [mPa · s, 20° C.]: | 106 |
| CCY-3-O3 | 4.00% | $V_0$ [20° C., V]: | 1.32 |
| CCY-4-O2 | 4.00% | | |
| CLY-3-O2 | 10.00% | | |
| CLY-3-O3 | 2.00% | | |
| CPY-2-O2 | 8.00% | | |
| CC-3-V | 24.00% | | |
| PGP-2-5 | 5.00% | | |

Example 105

| | | | |
|---|---|---|---|
| CY-3-O2 | 14.00% | Clearing point [° C.]: | 84.7 |
| CY-3-O4 | 4.00% | Δn [589 nm, 20° C.]: | 0.1068 |
| CY-5-O2 | 7.00% | Δε [1 kHz, 20° C.]: | −4.0 |
| CCY-3-O1 | 4.00% | $\gamma_1$ [mPa · s, 20° C.]: | 138 |
| CCY-3-O2 | 5.00% | $K_1$ [pN, 20° C.]: | 14.1 |
| CCY-4-O2 | 8.00% | $K_3$ [pN, 20° C.]: | 16.2 |
| CCY-5-O2 | 3.00% | $V_0$ [20° C., V]: | 2.13 |
| CPY-2-O2 | 9.00% | | |
| CPY-3-O2 | 9.00% | | |
| PYP-2-3 | 6.00% | | |
| CC-3-V | 22.00% | | |
| CC-3-V1 | 3.50% | | |
| CCP-V-1 | 5.00% | | |
| PPGU-3-F | 0.50% | | |

Example 106

| | | | |
|---|---|---|---|
| CY-3-O2 | 15.00% | Clearing point [° C.]: | 80.4 |
| CY-5-O2 | 12.50% | Δn [589 nm, 20° C.]: | 0.1038 |
| CCY-3-O1 | 2.50% | Δε [1 kHz, 20° C.]: | −3.3 |
| CCY-4-O2 | 5.00% | $\varepsilon_{\parallel}$ [1 kHz, 20° C.]: | 3.5 |
| CPY-2-O2 | 8.00% | $\varepsilon_{\perp}$ [1 kHz, 20° C.]: | 6.8 |
| CPY-3-O2 | 8.00% | $\gamma_1$ [mPa · s, 20° C.]: | 137 |
| CCY-2-1 | 6.00% | $K_1$ [pN, 20° C.]: | 14.2 |
| CCY-3-1 | 6.00% | $K_3$ [pN, 20° C.]: | 14.2 |
| CCH-23 | 15.00% | $V_0$ [20° C., V]: | 2.18 |
| CCH-34 | 5.00% | | |
| CCH-301 | 1.50% | | |
| BCH-32 | 15.50% | | |

Example 106a

The mixture from Example 106 is additionally mixed with 0.25% of RM-35

RM-35

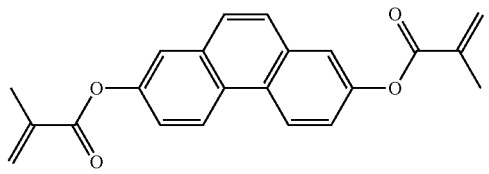

and additionally stabilised with 0.025% of

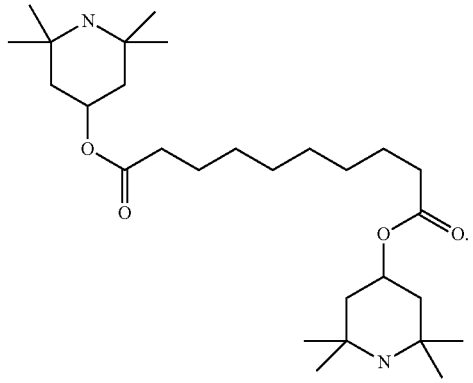

Example 107

| | | | |
|---|---|---|---|
| CC-3-V | 34.00% | Clearing point [° C.]: | 100 |
| CC-3-V1 | 2.50% | Δn [589 nm, 20° C.]: | 0.1003 |
| CCP-V-1 | 10.00% | Δε [1 kHz, 20° C.]: | 9.1 |
| PUQU-3-F | 7.00% | $\varepsilon_{\parallel}$ [1 kHz, 20° C.]: | 12.3 |
| PGUQU-3-F | 4.00% | $\varepsilon_{\perp}$ [1 kHz, 20° C.]: | 3.2 |
| CPGU-3-OT | 6.00% | $\gamma_1$ [mPa · s, 20° C.]: | 99 |
| CCGU-3-F | 4.00% | $K_1$ [pN, 20° C.]: | 14.2 |
| APUQU-3-F | 8.00% | $K_3$ [pN, 20° C.]: | 17.3 |
| CCP-3F.F.F | 4.50% | | |
| CCP-30CF$_3$ | 4.00% | | |
| CCP-50CF$_3$ | 3.00% | | |
| CCQU-3-F | 10.00% | | |
| CBC-33 | 3.00% | | |

Example 107a
m

The mixture from Example 107 is additionally stabilised with 0.03% of

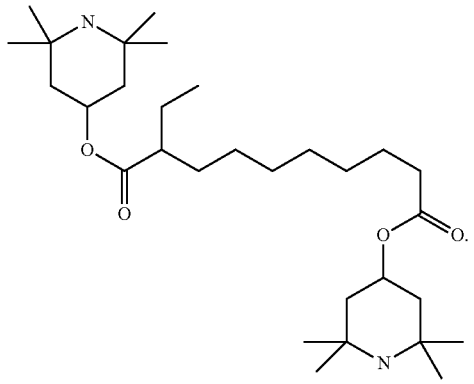

Example 107b

The mixture from Example 107 is additionally stabilised with
0.03% of

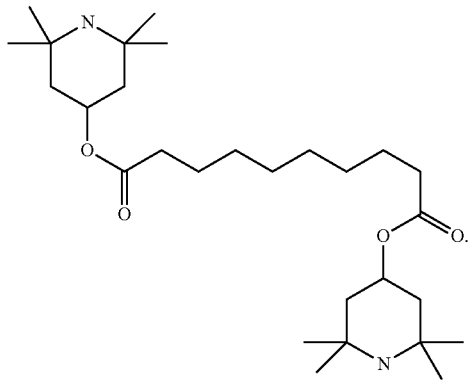

Example 108

| | | | |
|---|---|---|---|
| Y-4O-O4 | 4.50% | Clearing point [° C.]: | 100 |
| PYP-2-3 | 2.00% | Δn [589 nm, 20° C.]: | 0.1716 |
| CC-3-V | 25.00% | Δε [1 kHz, 20° C.]: | −1.5 |
| CC-4-V | 10.00% | $\varepsilon_{\parallel}$ [1 kHz, 20° C.]: | 3.4 |
| CCP-V-1 | 14.00% | $\varepsilon_{\perp}$ [1 kHz, 20° C.]: | 4.9 |
| PTP-302FF | 10.00% | $\gamma_1$ [mPa · s, 20° C.]: | 114 |
| CPTP-302FF | 10.00% | $K_1$ [pN, 20° C.]: | 15.2 |
| CPTP-302FF | 10.00% | $K_3$ [pN, 20° C.]: | 18.5 |
| PPTUI-3-2 | 14.50% | $V_0$ [20° C., V]: | 3.76 |

Example 109

| | | | |
|---|---|---|---|
| CCH-23 | 25.00% | Clearing point [° C.]: | 70.3 |
| CC-3-V | 4.50% | Δn [589 nm, 20° C.]: | 0.0737 |
| PCH-53 | 25.00% | Δε [1 kHz, 20° C.]: | −1.1 |
| CCY-2-1 | 12.00% | $\varepsilon_{\parallel}$ [1 kHz, 20° C.]: | 2.8 |
| CCY-3-1 | 12.00% | $\varepsilon_{\perp}$ [1 kHz, 20° C.]: | 3.9 |

-continued

| | | | |
|---|---|---|---|
| CCY-3-O2 | 12.00% | $K_1$ [pN, 20° C.]: | 11.7 |
| CCY-3-O3 | 5.00% | $K_3$ [pN, 20° C.]: | 13.1 |
| CBC-33F | 4.50% | | |

Example 110

| | | | |
|---|---|---|---|
| CC-3-V1 | 10.25% | Clearing point [° C.]: | 74.7 |
| CCH-23 | 18.50% | Δn [589 nm, 20° C.]: | 0.1027 |
| CCH-35 | 6.75% | Δε [1 kHz, 20° C.]: | −3.1 |
| CCP-3-1 | 6.00% | $\varepsilon_{\parallel}$ [1 kHz, 20° C.]: | 3.4 |
| CCY-3-1 | 2.50% | $\varepsilon_{\perp}$ [1 kHz, 20° C.]: | 6.5 |
| CCY-3-O2 | 12.00% | $\gamma_1$ [mPa · s, 20° C.]: | 104 |
| CPY-2-O2 | 6.00% | $K_1$ [pN, 20° C.]: | 15.4 |
| CPY-3-O2 | 9.75% | $K_3$ [pN, 20° C.]: | 16.8 |
| CY-3-O2 | 11.50% | $V_0$ [20° C., V]: | 2.46 |
| PP-1-2V1 | 3.75% | | |
| PY-3-O2 | 13.00% | | |

Example 110a

The mixture from Example 110 is additionally mixed with 0.01% of Irganox® 1076 (octadecyl 3-(3,5-di-tert-butyl-4-hydroxyphenyl)propionate, BASF) and 0.3% of RM-1.

Example 111

| | | | |
|---|---|---|---|
| BCH-3F.F | 10.00% | Clearing point [° C.]: | 99.6 |
| BCH-3F.F.F | 12.00% | Δn [589 nm, 20° C.]: | 0.1122 |
| CBC-33 | 3.00% | Δε [1 kHz, 20° C.]: | 10.1 |
| CBC-33F | 3.00% | $\varepsilon_{\parallel}$ [1 kHz, 20° C.]: | 13.8 |
| CCGU-3-F | 8.00% | $\varepsilon_{\perp}$ [1 kHz, 20° C.]: | 3.6 |
| CCH-34 | 10.00% | $\gamma_1$ [mPa · s, 20° C.]: | 164 |
| CCH-35 | 6.50% | $K_1$ [pN, 20° C.]: | 11.8 |
| CCP-1F.F.F | 10.00% | $K_3$ [pN, 20° C.]: | 15.9 |
| CCP-2F.F.F | 10.00% | $V_0$ [20° C., V]: | 1.14 |
| CCP-3-1 | 2.50% | | |
| CCP-3F.F.F | 8.00% | | |
| CPGP-4-3 | 3.00% | | |
| CPGP-5-2 | 2.00% | | |
| CPGP-5-3 | 1.00% | | |
| PUQU-2-F | 1.00% | | |
| PUQU-3-F | 10.00% | | |

Example 112

| | | | |
|---|---|---|---|
| CBC-53F | 3.00% | Clearing point [° C.]: | 115.5 |
| CC-3-2V1 | 1.00% | Δn [589 nm, 20° C.]: | 0.1106 |
| CC-3-V | 25.00% | Δε [1 kHz, 20° C.]: | 7.0 |
| CC-3-V1 | 5.00% | $\varepsilon_{\parallel}$ [1 kHz, 20° C.]: | 9.9 |
| CCGU-3-F | 5.50% | $\varepsilon_{\perp}$ [1 kHz, 20° C.]: | 2.9 |
| CCP-30CF$_3$ | 4.00% | $\gamma_1$ [mPa · s, 20° C.]: | 118 |
| CCP-30CF$_3$.F | 8.00% | $K_1$ [pN, 20° C.]: | 17.4 |
| CCP-40CF$_3$ | 3.00% | $K_3$ [pN, 20° C.]: | 20.4 |
| CCP-50CF$_3$ | 3.00% | $V_0$ [20° C., V]: | 1.66 |
| CCP-V-1 | 8.00% | | |
| CCP-V2-1 | 12.00% | | |
| CPGU-3-OT | 5.00% | | |
| PGUQU-3-F | 4.00% | | |
| PGUQU-4-F | 4.00% | | |
| PGUQU-5-F | 2.00% | | |
| PP-1-2V1 | 3.00% | | |
| PPGU-3-F | 0.50% | | |
| PUQU-2-F | 1.00% | | |
| PUQU-3-F | 3.00% | | |

Example 113

| | | | |
|---|---|---|---|
| APUQU-2-F | 2.50% | Clearing point [° C.]: | 85.8 |
| APUQU-3-F | 5.00% | Δn [589 nm, 20° C.]: | 0.1106 |
| PUQU-3-F | 10.00% | Δε [1 kHz, 20° C.]: | 8.6 |
| PGUQU-3-F | 5.00% | $\varepsilon_{\parallel}$ [1 kHz, 20° C.]: | 12.6 |
| PGUQU-4-F | 3.00% | $\varepsilon_{\perp}$ [1 kHz, 20° C.]: | 4.0 |
| PGUQU-5-F | 2.00% | $\gamma_1$ [mPa · s, 20° C.]: | 92 |
| DPGU-4-F | 4.00% | $K_1$ [pN, 20° C.]: | 13.0 |
| PPGU-3-F | 0.50% | $K_3$ [pN, 20° C.]: | 15.3 |
| CDUQU-3-F | 0.05% | $V_0$ [20° C., V]: | 1.30 |
| CC-3-V | 39.95% | | |
| CCP-V-1 | 9.00% | | |
| CCP-V2-1 | 8.00% | | |
| CCP-3-1 | 2.00% | | |
| PGP-2-3 | 3.00% | | |
| CY-3-O2 | 5.00% | | |
| CCY-3-O2 | 5.00% | | |

Example 114

| | | | |
|---|---|---|---|
| APUQU-2-F | 2.50% | Clearing point [° C.]: | 85.8 |
| APUQU-3-F | 5.00% | Δn [589 nm, 20° C.]: | 0.1105 |
| PUQU-3-F | 12.50% | Δε [1 kHz, 20° C.]: | 10.6 |
| PGUQU-3-F | 5.00% | $\varepsilon_{\parallel}$ [1 kHz, 20° C.]: | 14.8 |
| PGUQU-4-F | 4.00% | $\varepsilon_{\perp}$ [1 kHz, 20° C.]: | 4.2 |
| PGUQU-5-F | 4.00% | $\gamma_1$ [mPa · s, 20° C.]: | 98 |
| DPGU-4-F | 4.00% | $K_1$ [pN, 20° C.]: | 12.7 |
| PPGU-3-F | 0.50% | $K_3$ [pN, 20° C.]: | 15.1 |
| CDUQU-3-F | 0.05% | | |
| CC-3-V | 34.95% | | |
| CCP-V-1 | 7.00% | | |
| CCP-V2-1 | 6.00% | | |
| CCP-3-1 | 2.50% | | |
| CCPC-33 | 2.00% | | |
| CY-3-O2 | 5.00% | | |
| CCY-3-O2 | 5.00% | | |

Example 115

| | | | |
|---|---|---|---|
| APUQU-2-F | 3.00% | Clearing point [° C.]: | 85.7 |
| APUQU-3-F | 5.00% | Δn [589 nm, 20° C.]: | 0.1097 |
| PUQU-3-F | 12.00% | Δε [1 kHz, 20° C.]: | 8.7 |
| PGUQU-3-F | 5.00% | $\varepsilon_{\parallel}$ [1 kHz, 20° C.]: | 12.4 |
| PGUQU-4-F | 4.00% | $\varepsilon_{\perp}$ [1 kHz, 20° C.]: | 3.7 |
| PGUQU-5-F | 3.00% | $\gamma_1$ [mPa · s, 20° C.]: | 82 |
| PPGU-3-F | 0.50% | $K_1$ [pN, 20° C.]: | 12.9 |
| CDUQU-3-F | 0.05% | $K_3$ [pN, 20° C.]: | 15.7 |
| CC-3-V | 38.95% | $V_0$ [20° C., V]: | 1.29 |
| CCP-V-1 | 10.50% | | |
| CCP-V2-1 | 9.00% | | |
| PGP-2-3 | 2.00% | | |
| CCY-3-O2 | 3.50% | | |
| CPY-3-O2 | 3.50% | | |

Example 116

| | | | |
|---|---|---|---|
| APUQU-2-F | 3.00% | Clearing point [° C.]: | 85.7 |
| APUQU-3-F | 5.00% | Δn [589 nm, 20° C.]: | 0.1097 |
| PUQU-3-F | 12.00% | Δε [1 kHz, 20° C.]: | 8.7 |
| PGUQU-3-F | 5.00% | $\varepsilon_{\parallel}$ [1 kHz, 20° C.]: | 12.4 |
| PGUQU-4-F | 4.00% | $\varepsilon_{\perp}$ [1 kHz, 20° C.]: | 3.7 |
| PGUQU-5-F | 3.00% | $\gamma_1$ [mPa · s, 20° C.]: | 82 |
| PPGU-3-F | 0.50% | $K_1$ [pN, 20° C.]: | 12.9 |
| CDUQU-3-F | 0.05% | $K_3$ [pN, 20° C.]: | 15.7 |

-continued

| | | | |
|---|---|---|---|
| CC-3-V | 38.95% | $V_0$ [20° C., V]: | 1.29 |
| CCP-V-1 | 10.50% | | |
| CCP-V2-1 | 9.00% | | |
| PGP-2-3 | 2.00% | | |
| CCY-3-O2 | 3.50% | | |
| CPY-3-O2 | 3.50% | | |

Example 117

| | | | |
|---|---|---|---|
| CC-3-V | 35.00% | Clearing point [° C.]: | 84.6 |
| CCY-3-O1 | 9.00% | Δn [589 nm, 20° C.]: | 0.1010 |
| CCY-3-O2 | 8.00% | Δε [1 kHz, 20° C.]: | −4.0 |
| CCY-4-O2 | 5.00% | $\varepsilon_{\parallel}$ [1 kHz, 20° C.]: | 3.6 |
| CLY-3-O3 | 11.00% | $\varepsilon_{\perp}$ [1 kHz, 20° C.]: | 7.6 |
| CPY-2-O2 | 9.50% | $\gamma_1$ [mPa · s, 20° C.]: | 114 |
| CPY-3-O2 | 4.00% | $K_1$ [pN, 20° C.]: | 14.5 |
| CY-3-O2 | 6.50% | | |
| PY-3-O2 | 12.00% | | |

Example 117a

The mixture from Example 117 is additionally stabilised with 0.04% of

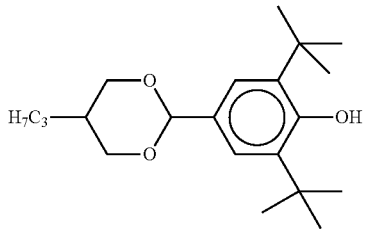

and 0.015% of

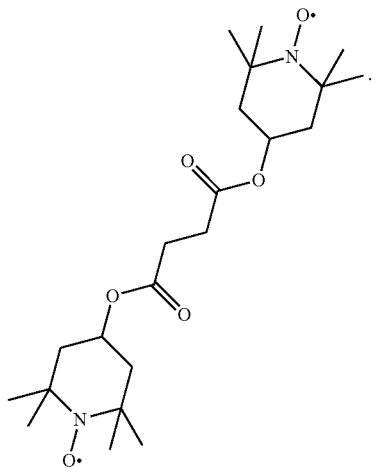

Example 118

| | | | |
|---|---|---|---|
| CC-3-V | 33.00% | Clearing point [° C.]: | 84 |
| CCY-3-O1 | 7.00% | Δn [589 nm, 20° C.]: | 0.1111 |
| CCY-3-O2 | 7.00% | Δε [1 kHz, 20° C.]: | −4.0 |
| CCY-4-O2 | 5.00% | $\varepsilon_{\parallel}$ [1 kHz, 20° C.]: | 3.7 |
| CLY-3-O3 | 11.00% | $\varepsilon_{\perp}$ [1 kHz, 20° C.]: | 7.6 |
| CPY-2-O2 | 9.00% | $\gamma_1$ [mPa · s, 20° C.]: | 119 |
| CPY-3-O2 | 8.00% | $K_1$ [pN, 20° C.]: | 14.8 |
| PP-1-2V1 | 1.50% | | |
| PY-1-O4 | 8.50% | | |
| PY-3-O2 | 10.00% | | |

Example 118a

The mixture from Example 118 is additionally stabilised with
0.04% of

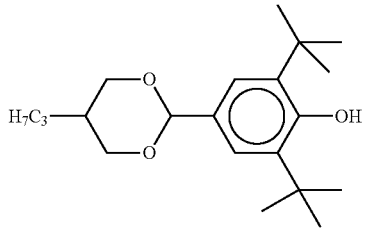

and
0.015% of

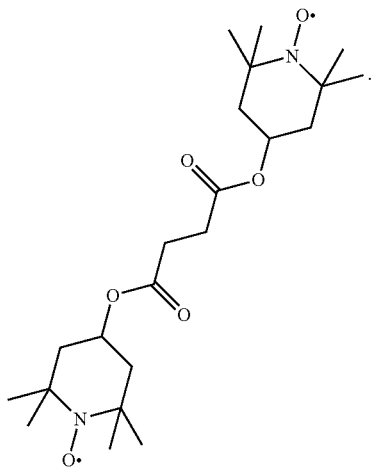

Example 119

| | | | |
|---|---|---|---|
| APUQU-2-F | 4.00% | Clearing point [° C.]: | 85.6 |
| APUQU-3-F | 7.00% | Δn [589 nm, 20° C.]: | 0.1021 |
| PUQU-3-F | 5.00% | Δε [1 kHz, 20° C.]: | 6.9 |
| PGUQU-3-F | 4.00% | $\varepsilon_{\parallel}$ [1 kHz, 20° C.]: | 10.0 |
| PGUQU-4-F | 3.00% | $\varepsilon_{\perp}$ [1 kHz, 20° C.]: | 3.1 |
| PGUQU-5-F | 3.00% | $\gamma_1$ [mPa · s, 20° C.]: | 71 |
| CCP-V-1 | 16.00% | $K_1$ [pN, 20° C.]: | 13.1 |
| CC-3-V | 40.00% | $K_3$ [pN, 20° C.]: | 15.3 |

-continued

| | | | |
|---|---|---|---|
| CC-3-V1 | 4.00% | $V_0$ [20° C., V]: | 1.45 |
| CC-4-V | 3.00% | | |
| PGP-2-3 | 4.00% | | |
| PGP-2-4 | 1.00% | | |
| PPGU-3-F | 1.00% | | |
| CCOC-4-3 | 5.00% | | |

Example 119a

The mixture from Example 119 is additionally mixed with 0.25% of RM-41

RM-41

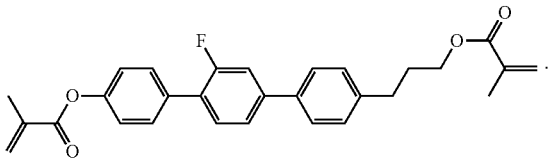

Example 119b

The mixture from Example 119 is additionally mixed with 0.3% of RM-17

RM-17

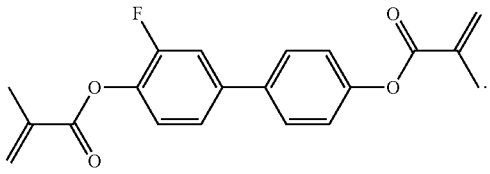

Example 120

| | | | |
|---|---|---|---|
| Y-4O-O4 | 12.00% | Clearing point [° C.]: | 101 |
| CY-3-O2 | 14.00% | Δn [589 nm, 20° C.]: | 0.1504 |
| CCY-3-O1 | 5.00% | Δε [1 kHz, 20° C.]: | −6.2 |
| CCY-3-O2 | 6.00% | $\varepsilon_{\parallel}$ [1 kHz, 20° C.]: | 4.5 |
| CCY-3-O3 | 6.00% | $\varepsilon_{\perp}$ [1 kHz, 20° C.]: | 10.7 |
| CCY-4-O2 | 6.00% | $\gamma_1$ [mPa · s, 20° C.]: | 281 |
| CPY-2-O2 | 2.50% | $K_1$ [pN, 20° C.]: | 15.7 |
| PTP-302FF | 10.00% | $K_3$ [pN, 20° C.]: | 19.9 |
| CPTP-302FF | 10.00% | $V_0$ [20° C., V]: | 1.90 |
| CPTP-502FF | 10.00% | | |
| CC-4-V | 2.50% | | |
| CCP-V-1 | 11.50% | | |
| CCPC-33 | 4.50% | | |

Example 121

| | | | |
|---|---|---|---|
| Y-4O-O4 | 12.00% | Clearing point [° C.]: | 100 |
| CCY-3-O1 | 5.00% | Δn [589 nm, 20° C.]: | 0.1496 |
| CCY-3-O2 | 6.00% | Δε [1 kHz, 20° C.]: | −4.1 |

-continued

| | | | |
|---|---|---|---|
| CCY-3-O3 | 6.00% | $\varepsilon_{\parallel}$ [1 kHz, 20° C.]: | 4.0 |
| CCY-4-O2 | 2.00% | $\varepsilon_{\perp}$ [1 kHz, 20° C.]: | 8.1 |
| CC-4-V | 15.00% | $\gamma_1$ [mPa · s, 20° C.]: | 180 |
| CCP-V-1 | 11.00% | $K_1$ [pN, 20° C.]: | 16.1 |
| CCP-V2-1 | 5.00% | $K_3$ [pN, 20° C.]: | 18.5 |
| BCH-32 | 5.00% | $V_0$ [20° C., V]: | 2.25 |
| PTP-302FF | 10.00% | | |
| PTP-502FF | 3.00% | | |
| CPTP-302FF | 10.00% | | |
| CPTP-502FF | 10.00% | | |

Example 122

| | | | |
|---|---|---|---|
| Y-4O-O4 | 10.00% | Clearing point [° C.]: | 100 |
| CCY-3-O1 | 2.50% | Δn [589 nm, 20° C.]: | 0.1515 |
| PTP-302FF | 10.00% | Δε [1 kHz, 20° C.]: | −2.1 |
| PTP-502FF | 3.50% | $\varepsilon_{\parallel}$ [1 kHz, 20° C.]: | 3.5 |
| CPTP-302FF | 10.00% | $\varepsilon_{\perp}$ [1 kHz, 20° C.]: | 5.6 |
| CPTP-502FF | 3.50% | $\gamma_1$ [mPa · s, 20° C.]: | 125 |
| CC-4-V | 15.00% | $K_1$ [pN, 20° C.]: | 16.6 |
| CC-3-V1 | 8.00% | $K_3$ [pN, 20° C.]: | 18.7 |
| CCP-V-1 | 12.00% | $V_0$ [20° C., V]: | 3.13 |
| CCP-V2-1 | 12.00% | | |
| BCH-32 | 5.00% | | |
| CPTP-3-1 | 5.00% | | |
| CPTP-3-2 | 3.50% | | |

Example 123

| | | | |
|---|---|---|---|
| Y-4O-O4 | 12.00% | Clearing point [° C.]: | 101 |
| CY-3-O2 | 6.00% | Δn [589 nm, 20° C.]: | 0.1218 |
| CY-3-O4 | 15.00% | Δε [1 kHz, 20° C.]: | −6.2 |
| CCY-3-O2 | 6.00% | $\varepsilon_{\parallel}$ [1 kHz, 20° C.]: | 4.5 |
| CCY-3-O3 | 6.00% | $\varepsilon_{\perp}$ [1 kHz, 20° C.]: | 10.7 |
| CCY-4-O2 | 6.00% | $\gamma_1$ [mPa · s, 20° C.]: | 302 |
| CLY-3-O2 | 5.00% | $K_1$ [pN, 20° C.]: | 15.7 |
| CPY-2-O2 | 8.00% | $K_3$ [pN, 20° C.]: | 18.9 |
| CPY-3-O2 | 8.00% | $V_0$ [20° C., V]: | 1.83 |
| CPTP-302FF | 4.00% | | |
| CPTP-502FF | 4.00% | | |
| CCP-V-1 | 11.00% | | |
| CCPC-33 | 4.50% | | |
| CCPC-34 | 4.50% | | |

Example 124

| | | | |
|---|---|---|---|
| Y-4O-O4 | 15.00% | Clearing point [° C.]: | 101 |
| CCY-3-O2 | 5.00% | Δn [589 nm, 20° C.]: | 0.1216 |
| CCY-3-O3 | 5.00% | Δε [1 kHz, 20° C.]: | −4.0 |
| CCY-4-O2 | 5.00% | $\varepsilon_{\parallel}$ [1 kHz, 20° C.]: | 4.0 |
| CLY-3-O2 | 4.00% | $\varepsilon_{\perp}$ [1 kHz, 20° C.]: | 8.0 |
| CPY-2-O2 | 8.00% | $\gamma_1$ [mPa · s, 20° C.]: | 167 |
| CPY-3-O2 | 8.00% | $K_1$ [pN, 20° C.]: | 16.1 |
| CPTP-302FF | 5.00% | $K_3$ [pN, 20° C.]: | 17.3 |
| CPTP-502FF | 5.00% | $V_0$ [20° C., V]: | 2.19 |
| CC-4-V | 13.50% | | |
| CCP-V-1 | 11.50% | | |
| CCP-V2-1 | 10.00% | | |
| BCH-32 | 5.00% | | |

Example 125

| | | | |
|---|---|---|---|
| Y-4O-O4 | 10.00% | Clearing point [° C.]: | 100 |
| CCY-3-O2 | 5.00% | Δn [589 nm, 20° C.]: | 0.1203 |
| CCY-3-O3 | 3.50% | Δε [1 kHz, 20° C.]: | −2.0 |
| CPY-3-O2 | 5.50% | $\varepsilon_{\parallel}$ [1 kHz, 20° C.]: | 3.4 |
| PTP-302FF | 3.50% | $\varepsilon_{\perp}$ [1 kHz, 20° C.]: | 5.4 |
| CPTP-302FF | 5.00% | $\gamma_1$ [mPa · s, 20° C.]: | 117 |
| CPTP-502FF | 5.00% | $K_1$ [pN, 20° C.]: | 15.6 |
| CCH-301 | 5.00% | $K_3$ [pN, 20° C.]: | 18.5 |
| CC-4-V | 15.00% | $V_0$ [20° C., V]: | 3.17 |
| CC-3-V1 | 8.00% | | |
| CCP-V-1 | 13.00% | | |
| CCP-V2-1 | 13.00% | | |
| BCH-32 | 5.00% | | |
| CPTP-3-1 | 3.50% | | |

Example 126

| | | | |
|---|---|---|---|
| BCH-32 | 16.00% | Clearing point [° C.]: | 10.5 |
| BCH-52 | 6.50% | Δn [589 nm, 20° C.]: | 0.1503 |
| CCY-3-O1 | 5.00% | Δε [1 kHz, 20° C.]: | −4.2 |
| CCY-3-O2 | 8.00% | $\varepsilon_{\parallel}$ [1 kHz, 20° C.]: | 3.8 |
| CCY-3-O3 | 6.00% | $\varepsilon_{\perp}$ [1 kHz, 20° C.]: | 8.0 |
| CCY-4-O2 | 8.00% | $\gamma_1$ [mPa · s, 20° C.]: | 297 |
| CCY-5-O2 | 7.00% | $K_1$ [pN, 20° C.]: | 18.3 |
| CY-3-O4 | 13.00% | $K_3$ [pN, 20° C.]: | 17.3 |
| PY-3-O2 | 5.50% | $V_0$ [20° C., V]: | 2.13 |
| PY-4-O2 | 9.00% | | |
| PYP-2-3 | 8.00% | | |
| PYP-2-4 | 8.00% | | |

Example 126a

The mixture from Example 126 is additionally stabilised with 0.015% of

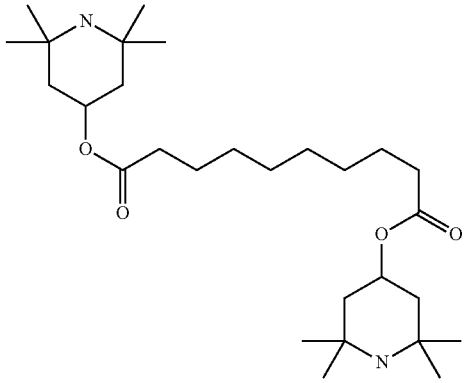

and
0.015% of

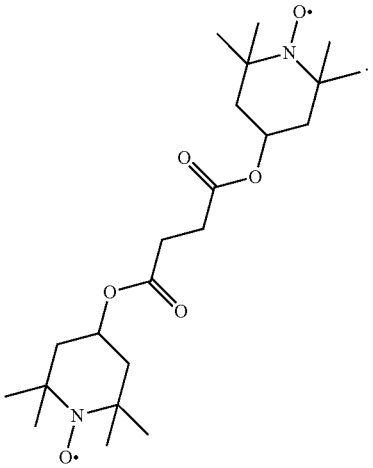

Example 127

| | | | |
|---|---|---|---|
| CC-3-V | 35.50% | Clearing point [° C.]: | 79.8 |
| CCY-3-O2 | 6.00% | Δn [589 nm, 20° C.]: | 0.0962 |
| CCY-3-O3 | 6.00% | Δε [1 kHz, 20° C.]: | −3.4 |
| CCY-4-O2 | 6.00% | $\varepsilon_{\parallel}$ [1 kHz, 20° C.]: | 3.6 |
| CCY-5-O2 | 3.50% | $\varepsilon_{\perp}$ [1 kHz, 20° C.]: | 7.0 |
| CPY-2-O2 | 10.00% | $\gamma_1$ [mPa · s, 20° C.]: | 111 |
| CPY-3-O2 | 9.00% | $K_1$ [pN, 20° C.]: | 13.3 |
| CY-3-O4 | 10.00% | $K_3$ [pN, 20° C.]: | 15.2 |
| CY-5-O2 | 9.00% | $V_0$ [20° C., V]: | 2.23 |
| PGIGI-3-F | 5.00% | | |

Example 128

| | | | |
|---|---|---|---|
| CC-3-V | 31.50% | Clearing point [° C.]: | 79.6 |
| CCP-V-1 | 5.00% | Δn [589 nm, 20° C.]: | 0.1044 |
| CCY-3-O2 | 6.00% | Δε [1 kHz, 20° C.]: | −3.4 |
| CCY-3-O3 | 6.00% | $\varepsilon_{\parallel}$ [1 kHz, 20° C.]: | 3.6 |
| CCY-4-O2 | 5.50% | $\varepsilon_{\perp}$ [1 kHz, 20° C.]: | 7.0 |
| CPY-2-O2 | 10.00% | $\gamma_1$ [mPa · s, 20° C.]: | 115 |
| CPY-3-O2 | 10.00% | $K_1$ [pN, 20° C.]: | 13.3 |
| CY-3-O4 | 7.00% | $K_3$ [pN, 20° C.]: | 15.2 |
| CY-5-O2 | 7.00% | $V_0$ [20° C., V]: | 2.24 |
| PGIGI-3-F | 5.00% | | |
| PY-3-O2 | 7.00% | | |

Example 129

| | | | |
|---|---|---|---|
| CC-3-V | 36.50% | Clearing point [° C.]: | 84.9 |
| CCP-V-1 | 3.00% | Δn [589 nm, 20° C.]: | 0.1054 |
| CCY-3-O1 | 6.50% | Δε [1 kHz, 20° C.]: | −3.5 |
| CCY-3-O2 | 3.50% | $\varepsilon_{\parallel}$ [1 kHz, 20° C.]: | 3.5 |
| CCY-4-O2 | 5.00% | $\varepsilon_{\perp}$ [1 kHz, 20° C.]: | 7.0 |
| CLY-3-O3 | 9.00% | $\gamma_1$ [mP · s, 20° C.]: | 108 |
| CPY-2-O2 | 11.00% | $K_1$ [pN, 20° C.]: | 14.4 |
| CPY-3-O2 | 9.00% | $K_3$ [pN, 20° C.]: | 15.7 |
| CY-3-O2 | 3.00% | $V_0$ [20° C., V]: | 2.24 |
| PY-3-O2 | 13.50% | | |

Example 130

| | | | |
|---|---|---|---|
| CC-3-V | 39.00% | Clearing point [° C.]: | 75.2 |
| BCH-3F.F.F | 8.00% | Δn [589 nm, 20° C.]: | 0.1298 |
| PGU-2-F | 6.00% | Δε [1 kHz, 20° C.]: | 18.3 |
| PGU-3-F | 6.00% | $\varepsilon_{\parallel}$ [1 kHz, 20° C.]: | 22.6 |
| APUQU-2-F | 6.00% | $\varepsilon_{\perp}$ [1 kHz, 20° C.]: | 4.3 |
| APUQU-3-F | 8.00% | $\gamma_1$ [mPa · s, 20° C.]: | 99 |
| PGUQU-3-F | 6.00% | $K_1$ [pN, 20° C.]: | 10.9 |
| PGUQU-4-F | 6.00% | $K_3$ [pN, 20° C.]: | 11.1 |
| PGUQU-5-F | 6.00% | $V_0$ [20° C., V]: | 0.81 |
| DPGU-4-F | 9.00% | | |

Example 131

| | | | |
|---|---|---|---|
| CC-3-V | 38.50% | Clearing point [° C.]: | 74.9 |
| CCY-3-O1 | 4.50% | Δn [589 nm, 20° C.]: | 0.1012 |
| CCY-3-O2 | 4.00% | Δε [1 kHz, 20° C.]: | −3.7 |
| CCY-4-O2 | 8.00% | $\varepsilon_{\parallel}$ [1 kHz, 20° C.]: | 3.7 |
| CLY-3-O2 | 8.00% | $\varepsilon_{\perp}$ [1 kHz, 20° C.]: | 7.4 |
| CPY-2-O2 | 10.00% | $\gamma_1$ [mPa · s, 20° C.]: | 94 |
| CPY-3-O2 | 9.00% | $K_1$ [pN, 20° C.]: | 13.4 |
| PY-1-O4 | 7.50% | $K_3$ [pN, 20° C.]: | 14.4 |
| PY-3-O2 | 6.00% | $V_0$ [20° C., V]: | 2.08 |
| Y-4O-O4 | 4.50% | LTS (bulk) [−20° C.] | >1000 h |

Example 131a

The mixture from Example 131 is additionally mixed with 0.25% of

RM-41

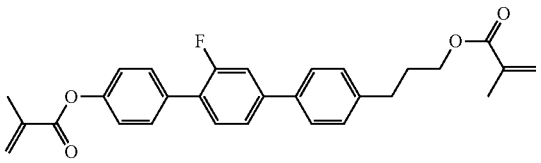

and
0.25% of

RM-35

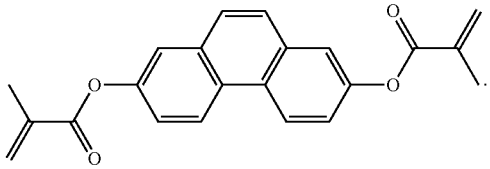

Example 132

| | | | |
|---|---|---|---|
| CC-3-V | 40.50% | Clearing point [° C.]: | 74.8 |
| CC-3-V1 | 5.00% | Δn [589 nm, 20° C.]: | 0.1073 |
| CCPC-33 | 3.00% | Δε [1 kHz, 20° C.]: | −1.9 |
| CCY-3-O2 | 9.00% | $\varepsilon_{\parallel}$ [1 kHz, 20° C.]: | 3.2 |
| CPY-2-O2 | 9.00% | $\varepsilon_{\perp}$ [1 kHz, 20° C.]: | 5.2 |

-continued

| | | | |
|---|---|---|---|
| CPY-3-O2 | 9.50% | $\gamma_1$ [mPa · s, 20° C.]: | 63 |
| PP-1-2V1 | 6.00% | $K_1$ [pN, 20° C.]: | 12.6 |
| PY-3-O2 | 7.00% | $K_3$ [pN, 20° C.]: | 14.1 |
| PYP-2-3 | 8.00% | $V_0$ [20° C., V]: | 2.86 |
| Y-4O-O4 | 3.00% | | |

Example 132a

The mixture from Example 132 is additionally stabilised with
0.04% of

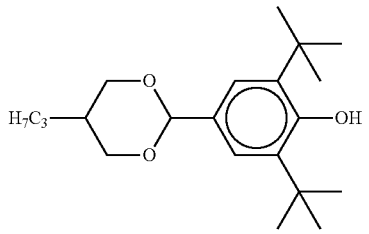

and
0.02% of

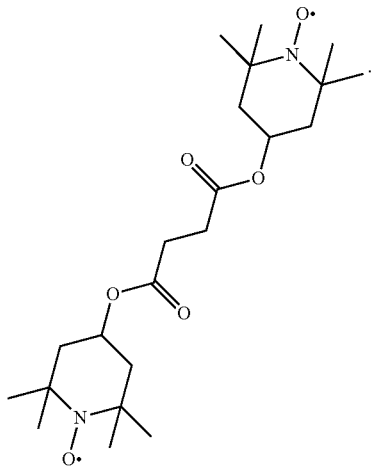

Example 133

| | | | |
|---|---|---|---|
| APUQU-2-F | 2.50% | Clearing point [° C.]: | 97.5 |
| APUQU-3-F | 7.00% | Δn [589 nm, 20° C.]: | 0.1000 |
| PGUQU-3-F | 4.00% | Δε [1 kHz, 20° C.]: | 8.0 |
| PGUQU-4-F | 4.00% | $\varepsilon_{\parallel}$ [1 kHz, 20° C.]: | 11.1 |
| PUQU-3-F | 4.00% | $\varepsilon_{\perp}$ [1 kHz, 20° C.]: | 3.1 |
| CCP-V-1 | 6.00% | $\gamma_1$ [mPa · s, 20° C.]: | 93 |
| CCP-V2-1 | 14.00% | $K_1$ [pN, 20° C.]: | 15.3 |
| CCGU-3-F | 3.50% | $K_3$ [pN, 20° C.]: | 17.6 |
| CCQU-3-F | 10.00% | $V_0$ [20° C., V]: | 1.45 |
| PCH-302 | 6.50% | | |
| CC-3-V | 25.00% | | |
| CC-3-V1 | 8.00% | | |
| CCP-30CF$_3$ | 5.00% | | |
| PPGU-3-F | 0.50% | | |

Example 133a

The mixture from Example 133 is additionally mixed with 0.25% of

RM-41

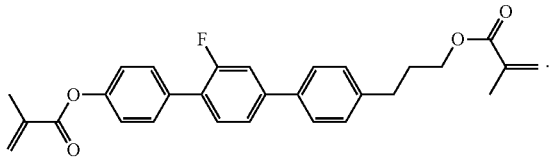

Example 134

| | | | |
|---|---|---|---|
| CY-3-O2 | 18.50% | Clearing point [° C.]: | 80 |
| CCY-3-O2 | 11.00% | Δn [589 nm, 20° C.]: | 0.0896 |
| CCY-4-O2 | 9.00% | Δε [1 kHz, 20° C.]: | −3.4 |
| CPY-2-O2 | 7.50% | $\varepsilon_{\parallel}$ [1 kHz, 20° C.]: | 3.5 |
| CPY-3-O2 | 9.00% | $\varepsilon_{\perp}$ [1 kHz, 20° C.]: | 6.9 |
| CCH-34 | 9.00% | $\gamma_1$ [mPa · s, 20° C.]: | 117 |
| CCH-35 | 9.00% | $K_1$ [pN, 20° C.]: | 14.4 |
| CC-3-V | 10.00% | $K_3$ [pN, 20° C.]: | 15.1 |
| CCH-301 | 9.00% | $V_0$ [20° C., V]: | 2.23 |
| CCH-303 | 5.00% | | |
| PYP-2-3 | 3.00% | | |

Example 134a

The mixture from Example 134 is additionally mixed with 0.2% of

RM-1

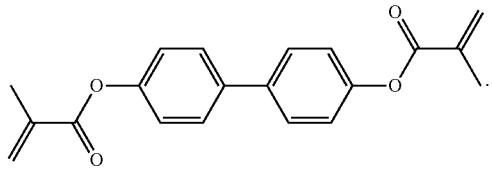

Example 135

| | | | |
|---|---|---|---|
| CY-3-O2 | 10.50% | Clearing point [° C.]: | 79.7 |
| PY-1-O4 | 5.00% | Δn [589 nm, 20° C.]: | 0.1113 |
| PY-3-O2 | 7.50% | Δε [1 kHz, 20° C.]: | −4.4 |
| PY-4-O2 | 4.00% | $K_1$ [pN, 20° C.]: | 14.5 |
| CCY-3-O1 | 5.50% | $K_3$ [pN, 20° C.]: | 16.7 |
| CCY-3-O2 | 5.00% | $V_0$ [20° C., V]: | 2.05 |
| CCY-4-O2 | 4.00% | | |
| CLY-3-O2 | 9.00% | | |
| CPY-2-O2 | 9.00% | | |
| CPY-3-O2 | 9.00% | | |
| CC-3-V | 23.50% | | |
| CC-3-V1 | 7.00% | | |
| CBC-33F | 1.00% | | |

Example 136

| | | | |
|---|---|---|---|
| APUQU-3-F | 3.00% | Clearing point [° C.]: | 90.5 |
| CC-3-V1 | 7.75% | Δn [589 nm, 20° C.]: | 0.1057 |
| CC-4-V | 10.00% | Δε [1 kHz, 20° C.]: | 7.4 |
| CC-5-V | 9.25% | $\gamma_1$ [mPa · s, 20° C.]: | 91 |
| CCGU-3-F | 7.00% | $K_1$ [pN, 20° C.]: | 13.6 |
| CCH-34 | 3.00% | $K_3$ [pN, 20° C.]: | 15.5 |
| CCP-30CF$_3$ | 2.50% | $V_0$ [20° C., V]: | 1.43 |
| CCP-V-1 | 14.00% | | |
| CCP-V2-1 | 9.50% | | |
| PCH-301 | 11.00% | | |
| PGP-2-2V | 2.00% | | |
| PGUQU-3-F | 5.00% | | |
| PPGU-3-F | 0.50% | | |
| PUQU-3-F | 12.00% | | |
| APUQU-2-F | 3.50% | | |

Example 137

| | | | |
|---|---|---|---|
| CC-3-V | 27.00% | Clearing point [° C.]: | 74.9 |
| CCY-3-1 | 9.50% | Δn [589 nm, 20° C.]: | 0.1093 |
| CCP-3-1 | 8.00% | Δε [1 kHz, 20° C.]: | −3.8 |
| CLY-3-O2 | 6.00% | $\varepsilon_{\parallel}$ [1 kHz, 20° C.]: | 3.7 |
| CPY-2-O2 | 10.50% | $\varepsilon_{\perp}$ [1 kHz, 20° C.]: | 7.5 |
| CPY-3-O2 | 10.50% | $\gamma_1$ [mPa · s, 20° C.]: | 108 |
| CY-3-O2 | 15.00% | $K_1$ [pN, 20° C.]: | 14.1 |
| PY-3-O2 | 13.50% | $K_3$ [pN, 20° C.]: | 15.8 |
| | | $V_0$ [20° C., V]: | 2.16 |

Example 138

| | | | |
|---|---|---|---|
| CC-3-V | 16.00% | Clearing point [° C.]: | 85.4 |
| CC-3-V1 | 5.00% | Δn [589 nm, 20° C.]: | 0.1060 |
| CCH-34 | 7.00% | Δε [1 kHz, 20° C.]: | −3.7 |
| CCP-3-1 | 1.00% | $\varepsilon_{\parallel}$ [1 kHz, 20° C.]: | 3.6 |
| CCY-3-O1 | 6.00% | $\varepsilon_{\perp}$ [1 kHz, 20° C.]: | 7.4 |
| CCY-3-O2 | 7.50% | $\gamma_1$ [mPa · s, 20° C.]: | 114 |
| CCY-3-O3 | 2.00% | $K_1$ [pN, 20° C.]: | 13.4 |
| CCY-4-O2 | 5.00% | $K_3$ [pN, 20° C.]: | 14.5 |
| CPY-2-O2 | 10.00% | $V_0$ [20° C., V]: | 2.09 |
| CPY-3-O2 | 9.00% | | |
| CY-3-O2 | 10.00% | | |
| CY-3-O4 | 6.50% | | |
| CY-5-O4 | 6.00% | | |
| PYP-2-3 | 5.50% | | |
| PYP-2-4 | 3.50% | | |

Example 138a

The mixture from Example 138 is additionally stabilised with
0.04% of

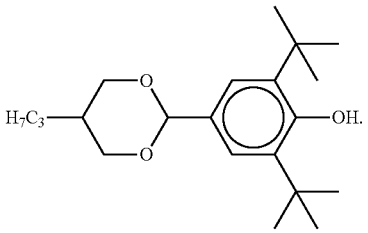

Example 139

| | | | |
|---|---|---|---|
| CCH-23 | 12.00% | Clearing point [° C.]: | 110.7 |
| CCH-34 | 10.00% | Δn [589 nm, 20° C.]: | 0.1002 |
| CCP-3-1 | 7.00% | Δε [1 kHz, 20° C.]: | −2.9 |
| CCY-3-1 | 10.00% | $\varepsilon_{\parallel}$ [1 kHz, 20° C.]: | 3.2 |
| CCY-3-O1 | 1.50% | $\varepsilon_{\perp}$ [1 kHz, 20° C.]: | 6.1 |
| CCY-3-O2 | 9.00% | $\gamma_1$ [mPa · s, 20° C.]: | 147 |
| CCY-3-O3 | 7.50% | $K_1$ [pN, 20° C.]: | 17.3 |
| CCY-4-O2 | 9.00% | $K_3$ [pN, 20° C.]: | 18.3 |
| CPGP-4-3 | 2.00% | $V_0$ [20° C., V]: | 2.65 |
| CPY-2-O2 | 8.00% | | |
| CPY-3-O2 | 8.00% | | |
| CY-3-O2 | 1.50% | | |
| CY-3-O4 | 3.00% | | |
| PCH-301 | 10.00% | | |
| PYP-2-3 | 1.50% | | |

Example 139a

The mixture from Example 139 is additionally stabilised with
0.04% of

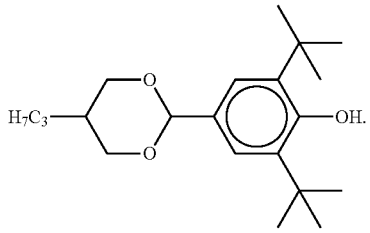

Example 140

| | | | |
|---|---|---|---|
| BCH-32 | 1.50% | Clearing point [° C.]: | 74.3 |
| CC-3-V | 19.50% | Δn [589 nm, 20° C.]: | 0.1089 |
| CC-3-V1 | 5.50% | Δε [1 kHz, 20° C.]: | −3.8 |
| CCP-3-1 | 8.00% | $\varepsilon_{\parallel}$ [1 kHz, 20° C.]: | 3.7 |
| CCP-3-3 | 4.50% | $\varepsilon_{\perp}$ [1 kHz, 20° C.]: | 7.5 |
| CLY-3-O2 | 6.00% | $\gamma_1$ [mPa · s, 20° C.]: | 115 |
| CPY-2-O2 | 10.50% | $K_1$ [pN, 20° C.]: | 13.7 |
| CPY-3-O2 | 10.50% | $K_3$ [pN, 20° C.]: | 16.1 |
| CY-3-O2 | 15.00% | $V_0$ [20° C., V]: | 2.18 |
| CY-5-O2 | 9.00% | | |
| PY-3-O2 | 10.00% | | |

Example 141

| | | | |
|---|---|---|---|
| CY-3-O2 | 15.00% | Clearing point [° C.]: | 74.7 |
| CY-5-O2 | 6.50% | Δn [589 nm, 20° C.]: | 0.1082 |
| CCY-3-O2 | 11.00% | Δε [1 kHz, 20° C.]: | −3.0 |
| CPY-2-O2 | 5.50% | $\varepsilon_{\parallel}$ [1 kHz, 20° C.]: | 3.6 |
| CPY-3-O2 | 10.50% | $\varepsilon_{\perp}$ [1 kHz, 20° C.]: | 6.6 |
| CC-3-V | 28.50% | $\gamma_1$ [mPa · s, 20° C.]: | 97 |
| CC-3-V1 | 10.00% | $K_1$ [pN, 20° C.]: | 12.9 |
| PYP-2-3 | 12.50% | $K_3$ [pN, 20° C.]: | 15.7 |
| PPGU-3-F | 0.50% | $V_0$ [20° C., V]: | 2.42 |

Example 142

| | | | |
|---|---|---|---|
| PGUQU-3-F | 5.00% | Clearing point [° C.]: | 84.8 |
| CCQU-3-F | 8.00% | Δn [589 nm, 20° C.]: | 0.1035 |
| CCQU-5-F | 4.00% | Δε [1 kHz, 20° C.]: | 10.1 |
| PUQU-3-F | 13.50% | $\varepsilon_{\parallel}$ [1 kHz, 20° C.]: | 13.5 |
| APUQU-2-F | 3.00% | $\varepsilon_{\perp}$ [1 kHz, 20° C.]: | 3.4 |
| APUQU-3-F | 6.00% | $\gamma_1$ [mPa · s, 20° C.]: | 86 |
| CC-3-V | 25.50% | $K_1$ [pN, 20° C.]: | 12.3 |
| CC-3-V1 | 6.00% | $K_3$ [pN, 20° C.]: | 15.0 |
| CCP-V-1 | 13.00% | $V_0$ [20° C., V]: | 1.17 |
| CCP-V2-1 | 6.00% | | |
| PPGU-3-F | 0.50% | | |
| BCH-3F.F | 7.50% | | |
| BCH-2F.F | 2.00% | | |

Example 142a

The mixture from Example 142 is additionally mixed with 0.25% of

RM-35

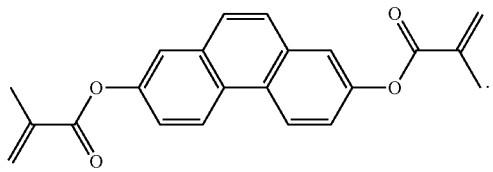

Example 143

| | | | |
|---|---|---|---|
| CY-3-O2 | 12.00% | Clearing point [° C.]: | 85.4 |
| CY-5-O2 | 12.00% | Δn [589 nm, 20° C.]: | 0.1039 |
| CCY-3-O3 | 5.00% | | |
| CCY-4-O2 | 5.00% | | |
| CPY-2-O2 | 10.00% | | |
| CPY-3-O2 | 10.00% | | |
| CCY-2-1 | 4.00% | | |
| CC-3-V | 16.00% | | |
| CCH-23 | 10.00% | | |
| CCH-34 | 4.00% | | |
| CCP-V-1 | 4.00% | | |
| PGP-2-5 | 2.00% | | |
| CPGP-5-2 | 3.00% | | |
| CPGP-5-3 | 3.00% | | |

Example 144

| | | | |
|---|---|---|---|
| CC-3-V | 41.50% | Clearing point [° C.]: | 74.5 |
| CCY-3-O1 | 2.50% | Δn [589 nm, 20° C.]: | 0.0984 |
| CCY-3-O2 | 11.50% | Δε [1 kHz, 20° C.]: | −3.3 |
| CCY-3-O3 | 5.00% | $\varepsilon_{\parallel}$ [1 kHz, 20° C.]: | 3.5 |
| CPY-2-O2 | 5.00% | $\varepsilon_{\perp}$ [1 kHz, 20° C.]: | 6.7 |
| CPY-3-O2 | 12.00% | $\gamma_1$ [mPa · s, 20° C.]: | 89 |
| CY-3-O2 | 9.50% | $K_1$ [pN, 20° C.]: | 13.2 |
| PY-3-O2 | 7.00% | $K_3$ [pN, 20° C.]: | 15.2 |
| PY-4-O2 | 3.00% | $V_0$ [20° C., V]: | 2.29 |
| PYP-2-3 | 3.00% | | |

Example 144a

The mixture from Example 144 is additionally mixed with 0.001% of Irganox® 1076 (octadecyl 3-(3,5-di-tert-butyl-4-hydroxyphenyl)propionate, BASF) and additionally with 0.4% of

RM-8

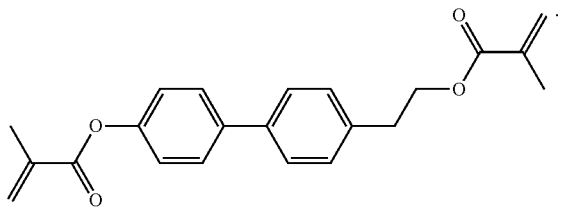

Example 145

| | | | |
|---|---|---|---|
| CC-3-V | 30.50% | Clearing point [° C.]: | 80.1 |
| CC-3-V1 | 4.50% | Δn [589 nm, 20° C.]: | 0.1033 |
| CCY-3-O1 | 6.00% | Δε [1 kHz, 20° C.]: | −4.0 |
| CCY-3-O2 | 8.00% | $\varepsilon_{\parallel}$ [1 kHz, 20° C.]: | 3.6 |
| CLY-3-O2 | 8.00% | $\varepsilon_{\perp}$ [1 kHz, 20° C.]: | 7.6 |
| CPY-2-O2 | 8.00% | $\gamma_1$ [mPa · s, 20° C.]: | 113 |
| CPY-3-O2 | 12.00% | $K_1$ [pN, 20° C.]: | 14.4 |
| CY-3-O2 | 15.00% | $K_3$ [pN, 20° C.]: | 17.0 |
| PY-3-O2 | 8.00% | $V_0$ [20° C., V]: | 2.16 |

Example 146

| | | | |
|---|---|---|---|
| CC-3-V | 41.50% | Clearing point [° C.]: | 74.5 |
| CCY-3-O1 | 2.50% | Δε [1 kHz, 20° C.]: | −3.3 |
| CCY-3-O2 | 11.50% | $K_1$ [pN, 20° C.]: | 13.2 |
| CCY-3-O3 | 5.00% | $K_3$ [pN, 20° C.]: | 15.2 |
| CPY-2-O2 | 5.00% | $V_0$ [20° C., V]: | 2.29 |
| CPY-3-O2 | 12.00% | | |
| CY-3-O2 | 9.50% | | |
| PY-3-O2 | 7.00% | | |
| PY-4-O2 | 3.00% | | |
| PYP-2-3 | 3.00% | | |

Example 147

| | | | |
|---|---|---|---|
| CC-3-V | 26.00% | Clearing point [° C.]: | 80.5 |
| CCY-3-O2 | 6.00% | Δn [589 nm, 20° C.]: | 0.1040 |
| CCY-3-O3 | 6.00% | Δε [1 kHz, 20° C.]: | −4.0 |
| CCY-4-O2 | 6.00% | $\varepsilon_{\parallel}$ [1 kHz, 20° C.]: | 3.7 |
| CCY-5-O2 | 6.00% | $\varepsilon_{\perp}$ [1 kHz, 20° C.]: | 7.7 |
| CPY-2-O2 | 6.00% | $\gamma_1$ [mPa · s, 20° C.]: | 133 |
| CPY-3-O2 | 6.00% | $K_1$ [pN, 20° C.]: | 13.6 |
| PYP-2-3 | 7.00% | $K_3$ [pN, 20° C.]: | 15.4 |
| CY-3-O2 | 15.00% | $V_0$ [20° C., V]: | 2.07 |
| CY-5-O2 | 12.00% | LTS (bulk) [−20° C.] | >1000 h |
| BCH-32 | 4.00% | | |

Example 147a

The mixture from Example 147 is additionally mixed with 0.3% of

RM-1

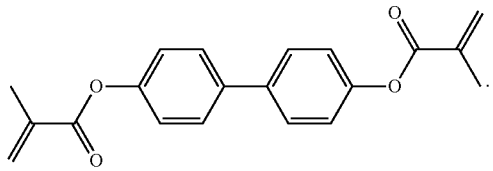

Example 148

| | | | |
|---|---|---|---|
| CC-3-V | 26.50% | Clearing point [° C.]: | 84.6 |
| CC-3-V1 | 2.00% | Δn [589 nm, 20° C.]: | 0.1076 |
| CCH-34 | 2.00% | Δε [1 kHz, 20° C.]: | −4.0 |
| CCY-3-O2 | 10.00% | $\epsilon_{\parallel}$ [1 kHz, 20° C.]: | 3.7 |
| CCY-3-O3 | 5.00% | $\epsilon_{\perp}$ [1 kHz, 20° C.]: | 7.7 |
| CCY-4-O2 | 10.00% | $\gamma_1$ [mPa · s, 20° C.]: | 129 |
| CPY-2-O2 | 10.00% | $K_1$ [pN, 20° C.]: | 13.9 |
| CPY-3-O2 | 10.00% | $K_3$ [pN, 20° C.]: | 15.4 |
| CY-3-O2 | 10.50% | $V_0$ [20° C., V]: | 2.06 |
| PYP-2-3 | 9.00% | | |
| Y-4O-O4 | 5.00% | | |

Example 148a

The mixture from Example 148 is additionally stabilised with
0.04% of

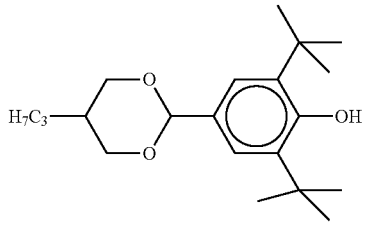

and
0.015% of

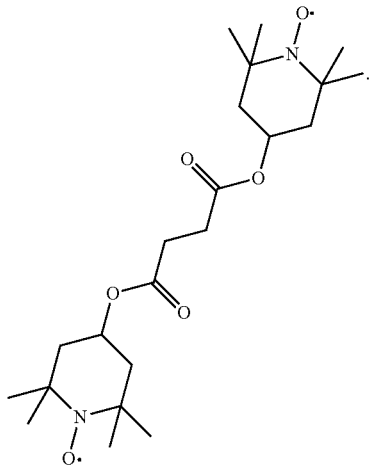

Example 149

| | | | |
|---|---|---|---|
| APUQU-3-F | 1.50% | Clearing point [° C.]: | 110.1 |
| CC-3-V | 34.00% | Δn [589 nm, 20° C.]: | 0.1208 |
| CC-3-V1 | 5.00% | Δε [1 kHz, 20° C.]: | 6.2 |
| CCP-30CF$_3$ | 4.50% | $\varepsilon_{\parallel}$ [1 kHz, 20° C.]: | 9.2 |
| CCP-V-1 | 10.50% | $\varepsilon_{\perp}$ [1 kHz, 20° C.]: | 3.0 |
| CCP-V2-1 | 6.00% | $\gamma_1$ [mPa · s, 20° C.]: | 104 |
| CCVC-3-V | 3.50% | $K_1$ [pN, 20° C.]: | 16.3 |
| CPGP-5-2 | 4.50% | $K_3$ [pN, 20° C.]: | 18.9 |
| CPGP-5-3 | 4.50% | $V_0$ [20° C., V]: | 1.70 |
| DGUQU-4-F | 3.00% | | |
| PGP-2-3 | 4.00% | | |
| PGP-2-4 | 2.00% | | |
| PGUQU-3-F | 5.00% | | |
| PGUQU-4-F | 3.50% | | |
| PGUQU-5-F | 3.00% | | |
| PPGU-3-F | 0.50% | | |
| PUQU-3-F | 5.00% | | |

Example 150

| | | | |
|---|---|---|---|
| APUQU-3-F | 1.50% | Clearing point [° C.]: | 110 |
| CC-3-V | 35.50% | Δn [589 nm, 20° C.]: | 0.1257 |
| CCP-30CF$_3$ | 4.00% | Δε [1 kHz, 20° C.]: | 6.3 |
| CCP-V-1 | 12.00% | $\varepsilon_{\parallel}$ [1 kHz, 20° C.]: | 9.3 |
| CCP-V2-1 | 4.50% | $\varepsilon_{\perp}$ [1 kHz, 20° C.]: | 3.0 |
| CCVC-3-V | 4.00% | $\gamma_1$ [mPa · s, 20° C.]: | 104 |
| CPGP-5-2 | 5.00% | $K_1$ [pN, 20° C.]: | 16.1 |
| CPGP-5-3 | 5.00% | $K_3$ [pN, 20° C.]: | 18.7 |
| DGUQU-4-F | 3.00% | $V_0$ [20° C., V]: | 1.69 |
| PGP-2-3 | 4.00% | | |
| PGP-2-4 | 2.00% | | |
| PGUQU-3-F | 5.00% | | |
| PGUQU-4-F | 3.50% | | |
| PGUQU-5-F | 3.00% | | |
| PPGU-3-F | 0.50% | | |
| PUQU-3-F | 5.00% | | |
| PP-1-2V1 | 2.50% | | |

Example 151

| | | | |
|---|---|---|---|
| CY-3-O2 | 5.00% | Clearing point [° C.]: | 102 |
| CY-3-O4 | 15.00% | Δn [589 nm, 20° C.]: | 0.2503 |
| CCY-3-O2 | 6.00% | Δε [1 kHz, 20° C.]: | −4.0 |
| CCY-3-O3 | 6.00% | $\varepsilon_{\parallel}$ [1 kHz, 20° C.]: | 4.3 |
| CPY-2-O2 | 3.00% | $\varepsilon_{\perp}$ [1 kHz, 20° C.]: | 8.3 |
| PTP-102 | 5.00% | $\gamma_1$ [mPa · s, 20° C.]: | 392 |
| PPTUI-3-2 | 15.00% | $K_1$ [pN, 20° C.]: | 19.5 |
| PPTUI-3-4 | 11.00% | $K_3$ [pN, 20° C.]: | 24.0 |
| PTP-302FF | 12.00% | $V_0$ [20° C., V]: | 2.57 |
| PTP-502FF | 12.00% | | |
| CPTP-302FF | 5.00% | | |
| CPTP-502FF | 5.00% | | |

Example 152

| | | | |
|---|---|---|---|
| CC-3-V | 35.00% | Clearing point [° C.]: | 79.6 |
| CCP-3-1 | 7.50% | Δn [589 nm, 20° C.]: | 0.1095 |
| CCPC-33 | 2.00% | Δε [1 kHz, 20° C.]: | −2.6 |
| CCY-3-O2 | 7.00% | $\varepsilon_{\parallel}$ [1 kHz, 20° C.]: | 3.5 |

-continued

| | | | |
|---|---|---|---|
| CCY-4-O2 | 7.50% | $\varepsilon_{\perp}$ [1 kHz, 20° C.]: | 6.1 |
| CPY-2-O2 | 8.50% | $\gamma_1$ [mPa · s, 20° C.]: | 92 |
| CPY-3-O2 | 9.00% | $K_1$ [pN, 20° C.]: | 14.5 |
| PP-1-2V1 | 5.50% | | |
| PY-3-O2 | 8.00% | | |
| PYP-2-3 | 5.00% | | |
| Y-4O-O4 | 5.00% | | |

Example 152a

The mixture from Example 152 is additionally stabilised with 0.04% of

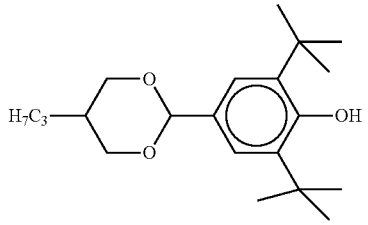

and 0.02% of

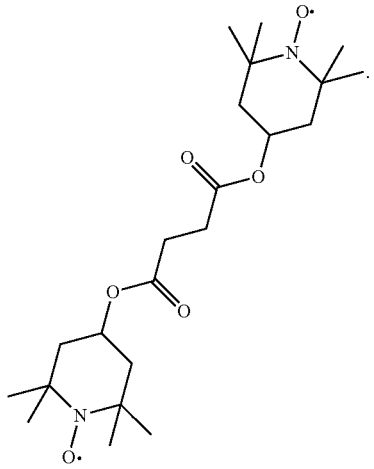

Example 153

| | | | |
|---|---|---|---|
| CY-3-O4 | 25.00% | Clearing point [° C.]: | 81.2 |
| CY-5-O2 | 9.00% | Δn [589 nm, 20° C.]: | 0.1531 |
| CCY-3-O2 | 7.00% | Δε [1 kHz, 20° C.]: | −5.0 |
| CCY-3-O3 | 4.50% | $\varepsilon_{\parallel}$ [1 kHz, 20° C.]: | 4.1 |
| CPY-2-O2 | 10.00% | $\varepsilon_{\perp}$ [1 kHz, 20° C.]: | 9.1 |
| CPY-3-O2 | 10.00% | $\gamma_1$ [mPa · s, 20° C.]: | 298 |
| PYP-2-3 | 14.00% | $K_1$ [pN, 20° C.]: | 13.1 |
| PYP-2-4 | 10.00% | $K_3$ [pN, 20° C.]: | 15.9 |
| CCP-V-1 | 3.00% | $V_0$ [20° C., V]: | 1.89 |
| BCH-32 | 2.00% | | |
| PP-1-2V1 | 3.50% | | |
| PGP-2-3 | 2.00% | | |

Example 153a

The mixture from Example 153 is additionally mixed with 10% of

RM-82

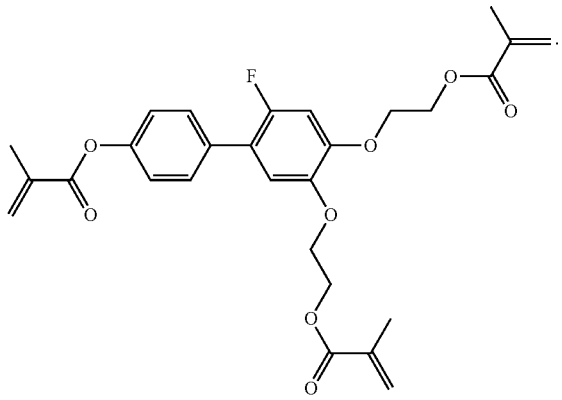

Example 154

| | | | |
|---|---|---|---|
| CC-3-V | 29.00% | Clearing point [° C.]: | 80.1 |
| CCY-3-O1 | 8.00% | Δn [589 nm, 20° C.]: | 0.1033 |
| CCY-3-O2 | 6.00% | Δε [1 kHz, 20° C.]: | −4.5 |
| CCY-4-O2 | 2.00% | $\epsilon_{\parallel}$ [1 kHz, 20° C.]: | 4.0 |
| CLY-3-O2 | 8.50% | $\epsilon_{\perp}$ [1 kHz, 20° C.]: | 8.4 |
| CLY-3-O3 | 7.50% | $\gamma_1$ [mPa · s, 20° C.]: | 98 |
| CPY-2-O2 | 10.00% | $K_1$ [pN, 20° C.]: | 13.2 |
| CPY-3-O2 | 7.50% | $K_3$ [pN, 20° C.]: | 14.6 |
| CY-3-O2 | 6.50% | $V_0$ [20° C., V]: | 1.91 |
| PY-3-O2 | 10.00% | | |
| Y-4O-O4 | 5.00% | | |

Example 154a

The mixture from Example 154 is additionally stabilised with 0.04% of

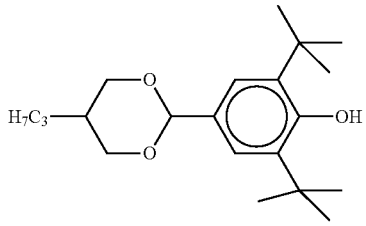

and 0.02% of

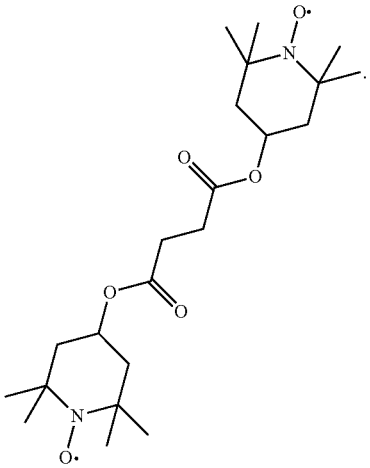

Example 155

| | | | |
|---|---|---|---|
| CC-3-V | 34.00% | Clearing point [° C.]: | 79.7 |
| CCPC-33 | 1.00% | Δn [589 nm, 20° C.]: | 0.1095 |
| CCY-3-1 | 4.00% | Δε [1 kHz, 20° C.]: | −3.5 |
| CCY-3-O2 | 10.00% | $\epsilon_{\parallel}$ [1 kHz, 20° C.]: | 3.7 |
| CCY-4-O2 | 9.50% | $\epsilon_{\perp}$ [1 kHz, 20° C.]: | 7.2 |
| CPY-2-O2 | 9.00% | $\gamma_1$ [mPa · s, 20° C.]: | 105 |
| CPY-3-O2 | 10.00% | $K_1$ [pN, 20° C.]: | 14.0 |
| PP-1-2V1 | 1.50% | | |
| PY-3-O2 | 10.00% | | |
| PYP-2-3 | 6.00% | | |
| Y-4O-O4 | 5.00% | | |

Example 155a

The mixture from Example 155 is additionally stabilised with 0.04% of

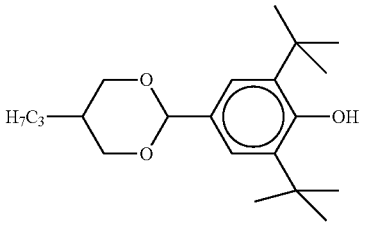

and 0.02% of

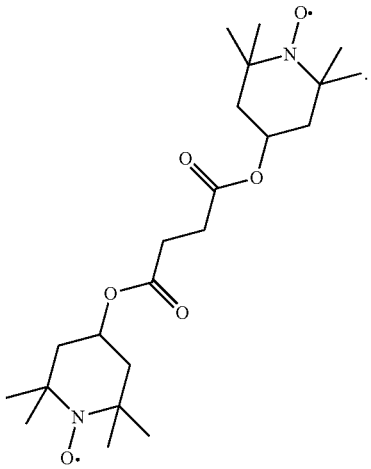

Example 156

| | | | |
|---|---|---|---|
| CC-3-V | 19.00% | Clearing point [° C.]: | 80.2 |
| CCY-3-O1 | 5.00% | Δn [589 nm, 20° C.]: | 0.1104 |
| CCY-3-O2 | 7.00% | Δε [1 kHz, 20° C.]: | −3.7 |
| CCY-3-O3 | 12.00% | $\epsilon_{\parallel}$ [1 kHz, 20° C.]: | 3.6 |
| CCY-4-O2 | 8.00% | $\epsilon_{\perp}$ [1 kHz, 20° C.]: | 7.3 |
| CPY-2-O2 | 9.50% | $\gamma_1$ [mPa · s, 20° C.]: | 143 |
| CPY-3-O2 | 10.00% | $K_1$ [pN, 20° C.]: | 12.9 |
| CY-3-O2 | 12.00% | $K_3$ [pN, 20° C.]: | 14.5 |
| CY-3-O4 | 3.50% | $V_0$ [20° C., V]: | 2.09 |
| PP-1-3 | 7.00% | | |
| PP-1-4 | 7.00% | | |

Example 157

| | | | |
|---|---|---|---|
| CY-3-O2 | 15.00% | Clearing point [° C.]: | 79.1 |
| CY-5-O2 | 9.50% | Δn [589 nm, 20° C.]: | 0.0944 |
| CCY-3-O1 | 4.00% | Δε [1 kHz, 20° C.]: | −4.0 |
| CCY-3-O2 | 6.00% | $\epsilon_{\parallel}$ [1 kHz, 20° C.]: | 3.7 |
| CCY-3-O3 | 4.50% | $\epsilon_{\perp}$ [1 kHz, 20° C.]: | 7.7 |
| CCY-4-O2 | 6.00% | $\gamma_1$ [mPa · s, 20° C.]: | 120 |
| CCY-5-O2 | 4.00% | $K_1$ [pN, 20° C.]: | 13.4 |
| CPY-2-O2 | 8.00% | $K_3$ [pN, 20° C.]: | 15.4 |
| CPY-3-O2 | 9.00% | $V_0$ [20° C., V]: | 2.06 |
| PYP-2-4 | 2.00% | | |
| CC-3-V | 32.00% | | |

Example 157a

The mixture from Example 157 is additionally stabilised with 0.015% of

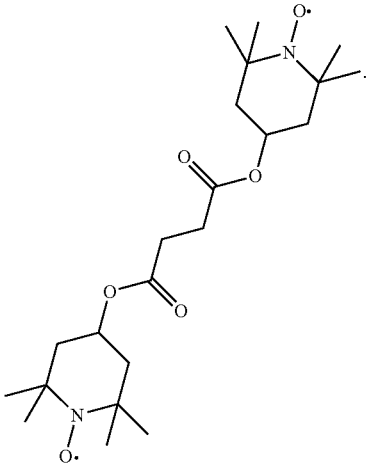

Example 158

| | | | |
|---|---|---|---|
| CY-3-O2 | 15.00% | Clearing point [° C.]: | 79.1 |
| CY-5-O2 | 9.50% | Δn [589 nm, 20° C.]: | 0.0944 |
| CCY-3-O1 | 4.00% | Δε [1 kHz, 20° C.]: | −4.0 |
| CCY-3-O2 | 6.00% | $\epsilon_{\parallel}$ [1 kHz, 20° C.]: | 3.7 |
| CCY-3-O3 | 4.50% | $\epsilon_{\perp}$ [1 kHz, 20° C.]: | 7.7 |
| CCY-4-O2 | 6.00% | $\gamma_1$ [mPa · s, 20° C.]: | 120 |
| CCY-5-O2 | 4.00% | $K_1$ [pN, 20° C.]: | 13.4 |
| CPY-2-O2 | 8.00% | $K_3$ [pN, 20° C.]: | 15.4 |
| CPY-3-O2 | 9.00% | $V_0$ [20° C., V]: | 2.06 |
| PYP-2-4 | 2.00% | | |
| CC-3-V | 32.00% | | |

Example 158a

The mixture from Example 158 is additionally stabilised with 0.015% of

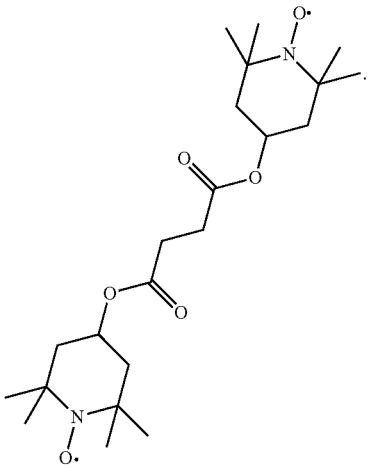

Example 159

| | | | |
|---|---|---|---|
| APUQU-3-F | 4.00% | Clearing point [° C.]: | 85.7 |
| CC-3-V | 41.00% | Δn [589 nm, 20° C.]: | 0.1004 |
| CC-3-V1 | 6.50% | Δε [1 kHz, 20° C.]: | 6.8 |
| CCP-V-1 | 12.00% | $\epsilon_{\parallel}$ [1 kHz, 20° C.]: | 9.8 |
| CCP-V2-1 | 11.00% | $\epsilon_{\perp}$ [1 kHz, 20° C.]: | 3.0 |
| CPGP-5-3 | 2.50% | $\gamma_1$ [mPa · s, 20° C.]: | 69 |
| PGUQU-3-F | 5.00% | $K_1$ [pN, 20° C.]: | 13.0 |
| PGUQU-4-F | 4.00% | $K_3$ [pN, 20° C.]: | 16.6 |
| PGUQU-5-F | 3.50% | $V_0$ [20° C., V]: | 1.47 |
| PUQU-3-F | 10.50% | | |

Example 160

| | | | |
|---|---|---|---|
| CC-3-V | 32.50% | Clearing point [° C.]: | 74.7 |
| CC-3-V1 | 1.50% | Δn [589 nm, 20° C.]: | 0.1090 |
| CCY-3-O1 | 8.50% | Δε [1 kHz, 20° C.]: | −3.8 |
| CCY-3-O2 | 5.50% | $\epsilon_{\parallel}$ [1 kHz, 20° C.]: | 3.7 |
| CLY-3-O2 | 10.00% | $\epsilon_{\perp}$ [1 kHz, 20° C.]: | 7.5 |
| CPY-3-O2 | 9.50% | $\gamma_1$ [mPa · 20° C.]: | 102 |
| PY-3-O2 | 10.50% | $K_1$ [pN, 20° C.]: | 13.8 |
| CY-3-O2 | 14.00% | $K_3$ [pN, 20° C.]: | 15.7 |
| PYP-2-3 | 8.00% | $V_0$ [20° C., V]: | 2.15 |

Example 161

| | | | |
|---|---|---|---|
| CC-3-V | 33.00% | Clearing point [° C.]: | 80.2 |
| CCY-3-O1 | 6.00% | Δn [589 nm, 20° C.]: | 0.1116 |
| CCY-3-O2 | 8.00% | Δε [1 kHz, 20° C.]: | −4.1 |
| CCY-4-O2 | 2.50% | $\epsilon_{\parallel}$ [1 kHz, 20° C.]: | 3.7 |
| CPY-2-O2 | 8.00% | $\epsilon_{\perp}$ [1 kHz, 20° C.]: | 7.8 |
| CPY-3-O2 | 12.00% | $\gamma_1$ [mPa · s, 20° C.]: | 119 |
| CLY-3-O2 | 8.00% | $K_1$ [pN, 20° C.]: | 14.5 |
| PY-1-O4 | 1.50% | $K_3$ [pN, 20° C.]: | 16.1 |
| PY-3-O2 | 10.00% | $V_0$ [20° C.,]: | 2.09 |
| PY-4-O2 | 8.00% | | |
| CY-3-O2 | 3.00% | | |

Example 161a

The mixture from Example 161 is additionally stabilised with 0.008% of

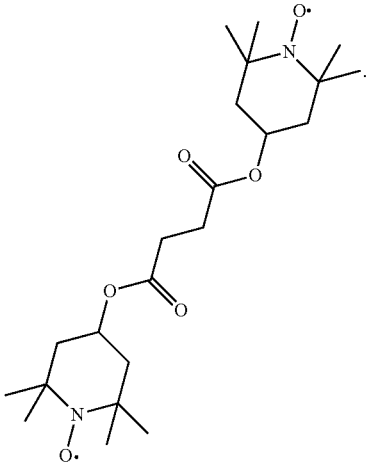

Example 162

| | | | |
|---|---|---|---|
| BCH-3F.F | 5.00% | Clearing point [° C.]: | 101 |
| BCH-3F.F.F | 8.50% | Δn [589 nm, 20° C.]: | 0.0925 |
| CC-3-V1 | 10.00% | Δε [1 kHz, 20° C.]: | 5.3 |
| CC-4-V | 12.50% | $\epsilon_{\parallel}$ [1 kHz, 20° C.]: | 8.3 |
| CCG-V-F | 9.00% | $\gamma_1$ [mPa · s, 20° C.]: | 119 |
| CCP-2F.F.F | 3.50% | $K_1$ [pN, 20° C.]: | 14.2 |
| CCP-3-1 | 4.50% | $K_3$ [pN, 20° C.]: | 19.9 |
| CCP-3F.F.F | 10.00% | $V_0$ [20° C., V]: | 1.73 |
| CCP-V-1 | 12.00% | | |
| CCP-V2-1 | 7.00% | | |
| ECCP-5F.F | 13.00% | | |
| PUQU-3-F | 5.00% | | |

Example 163

| | | | |
|---|---|---|---|
| APUQU-2-F | 4.00% | Clearing point [° C.]: | 86.4 |
| APUQU-3-F | 6.00% | Δn [589 nm, 20° C.]: | 0.1030 |
| PUQU-3-F | 10.00% | Δε [1 kHz, 20° C.]: | 7.0 |
| CCQU-3-F | 2.00% | $\epsilon_{\parallel}$ [1 kHz, 20° C.]: | 10.1 |
| CCP-V-1 | 13.00% | $\gamma_1$ [mPa · s, 20° C.]: | 71 |
| CCP-V2-1 | 7.00% | $K_1$ [pN, 20° C.]: | 13.2 |
| PGUQU-3-F | 6.00% | $K_3$ [pN, 20° C.]: | 15.8 |
| CC-3-V | 40.00% | $V_0$ [20° C., V]: | 1.45 |
| CC-3-V1 | 5.50% | | |
| PGP-2-3 | 3.00% | | |
| CPGP-5-2 | 3.00% | | |
| PPGU-3-F | 0.50% | | |

Example 163a

The mixture from Example 163 is additionally mixed with 0.25% of RM-41

RM-41

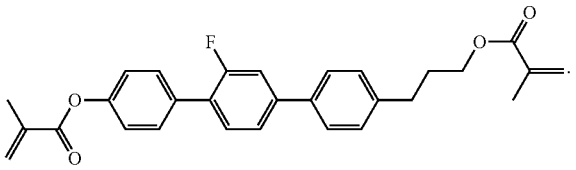

Example 164

| | | | |
|---|---|---|---|
| Y-4O-O4 | 9.00% | Clearing point [° C.]: | 96 |
| CY-3-O4 | 12.00% | Δn [589 nm, 20° C.]: | 0.0796 |
| CCY-3-O1 | 5.00% | Δε [1 kHz, 20° C.]: | −2.3 |
| CCY-3-O2 | 5.50% | $\epsilon_{\parallel}$ [1 kHz, 20° C.]: | 3.4 |
| CCY-3-O3 | 5.50% | $\epsilon_{\perp}$ [1 kHz, 20° C.]: | 5.7 |
| CC-4-V | 15.00% | $K_1$ [pN, 20° C.]: | 14.8 |
| CC-5-V | 5.50% | $K_3$ [pN, 20° C.]: | 16.6 |
| CC-3-V1 | 6.50% | $V_0$ [20° C., V]: | 2.85 |
| CCP-V-1 | 11.00% | | |
| CCP-V2-1 | 10.00% | | |
| CH-33 | 3.00% | | |
| CH-35 | 3.00% | | |
| CCPC-33 | 4.50% | | |
| CCPC-34 | 4.50% | | |

Example 165

| | | | |
|---|---|---|---|
| Y-4O-O4 | 11.50% | Clearing point [° C.]: | 95 |
| CCY-3-O1 | 4.00% | Δn [589 nm, 20° C.]: | 0.1697 |
| CCY-3-O2 | 5.00% | Δε [1 kHz, 20° C.]: | −4.4 |
| CCY-3-O3 | 2.50% | $\epsilon_{\parallel}$ [1 kHz, 20° C.]: | 4.1 |
| CPY-3-O2 | 4.00% | $\epsilon_{\perp}$ [1 kHz, 20° C.]: | 8.5 |
| CC-4-V | 10.00% | $\gamma_1$ [mPa · s, 20° C.]: | 193 |
| CCP-V-1 | 6.00% | $K_1$ [pN, 20° C.]: | 16.8 |
| CCP-V2-1 | 12.00% | $K_3$ [pN, 20° C.]: | 19.5 |
| BCH-32 | 5.00% | $V_0$ [20° C., V]: | 2.23 |
| PTP-302FF | 12.00% | | |
| PTP-502FF | 12.00% | | |
| CPTP-302FF | 8.00% | | |
| CPTP-502FF | 8.00% | | |

Example 166

| | | | |
|---|---|---|---|
| CY-3-O2 | 10.00% | Clearing point [° C.]: | 80.7 |
| PY-1-O4 | 5.00% | Δn [589 nm, 20° C.]: | 0.1123 |
| PY-3-O2 | 6.50% | Δε [1 kHz, 20° C.]: | −4.2 |
| PY-4-O2 | 3.00% | $\epsilon_{\parallel}$ [1 kHz, 20° C.]: | 3.8 |
| CCY-3-O1 | 5.00% | $\epsilon_{\perp}$ [1 kHz, 20° C.]: | 8.0 |
| CCY-3-O2 | 5.00% | $\gamma_1$ [mPa · s, 20° C.]: | 150 |
| CCY-4-O2 | 3.00% | $K_1$ [pN, 20° C.]: | 14.6 |
| CLY-3-O2 | 8.00% | $K_3$ [pN, 20° C.]: | 15.2 |
| CPY-2-O2 | 10.00% | $V_0$ [20° C., V]: | 2.01 |
| CPY-3-O2 | 10.00% | | |
| CCH-301 | 8.50% | | |
| CCH-23 | 12.00% | | |
| CCH-34 | 4.50% | | |
| CCH-35 | 3.00% | | |
| BCH-32 | 6.50% | | |

Example 167

| | | | |
|---|---|---|---|
| PCH-3N.F.F | 7.00% | Clearing point [° C.]: | 91 |
| CP-1V-N | 18.00% | Δn [589 nm, 20° C.]: | 0.2003 |
| CP-V2-N | 16.00% | Δε [1 kHz, 20° C.]: | 10.3 |
| CC-4-V | 12.00% | $\epsilon_{\parallel}$ [1 kHz, 20° C.]: | 14.3 |
| CCP-V-1 | 9.00% | $\epsilon_{\perp}$ [1 kHz, 20° C.]: | 4.0 |
| PPTUI-3-2 | 18.00% | | |
| PPTUI-3-4 | 20.00% | | |

Example 168

| | | | |
|---|---|---|---|
| BCH-32 | 8.00% | Clearing point [° C.]: | 96 |
| CC-3-V | 24.50% | Δn [589 nm, 20° C.]: | 0.1195 |
| CCP-V-1 | 8.00% | Δε [1 kHz, 20° C.]: | −2.7 |
| CCY-2-1 | 2.00% | $\epsilon_{\parallel}$ [1 kHz, 20° C.]: | 3.3 |
| CCY-3-O1 | 6.00% | | |
| CCY-3-O3 | 2.00% | | |
| CLY-3-O2 | 5.00% | | |
| CLY-3-O3 | 5.00% | | |
| CPY-2-O2 | 6.50% | | |
| CPY-3-O2 | 6.00% | | |
| CY-3-O2 | 6.00% | | |
| CY-3-O4 | 3.00% | | |
| CY-5-O2 | 5.00% | | |
| PYP-2-3 | 6.50% | | |
| PYP-2-4 | 6.50% | | |

Example 168a

The mixture from Example 168 is additionally stabilised with
0.03% of

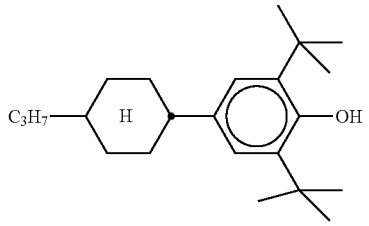

and mixed with
0.4% of

RM-41

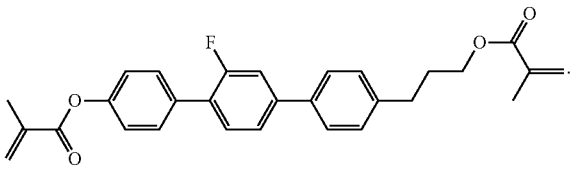

The invention claimed is:

1. A filling device (1) for dispensing a fluid into at least one container, comprising a weighing scale (2), which has at least one container positioning receptacle (4) which is adapted to a container diameter, where the weighing scale (2) is arranged on an accommodation platform (7) which is movable vertically along a linear track (6) and where a filling-needle (3) is arranged on a displacement block (8) in a position at a distance in the axial direction above the positioning receptacle (4).

2. The filling device (1) according to claim 1, comprising two or more weighing scales (2), where the weighing scales (2) are each arranged on an accommodation platform (7) which is movable vertically by, in each case, one linear track (6).

3. The filling device (1) according to claim 1, wherein the filling-needle (3) is present in combination with an inertisation needle (12).

4. The filling device (1) according to claim 1, wherein the filling-needle (3) is arranged in a clamping block (13) which is removable from the displacement block (8).

5. The filling device (1) according to claim 1, wherein components of the filling-needle (3) which may come into contact with the respective fluid used during the filling operation consist of stainless steel and/or polytetrafluoroethylene (PTFE).

6. The filling device (1) according to claim 1, wherein a membrane valve is installed upstream of the filling-needle (3).

7. The filling device (1) according to claim 6, wherein a filter unit (9) is installed upstream of the membrane valve.

8. The filling device (1) according to claim 1, wherein ionisers are present laterally, above and/or below the filling-needle (3) and are capable of emitting a directed stream of ionised air against the filling-needle (3).

9. The filling device (1) according to claim 1, wherein protective walls (16) having an antistatic coating are arranged laterally to the filling-needle (3).

10. The filling device (1) according to claim 1, wherein the positioning receptacle (4) has an annular shape.

11. The filling device (1) according to claim 1, further comprising a drop-catching vessel (5), which is attached to a swivel arm, and which vessel is capable of being swiveled beneath the filling-needle (3) if no container is located in the positioning receptacle (4) or after the filling operation is complete.

12. A method for dispensing a fluid into at least one container, comprising dispensing said fluid into the at least one container by the filling device (1) according to claim 1.

13. A method for dispensing a liquid-crystal mixture, comprising dispensing said liquid-crystal mixture by the filling device (1) according to claim 1.

14. The method according to claim 12, which is carried out in a clean room.

15. The method according to claim 13, which is carried out in a clean room.

* * * * *